US005514506A

United States Patent [19]

Takai et al.

[11] Patent Number: 5,514,506

[45] Date of Patent: May 7, 1996

[54] LIGHT RECEIVING MEMBER HAVING A MULTI-LAYERED LIGHT RECEIVING LAYER WITH AN ENHANCED CONCENTRATION OF HYDROGEN OR/AND HALOGEN ATOMS IN THE VICINITY OF THE INTERFACE OF ADJACENT LAYERS

[75] Inventors: Yasuyoshi Takai, Nara; Tetsuya Takei, Nagahama; Hirokazu Otoshi; Ryuji Okamura, both of Nara; Hiroyuki Katagiri; Satoshi Kojima, both of Tsuzuki, all of Japan

[73] Assignee: Canon Kabushiki Kaisha, Tokyo, Japan

[21] Appl. No.: 165,840

[22] Filed: Dec. 14, 1993

[30] Foreign Application Priority Data

| | | | |
|---|---|---|---|
| Dec. 14, 1992 | [JP] | Japan | 4-333220 |
| Apr. 22, 1993 | [JP] | Japan | 5-096038 |
| Apr. 22, 1993 | [JP] | Japan | 5-096039 |
| Nov. 19, 1993 | [JP] | Japan | 5-290561 |

[51] Int. Cl.[6] ..... G03D 5/082

[52] U.S. Cl. ..... 430/57; 430/63; 430/65; 430/66

[58] Field of Search ..... 430/57, 63, 65, 430/66

[56] References Cited

U.S. PATENT DOCUMENTS

| | | | |
|---|---|---|---|
| 4,225,222 | 9/1980 | Kempter | 355/3 DR |
| 4,265,991 | 5/1981 | Hirai et al. | 430/64 |
| 4,359,512 | 11/1982 | Fukuda et al. | 430/57 |
| 4,359,514 | 11/1982 | Shimizu et al. | 430/65 |
| 4,360,821 | 11/1982 | Tsukada et al. | 357/31 |
| 4,394,425 | 7/1983 | Shimizu et al. | 430/65 |
| 4,394,426 | 7/1983 | Shimizu et al. | 430/65 |
| 4,451,547 | 5/1984 | Hirai et al. | 430/128 |
| 4,461,819 | 7/1984 | Nakagawa et al. | 430/59 |
| 4,507,375 | 3/1985 | Hirai et al. | 430/128 |
| 4,529,679 | 7/1985 | Ogawa et al. | 430/84 |
| 4,551,405 | 11/1985 | Nakagawa et al. | 430/64 |
| 4,555,465 | 11/1985 | Ogawa et al. | 430/95 |
| 4,557,990 | 12/1985 | Nakagawa et al. | 430/84 |
| 4,613,558 | 9/1986 | Nakagawa et al. | 430/84 |
| 4,906,542 | 3/1990 | Aoike et al. | 430/57 |
| 4,986,574 | 11/1988 | Shirzi et al. | 430/65 |

FOREIGN PATENT DOCUMENTS

| | | |
|---|---|---|
| 2746967 | 4/1979 | Germany . |
| 2855718 | 6/1979 | Germany . |
| 2933411 | 3/1980 | Germany . |
| 59-119360 | 7/1984 | Japan . |

*Primary Examiner*—Christopher D. Rodee

*Attorney, Agent, or Firm*—Fitzpatrick, Cella, Harper & Scinto

[57] ABSTRACT

A light receiving member comprising a substrate and a light receiving layer disposed on said substrate, said light receiving layer having a stacked structure comprising a plurality of constituent layers each being composed of a non-single crystal material containing silicon atoms as a matrix and at least either hydrogen atoms or halogen atoms, characterized in that said light receiving layer has a region containing at least one kind of atoms selected from the group consisting of hydrogen atoms and halogen atoms at an enhanced concentration distribution in the thickness direction in the vicinity of at least one layer interface of the light receiving layer.

34 Claims, 11 Drawing Sheets

LIGHT RECEIVING MEMBER HAVING A MULTI-LAYERED LIGHT RECEIVING LAYER WITH AN ENHANCED CONCENTRATION OF HYDROGEN OR/AND HALOGEN ATOMS IN THE VICINITY OF THE INTERFACE OF ADJACENT LAYERS

BACKGROUND OF THE INVENTION

1. Field of the Invention

The present invention relates to an improved light receiving member which is highly sensitive to electromagnetic waves such as light (which herein means in a broad sense light such as ultraviolet rays, visible rays, infrared rays, X-rays, and γ-rays). More particularly, the present invention relates to an improved light receiving member having a multi-layered light receiving layer with an enhanced concentration of hydrogen or/and halogen atoms in the vicinity of the interface of adjacent layers which is suitable as a photosensitive member for use in information processing devices such as electrophotographic copying machines and laser beam printers, as a photosensor, or as a solar cell.

2. Description of Related Background Art

For the photoconductive material to constitute an image-forming material for use in solid image pickup device or electrophotography, or to constitute a photoconductive material for use in image-reading photosensor, it is required to be highly sensitive, to have a high S/N ratio (photocurrent (Ip)/dark current (Id)), to have absorption spectrum characteristics suited for an electromagnetic wave irradiated, to be quickly responsive and to have a desired dark resistance. It is also required to be not harmful to living things, especially man, upon use.

As the photoconductive material which satisfies these requirements, there are known so-called amorphous silicon materials (the amorphous silicon material will be hereinafter referred to as "a-Si material"). It is known that a-Si materials are high in Vickers hardness and have a good durability. There are a number of proposals of applying a-Si materials in the preparation of electronic devices. For example, U.S. Pat. Nos. 4,265,991, 4,451,547, 4,552,824, and 4,507,375, and Offenlegungsschriftes Nos. 2746967 and 2855718 disclose use of a-Si materials in electrophotographic image-forming members. Further, Offenlegungsschrift No. 2933411 discloses use of a-Si materials in a photoelectric conversion image-reading device. Other than these, U.S. Pat. Nos. 4,461,819, 4,551,405, 4,557,990, 4,613,558, 4,359,512, and 4,359,514 disclose light receiving members having an a-Si light receiving layer with a stacked structure comprising two or more layers each having a different conductivity and wherein a depletion layer is formed in an interfacial region between adjacent layers. In addition, U.S. Pat. Nos. 4,394,425 and 4,394,426 disclose layer constitutions of improving the light receiving member comprising an a-Si material such that it can be designed at a relatively relaxed construction while maintaining the advantage of the a-Si material of exhibiting a high photosensitivity even when the dark resistance is low to a certain extent. The particulars of these layer constitutions include a manner of designing the light receiving member to be of a multi-layered structure having a barrier layer between a substrate and a light receiving layer (having a photoconductive layer) and a manner of designing the light receiving member to be of a multi-layered structure having a barrier layer over a light receiving layer (having a photoconductive layer). The "barrier layer" herein means a layer which functions to prevent a photocarrier from getting into the photoconductive layer from either the substrate side or the outermost layer side and to allow a photocarrier generated in the photoconductive layer upon the irradiation of an electromagnetic wave which mobilizes toward the substrate side, to move from the photoconductive layer side toward either the substrate side or the outermost layer side.

A number of electrophotographic image-forming members each comprising an a-Si material (hereinafter referred to as a-Si electrophotographic image-forming member or a-Si light receiving member) based on the above proposals have been commercialized. However, for any of the conventional a-Si electrophotographic image-forming members (the conventional a-Si light receiving members in other words), there are still some subjects which requires further improvements in terms of overall viewpoints including electrical, optical and photoconductive characteristics such as dark resistance, photosensitivity, photoresponsiveness, and the like, use-environmental characteristics such as moisture resistance, durability, and the like, and economic stability, in order to satisfy the requirements desired for a light receiving member used in the recent electrophotographic copying machines.

In recent years, a remarkable improvement has been made in the electrophotographic copying machine especially in terms of copying speed and durability upon repeated use over a long period of time. Particularly, there has been developed an improved electrophotographic copying machine which can operate at a higher process speed while exhibiting its image-reproducing performance without being deteriorated even upon repeated use over a long period of time. For such electrophotographic copying machine, there is a demand for improving the reliability of each constituent member thereof so that the maintenance work frequency can be reduced, in order to curtail the expenses required for the maintenance work. Other than this, there is another demand for further improving the electrophotographic copying machine so that it can attain a large volume image reproduction of high quality and high resolution at a high speed.

Along with this, there is an increased demand for providing an improved a-Si light receiving member which exhibits an improved charge retentivity and an improved sensitivity which is suitable for use in such electrophotographic copying machine.

In the case of repeatedly conducting the electrophotographic image-forming process comprising charging, exposure, developing and transfer steps at a higher speed in the electrophotographic copying machine using the conventional a-Si light receiving member (that is, the conventional a-Si electrophotographic photosensitive member), there often occurs a problem in that the a-Si light receiving member does not exhibit a photoresponsibility sufficient to follow the increased, image-forming process speed and because of this, it is difficult to stably and repeatedly obtain a high quality copied image at a higher speed. Particularly, in the case where a half-tone based original is subjected to repetitive reproduction at a high speed in the electrophotographic copying machine using the conventional a-Si light receiving member (the conventional a-Si electrophotographic photosensitive member), there is a tendency that the resulting copied images often have defects such as insufficiency in half-tone resolution, and unevenness in image density, which are found slightly in the case of copied images reproduced from a character original. Therefore, it is difficult to repeatedly obtain a high quality copied image which is equivalent to the half-tone original. This tendency is apparent in the case of using a half-tone original in a single color and with a uniform density in the entire area such as a photograph of a blue sky, a photograph of a single-colored wall of a building, or a single-colored paper, wherein the appearance of the above defects on the resulting copied images is apparent, especially in terms of unevenness in image density. This situation becomes significant as the image-forming speed is heightened.

Description will be made of this situation. That is, upon repeatedly conducting the electrophotographic image-forming process in the electrophotographic copying machine, the related image-forming parameters including the surface potential and surface temperature of the a-Si light receiving member are properly adjusted so as to repeatedly provide an identical desirable copied image in each repetition of the image-forming process by detecting these parameters by means of a sensor disposed in the copying machine and controlling them to predetermined respective values by means of a control mechanism disposed in the copying machine. In the case where the photoresponsibility of the a-Si light receiving member is insufficient to follow the image-forming process speed, the a-Si light receiving member after having been subjected to the electrophotographic image-forming process is barely returned to the original state which is completely free of the remainder of the previous latent image, wherein the values of the parameters of the a-Si light receiving member detected by means of the sensor are eventually varied. In this case, it is necessary to properly adjust the image-forming parameters of the a-Si light receiving member in each repetition of the image-forming process. Should this situation be continued over a long period of time, problems eventually occur in that it is difficult to continuously provide an identical desirable copied image, and a serious burden is imposed upon the control mechanism, sometimes resulting in shortening the machine main body life. Particularly, for the copied images provided upon repeating the image-forming process, there often appear image defects such as deficiency in minute line reproduction, appearance of white fogging (or white marks on half-tone copies), unevenness in image density, and the like, which are likely due to unevenness in charge retentivity and unevenness in photosensitivity of the a-Si light receiving member.

The appearance of these image defects is relatively marked in the case of reproducing a large copy volume at a higher speed using the large-sized high performance electrophotographic copying machine. Particularly, in the case of repeatedly conducting the image-forming process at a higher speed using the conventional a-Si light receiving member, the sensitivity exhibited by the a-Si light receiving member is insufficient to follow the image-forming process speed. Hence, there often occurs a problem in that the latent images formed on the a-Si light receiving member in the previous image-forming process still remain in the form of a half-tone, resulting in providing a ghost on a copied image obtained. In addition to this, there often occurs another problem such that, as so-called blank exposure is usually conducted to the a-Si light receiving member once having been subjected to the electrophotographic image-forming process to extinguish the surface charge in order to prevent a surface portion of the a-Si light receiving member corresponding to the interval between one copying paper sheet and the other copying paper sheet to be successively supplied, from being deposited with toner, the history of the previous blank exposure often remain to cause a so-called blank exposure memory on an image reproduced. The image obtained is accompanied by such blank exposure memory and is poor in uniformity in terms of density. (The above ghost and blank exposure memory will be hereinafter collectively expressed by an inclusive term "photomemory".)

These problems are more liable to occur in the case of repeatedly conducting the image-forming process at a higher speed using the conventional a-Si light receiving member having a multi-layered photoconductive layer comprising a plurality of layers each having a different optical band gap or having a function-divided photoconductive layer comprising a charge generation layer and a charge transportation layer, since there is a tendency that not only the photosensitivity but also the mobility of a photocarrier at the interface between the adjacent layers becomes insufficient and the charge retentivity is lowered as the image-forming process speed is increased.

As above described, conventional a-Si light receiving members are problematic in that the photoresponsibility and the mobility of a photocarrier become insufficient and the appearance of photomemory are apparent as the image-forming process speed is increased.

Incidentally, there is a demand for providing a compact electrophotographic copying machine which can operate at a high speed. The a-Si light receiving member (the a-Si electrophotographic photosensitive member) to be used in such compact electrophotographic copying machine is accordingly required to be of a small size so that it can be suitable for use therein. In this case, the image-forming process speed is eventually increased to a level which is markedly higher than that used in the ordinary electrophotographic copying machine with the use of the ordinary a-Si light receiving member, in order to attain the same copy volume in the conventional electrophotographic copying machine. The occurrence of the above problems becomes more significant in this case.

Now, in order to avoid the occurrence of the foregoing problems in the case of repeatedly conducting the image-forming process at a higher speed using the conventional a-Si light receiving member, it is necessary to take measures such as enlarging the charger and/or of effectively conducting the charging within a short period of time, and in addition, it is necessary to employ an exposure mechanism having a high power-outputting performance. These factors lead to not only raising the production cost of an electrophotographic copying machine but also making the electrophotographic copying machine larger in size.

SUMMARY OF THE INVENTION

A principal object of the present invention is to eliminate the foregoing problems in the conventional light receiving member and to provide an improved light receiving member having an improved light receiving layer composed of a non-single crystal material which is free of the foregoing problems and capable of satisfying various kinds of requirements.

Another object of the present invention is to provide a light receiving member having an improved light receiving layer composed of a non-single crystal material in which electrical, optical and photoconductive properties are always substantially stable without depending on working circumstances, and which is excellent against light fatigue, causes no degradation upon repeated use, excels in durability and moisture-resistance, and exhibits no or minimal residual potential and provides easy production control.

A further object of the present invention is to provide a light receiving member having an improved light receiving layer composed of a non-single crystal material which always and stably exhibits a desirable photoresponsibility sufficiently to follow the increased, image-forming process speed in a high speed copying machine.

A further object of the present invention is to provide a light receiving member having an improved light receiving layer composed of a non-single crystal material which enables one to stably and repeatedly reproduce a high quality image without the appearance of the foregoing photomemory at an increased, image-forming process speed.

A further object of the present invention is to provide a light receiving member having an improved light receiving layer composed of a non-single crystal material which enables one to stably and repeatedly reproduce a high quality half-tone image of uniform density without accompaniment of the appearance of the foregoing photomemory from a single-colored half-tone original at an increased, image-forming process speed.

A further object of the present invention is to provide a light receiving member having an improved stacked light receiving layer comprising a plurality of layers each comprising a non-single crystal material which excels in adhesion among the constituent layers and is precise and stable in terms of structural arrangement.

A further object of the present invention is to provide a light receiving member having an improved multi-layered light receiving layer comprising at least two layers each comprising a non-single crystal material containing silicon atoms and at least one kind of atoms selected from the group consisting of hydrogen atoms and halogen atoms, said multi-layered light receiving layer having a region containing said hydrogen and/or halogen atoms such that their concentration distribution is enhanced in the thickness direction in the vicinity of the interface between given adjacent layers.

A further object of the present invention is to provide an improved light receiving member which enables to attain miniaturization of a information processing apparatus such as a copying machine used and also to attain a reduction in the production cost thereof.

DESCRIPTION OF THE INVENTION AND THE PREFERRED EMBODIMENTS

Figure 1:
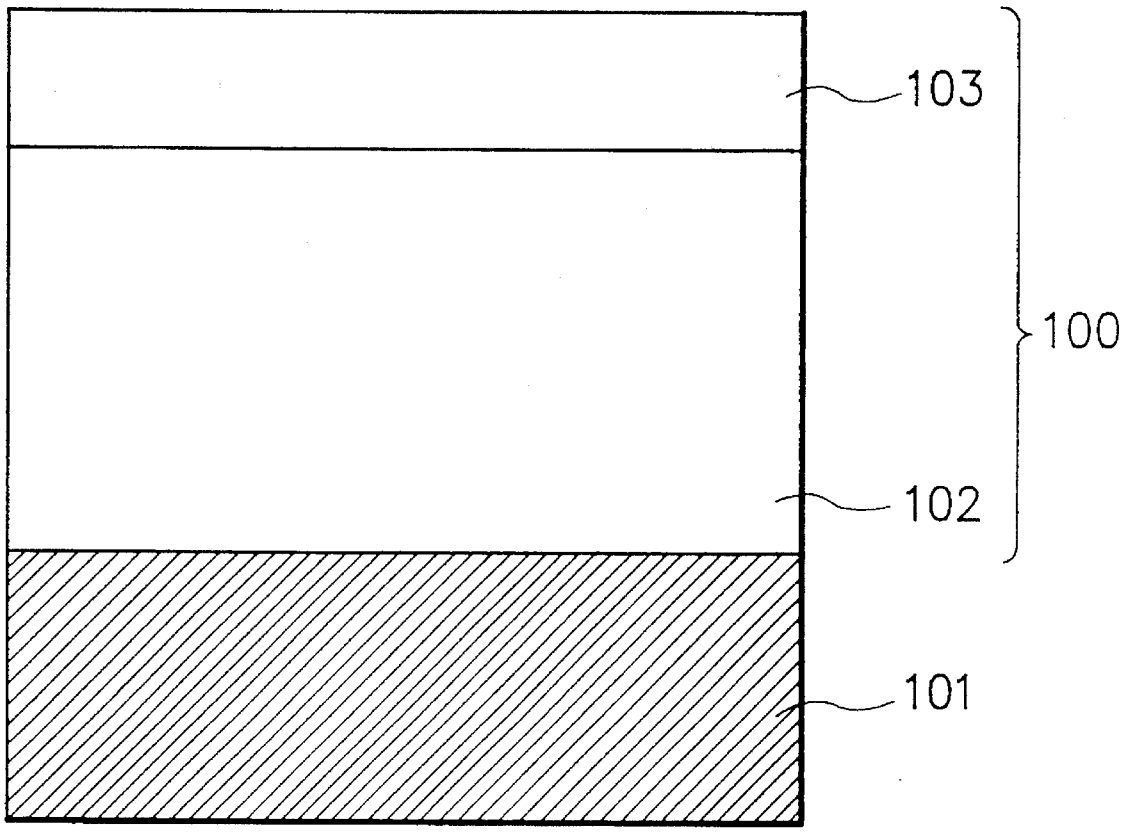
FIG. 1 is a schematic cross-section view illustrating the layer configuration of an example of a light receiving member according to the present invention.

The present invention is aimed at eliminating the foregoing problems in the conventional light receiving member and attaining the above-described objects.

The present invention is to provide an improved light receiving member comprising a substrate and a light receiving layer disposed on said substrate, said light receiving layer having a stacked structure comprising at least two layers each comprising a non-single crystal material containing silicon atoms and at least one kind of atoms selected from the group consisting of hydrogen atoms and halogen atoms, and said stacked structure having a specific region containing said hydrogen and/or halogen atoms such that their concentration is enhanced in the thickness direction in the neighborhood region of the interface between given adjacent layers.

The term "neighborhood region of the interface" in the present invention is meant to include a junction portion and a junction region between adjacent non-single crystal layers each having a different chemical composition. Specifically, for instance, in the case of a light receiving member having a light receiving layer with a stacked structure comprising a charge injection inhibition layer and a photoconductive layer formed by the plasma CVD technique, which will be later described, the "neighborhood region of the interface" corresponds the junction portion or junction region between the charge injection inhibition layer and photoconductive layer. More particularly in this respect, in the case where after said charge injection inhibition layer is formed on a substrate by the plasma CVD technique in the film-forming chamber, the discharging is terminated and the film-forming chamber is evacuated, followed by forming said photoconductive layer by the plasma CVD technique, the junction portion of each of the charge injection inhibition layer and photoconductive layer corresponds the "neighborhood region of the interface". Other than this, in the case where the charge injection inhibition layer and photoconductive layer are continuously formed by the plasma CVD technique without terminating the discharging, the resultant stacked structure has a junction region at which the charge injection inhibition layer is distinguished from the photoconductive layer in terms of difference in chemical composition. This junction region corresponds to the "neighborhood region of the interface".

The light receiving member configured as above described excels in adhesion among the constituent layers and is precise and stable in terms of structural arrangement.

The light receiving member according to the present invention stably exhibits satisfactory electrical, optical and photoconductive properties without depending on working circumstances, and it is excellent against light fatigue, causes no degradation upon repeated use, excels in durability and moisture-resistance, and exhibits no or minimal residual potential.

The light receiving member according to the present invention is free of the foregoing problems which are found in the conventional light receiving member when it is used for image reproduction by repeating the image-forming process at a higher speed in the high speed copying machine, and it always and stably exhibits a desirable photoresponsibility to sufficiently follow the image-forming process speed of a high speed copying machine wherein high quality image reproduction of a large copy volume can be attained at a high speed.

The light receiving member according to the present invention enables one to stably and repeatedly obtain a high quality half-tone image of uniform density which is equivalent to a single-colored half-tone image without accompaniment of photomemory at a high image-forming process speed.

The light receiving member according to the present invention enables one to attain high speed image reproduction of a large copy volume in the conventional high speed copying machine without the necessity of enlarging the charger and without the necessity of raising the performance of the exposure mechanism. It rather makes it possible to miniaturize the size of the copying machine used.

The present invention has been accomplished based on the following findings obtained as a result of intensive studies by the present inventor in order to attain the objects of the present invention.

There are known a number of light receiving members having a light receiving layer comprising a non-single crystal material containing silicon atoms, hydrogen atoms and/or halogen atoms such as a-Si:H material, a-Si:X material (X is halogen atom), or polycrystalline silicon material (these materials will be hereinafter referred to as "non-single crystal Si:(H,X) material" or "nc-Si:(H,X) material"). When the light receiving layer is of such a stacked structure as previously described which comprises a plurality of layers each comprising a nc-Si material (that is, a non-single crystal silicon (Si) material) being stacked, each constituent layer is usually incorporated with hydrogen atoms (H) or/and halogen atoms (X) such as fluorine atoms (F), chlorine atoms (Cl) or the like in order for the constituent layer to have desirable electrical and photoconductive properties, or in addition to these atoms, with atoms of a conductivity controlling element (M) such as boron (B), phosphorous (P), in order to provide the constituent layer with a desired conductivity, or with atoms of one or more elements other than the above mentioned elements in order to provide the constituent layer with other properties.

For these constituent layers, there is sometimes a problem that they are not satisfactory in terms of electrical and photoconductive properties when their constituent atoms are not contained in a desired state. Particularly, for the stacked structure comprising these constituent layers, the behavior of a charge which is different depending upon the kind, amount and distribution state of atoms contained in the layer region in the vicinity of the surface thereof or at the interface of the adjacent constituent layers, the structural stability of the stacked structure and the adhesion of each constituent layer are key factors to determine whether or not the light receiving member exhibits functions as expected. For instance, as for the conventional electrophotographic image-forming light receiving members having a light receiving layer with a stacked structure comprising a nc-Si material produced by a conventional manner using the plasma CVD technique, they are often unsatisfactory especially in terms of photoresponsibility, image formation repeatability and durability upon repeated use over a long period of time. The reason for this is not completely clear at the present time. One reason why these conventional nc-Si light receiving members are unsatisfactory in photoresponsibility and image formation repeatability upon repeated use over a long period of time is considered to be due to a structural distortion in the layer region in the vicinity of the surface of the stacked structure or/and at the interface between the adjacent constituent layers.

In order to eliminate the occurrence of such structural distortion at the interface between the adjacent constituent layers of a light receiving member with a nc-Si light receiving layer having a stacked structure, there are proposals as will be described below.

(1) U.S. Pat. No. 4,354,429 discloses a technique for the hetero junction non-single crystal semiconductor device wherein the chemical composition of the layer interface portion of each adjacent layer region is gradually changed such that the energy gap of one adjacent layer region is smoothly continued to the energy gap of the other adjacent layer region. Particularly, this patent literature describes a third layer region defined between adjacent first and second layer regions, wherein the third layer region has an energy gap which successively changes from the energy gap on the side of the first layer region to the energy gap on the side of the second layer region.

(2) U.S. Pat. No. 4,555,465 discloses a technique for the amorphous silicon photoconductive member comprising a substrate and an amorphous silicon light receiving layer containing at least hydrogen atoms and having photoconductivity disposed on said substrate in (2-i) that the amorphous silicon light receiving layer is designed to have a concentration distribution for the hydrogen atoms contained in which the content of the hydrogen atoms is decreased in the thickness direction toward both ends of the layer and (2-ii) that the amorphous silicon light receiving layer is formed to have a stacked structure having a concentration distribution for the hydrogen atoms contained in which the content of the hydrogen atoms is decreased toward the interface between the adjacent layers. Particularly, this U.S.

Patent literature describes that the light receiving layer has a layer region containing hydrogen atoms such that the content of the hydrogen atoms is decreased in the thickness direction toward both ends of said layer.

(3) U.S. Pat. No. 4,529,679 discloses a technique for the photoconductive member comprising a substrate and a light receiving layer containing silicon atoms as a matrix and at least halogen atoms and having photoconductivity disposed on said substrate wherein the light receiving layer is designed to have a concentration distribution for the hydrogen atoms contained in which the content of the halogen atoms is increased in the thickness direction toward from the substrate side toward the surface side of the photoconductive member.

(4) Japanese Unexamined Patent Publication No. 119360/1984 discloses a technique for the photoconductive member comprising a substrate and an amorphous silicon light receiving layer containing at least hydrogen atoms and halogen atoms and having photoconductivity disposed on said substrate in (4-i) that the light receiving layer is designed to have (a) a concentration distribution for the hydrogen atoms contained in which the content of the hydrogen atoms is decreased in the thickness direction toward both ends of the layer and (b) a concentration distribution for the halogen atoms contained in which the content of the halogen atoms is increased in the thickness direction toward both ends of the layer and (4-ii) that the amorphous silicon light receiving layer is made to have a stacked structure having (a') a concentration distribution for the hydrogen atoms contained in which the content of the hydrogen atoms is decreased toward the interface between the adjacent layers and (b') a concentration distribution for the halogen atoms contained in which the content of the halogen atoms is increased toward the interface between the adjacent layers.

Techniques (1) to (4) present problems as will be described below.

As for technique (1), when the chemical composition of each adjacent layer region in the vicinity of the interface is gradually varied, the layer region of each adjacent layer in which the chemical composition is gradually varied provides a certain thickness (to afford a so-called third layer region). This results in an undesirable influence. That is, such layer region in which the chemical composition is gradually varied functions as a so-called intermediate layer region possessing an independent property which is different from the property possessed by each of the first and second layer regions. As the intermediate layer region is thickened to a certain extent, a problem of hindering the mobility of photocarriers among the layer regions is caused. This results in deteriorating the characteristics of the semiconductor device.

Technique (2) is aimed at distributing the hydrogen atoms, which are liable to make the light receiving layer unstable in terms of the structural stability, at a concentration distribution in which the content of the hydrogen atoms is decreased in the thickness direction toward both ends of the layer, wherein the content of the hydrogen atoms at the layer interface is smaller than the bulk layer region. This constitution makes the light receiving layer structurally stabilized so that the characteristics exhibited by the light receiving layer are improved to a certain extent. However, there still remains a problem in that dangling bonds are still present in the vicinity of the layer interface, resulting in trapping photocarriers in the layer interface.

Technique (3) is one that is focused on the halogen atoms capable of chemically boding with silicon atoms to provide a bond which is hardly broken even at a relatively high temperature, and it is aimed at raising the content of halogen atoms in the vicinity of the surface of the amorphous silicon layer where a structural change is the most liable to occur. The constitution according to this technique makes the light receiving layer structurally stabilized so that the characteristics exhibited by the light receiving layer are improved to a certain extent. However, the constitution according to this technique is still problematic in that the electric characteristics exhibited by the light receiving layer are liable to vary depending upon the state of the halogen atoms contained therein.

Technique (4) is based on a combination of techniques (2) and (3). According to this technique, the structure of the light receiving layer is further improved in terms of structural stability, as compared to technique (2). However, the constitution according to this technique presents problems as well as that according to technique (3) in that the electric characteristics exhibited by the light receiving layer are liable to vary depending upon the state of the halogen atoms contained therein.

The present inventors made extensive studies through experiments in order to attain a structurally stable junction for given adjacent light receiving layers each having a different chemical composition without deteriorating the properties of each light receiving layer, while focusing on the control of the content of hydrogen atoms or/and halogen atoms contained in the vicinity of the interface between the adjacent layers. As a result, it was found that the foregoing problems in the prior art can be effectively solved where the chemical composition of the neighborhood region of the interface of the adjacent light receiving layers is designed to have a specific concentration distribution pattern in terms of the content of hydrogen atoms or/and halogen atoms without considering the content of such atoms in the bulk layer region of each adjacent layer, specifically in the case where the stacked structure comprising a plurality of light receiving layers each comprising a non-single crystal material containing silicon atoms and at least hydrogen atoms or/and halogen atoms is designed to have a specific region containing hydrogen atoms or/and halogen atoms such that their concentration is enhanced in the thickness direction in the vicinity of the interface between given adjacent layers.

Typical examples of the constitution of the light receiving layer in the light receiving member according to the present invention will be described as follows:

(i) a stacked structure comprising a charge injection inhibition layer and a photoconductive layer wherein the content of hydrogen atoms or/and halogen atoms in the vicinity of the interface between the two layers is greater than the content of hydrogen atoms or/and halogen atoms in the bulk layer region of each of the charge injection inhibition layer and the photoconductive layer;

(ii) a stacked structure comprising a photoconductive layer and a surface layer wherein the content of hydrogen atoms or/and halogen atoms in the vicinity of the interface between the two layers is greater than the content of hydrogen atoms or/and halogen atoms in the bulk layer region of each of the photoconductive layer and the surface layer; and (iii) a stacked structure comprising a charge transportation layer and a charge generation layer wherein the content of hydrogen atoms or/and halogen atoms in the vicinity of the interface between the two layers is greater than the content of hydrogen atoms or/and halogen atoms in the bulk layer region of each of the charge transportation layer and the charge generation layer.

Any of these constitutions may comprise a further appropriate layer depending upon the application purpose.

The light receiving member having a specific multi-layered light receiving layer of any of the above constitutions according to the present invention is free of the foregoing problems which are found in the prior art, and it provides various advantages as previously described.

That is, the light receiving member according to the present invention stably and repeatedly exhibits markedly improved electrical, optical and photoconductive properties without depending on working circumstances, is excellent against light fatigue, and causes no degradation upon repeated use over a long period of time.

Particularly, the light receiving member according to the present invention provides prominent advantages in the case where it is used as an electrophotographic image-forming member for image reproduction by repeating the image-forming process at a higher speed in the high speed copying machine, in that it always and repeatedly exhibits an improved sensitivity and a desirable photoresponsibility to sufficiently follow the image-forming process speed over a long period of time without being deteriorated while exhibiting excellent electric characteristics and S/N ratio. In addition, it excels in resistance to light fatigue and durability upon repeated use especially under high moisture environments. Hence, there can be repeatedly obtained a high quality visible image which excels in image density, resolution and preciseness in which a half-tone is reproduced in a state equivalent to an original.

The constitution of the light receiving member according to the present invention can be employed in the preparation of a photosensor, wherein the resulting photosensor is one that is excellent against light fatigue and stably and repeatedly exhibits an improved S/N ratio and improved electric characteristics.

Further, the constitution of the light receiving member according to the present invention can be employed in the preparation of a photovoltaic device such as a solar cell, wherein the resulting photovoltaic device is one that is excellent against light fatigue, excels in electric characteristics, and stably and repeatedly exhibits an improved photoelectric conversion efficiency.

Detailed description will be made of the light receiving member with reference to FIGS. 1 to 3.

Figure 2:
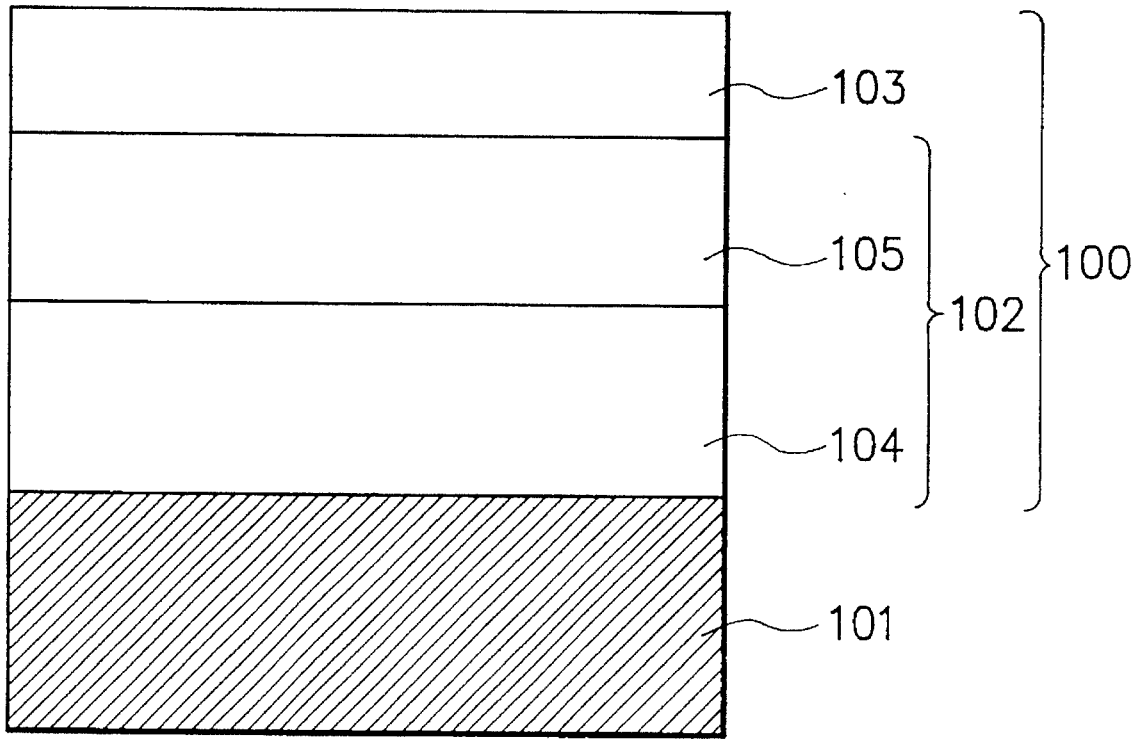
FIG. 2 is a schematic cross-section view illustrating the layer configuration of another example of a light receiving member according to the present invention.
Figure 3:
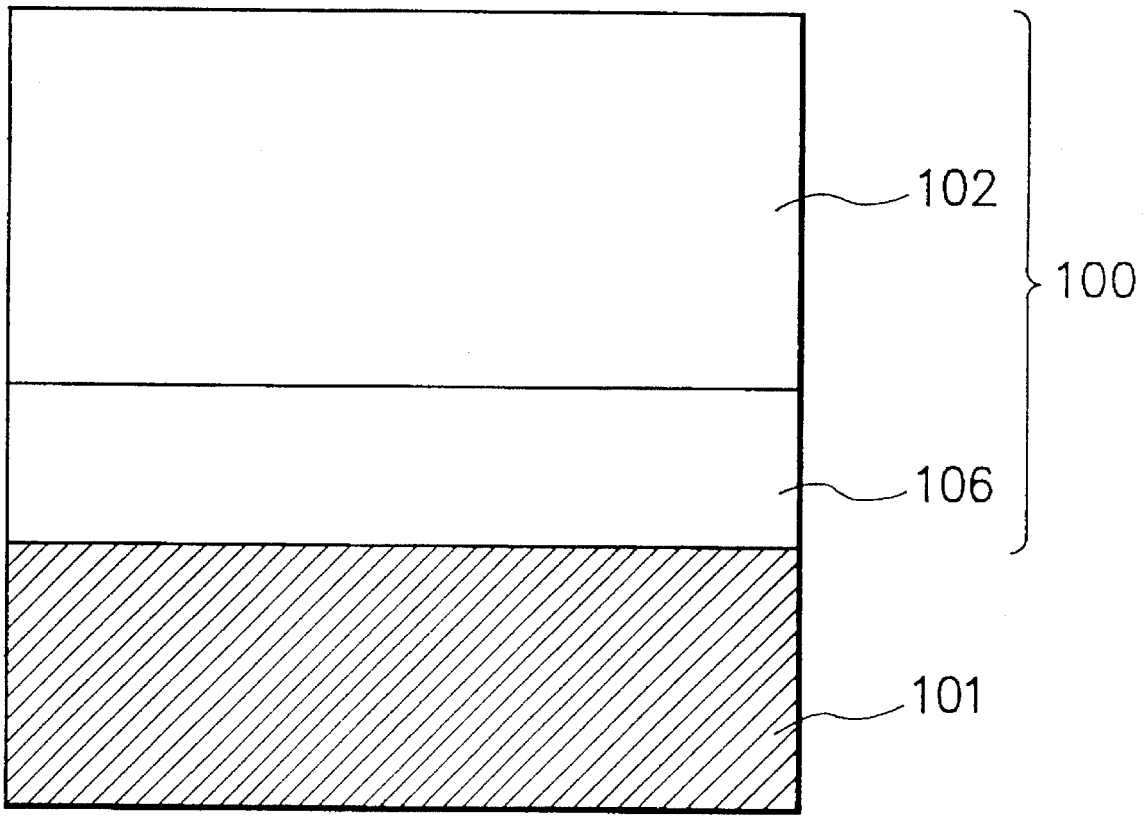
FIG. 3 is a schematic cross-section view illustrating the layer configuration of a further example of a light receiving member according to the present invention.

FIGS. 1 to 3 are schematic cross-section views each illustrating an embodiment of the layer constitution of a light receiving member usable as an electrophotographic image-forming member according to the present invention.

The light receiving member according to the present invention basically comprises a substrate and a light receiving layer having a stacked structure disposed on said substrate, said stacked structure comprising at least two layers each being constituted by a non-single crystal material containing silicon atoms as a matrix and at least one kind of atoms selected from hydrogen atoms and halogen atoms (hereinafter referred to as nc-Si (H,X) material). The receiving member having the nc-Si (H,X) light receiving layer according to the present invention may take such a constitution as shown in FIG. 1, 2 or 3. It should be understood that the light receiving member according to the present invention is not restricted to these constitutions shown in FIGS. 1 to 3 only, but it may take other appropriate constitutions.

Specifically, the light receiving member shown in FIG. 1 comprises a substrate 101 and a light receiving layer 100 disposed on said substrate 101, said light receiving layer 100 having a stacked structure comprising a nc-Si (H,X) layer 102 having photoconductivity (this layer will be hereinafter referred to as nc-Si (H,X) photoconductive layer) and a nc-Si (H,X) surface layer 103.

The light receiving member shown in FIG. 2 is a modification of the light receiving member shown in FIG. 1 in which the nc-Si (H,X) photoconductive layer in FIG. 1 is replaced by a function-divided type light receiving layer 102 comprising a charge transportation layer 104 and a charge generation layer 105 each being constituted by a nc-Si (H,X) material.

The constitution shown in FIG. 3 is one that has no surface layer. The light receiving member shown in FIG. 3 comprises a substrate 102 and a light receiving layer 100 disposed on said substrate 101, said light receiving layer 100 having a stacked structure comprising a charge injection inhibition layer 106 and a photoconductive layer 102 each being constituted by a nc-Si (H,X) material.

In any case, the hydrogen atoms (H) or/and halogen atoms contained in the light receiving layer 100 are specifically designed as will be described below.

That is, in the case of the light receiving member shown in FIG. 1, the hydrogen atoms (H) or/and halogen atoms (X) are contained in each of the photoconductive layer 102 and the surface layer 103 such that their concentration distribution is uniform in the direction parallel to the surface of the substrate 101 and their concentration distribution in the thickness direction is enhanced to be greater than the content of these atoms in the bulk layer region of each of the photoconductive layer and surface layer in the neighborhood region of the interface between the two layers.

Incidentally, the bulk layer region herein means the remaining layer region of each adjacent layer in which the neighborhood region of said layer situated in the vicinity of the layer interface is excluded.

Similarly, in the case of the light receiving member shown in FIG. 2, the hydrogen atoms (H) or/and halogen atoms (X) are contained in each of the charge transportation layer 104 and the charge generation layer 105 such that their concentration distribution is uniform in the direction parallel to the surface of the substrate 101 and their concentration distribution in the thickness direction is enhanced to be greater than the content of these atoms in the bulk layer region of each of the charge transportation layer and the charge generation layer in the neighborhood region of the interface between the two layers.

Also similarly, in the case of the light receiving member shown in FIG. 3, the hydrogen atoms (H) or/and halogen atoms (X) are contained in each of the charge injection inhibition layer 106 and the photoconductive layer 102 such that their concentration distribution is uniform in the direction parallel to the surface of the substrate 101 and their concentration distribution in the thickness direction is enhanced to be greater than the content of these atoms in the bulk layer region of each of the charge injection inhibition layer and the photoconductive layer in the neighborhood region of the interface between the two layers.

Thus, the light receiving member according to the present invention is characterized by having a multi-layered light receiving layer with a concentration distribution of hydrogen atoms (H) or/and halogen atoms (X) which is greater than the content of these atoms contained in the bulk layer region of each adjacent layer in the neighborhood region of the interface between the adjacent layers, wherein it is not always necessary for the content of the hydrogen atoms (H) or/and halogen atoms (X) in the region having such enhanced concentration distribution to be constant. The present invention includes such a configuration that the concentration distribution has a maximum concentration peak in the region in which the concentration distribution of the hydrogen atoms or/and halogen atoms is enhanced.

Figure 4:
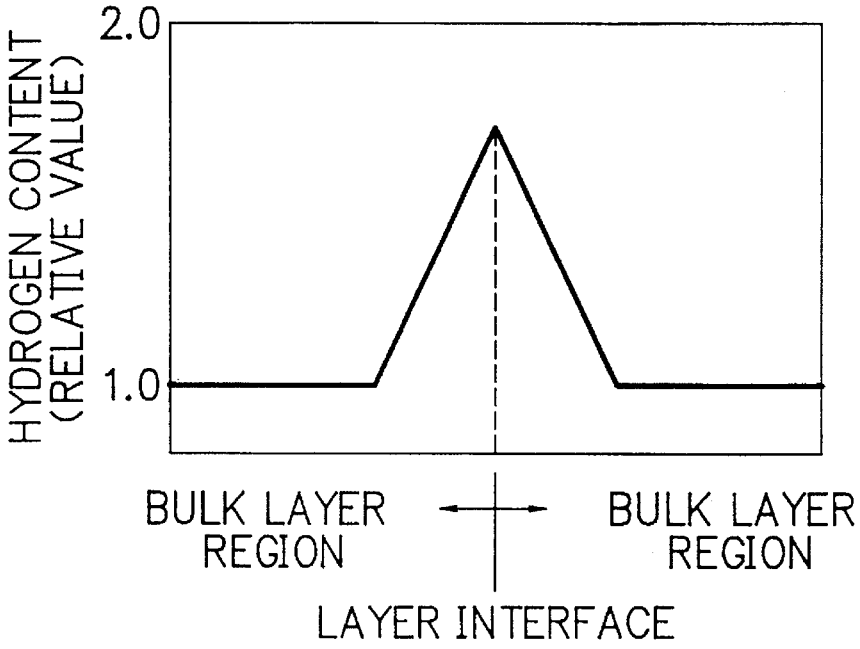
FIG. 4 is a schematic diagram showing a first pattern of the concentration distribution of hydrogen atoms in the vicinity of the interface between the adjacent layers of a light receiving member according to the present invention.
Figure 5:
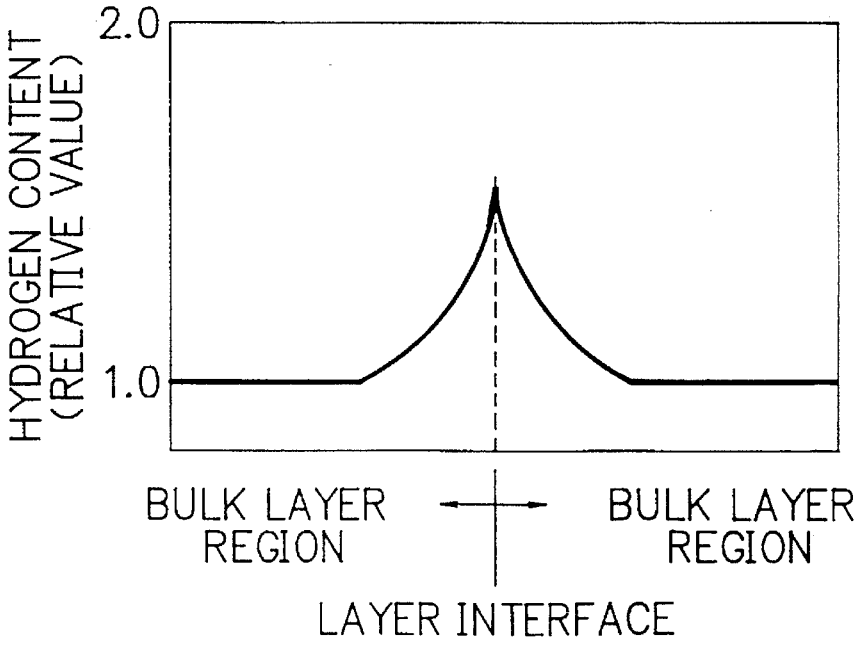
FIG. 5 is a schematic diagram showing a second pattern of the concentration distribution of hydrogen atoms in the vicinity of the interface between the adjacent layers of a light receiving member according to the present invention.

FIGS. 4 and 5 are schematic graphic views respectively illustrating a typical example of the above concentration distribution pattern of the hydrogen atoms (H) in the neighborhood region of the interface between given adjacent layers wherein the concentration distribution of the hydrogen atoms is enhanced to be greater than the content of hydrogen atoms in the bulk layer region of each of the adjacent layers in the neighborhood region of the interface between these two layers so as to provide a maximum concentration peak of the hydrogen atoms at the position where the interface is situated.

Other than these two patterns, the hydrogen concentration distribution pattern may be such a pattern as shown in any of FIGS. 6 to 11.

Figure 6:
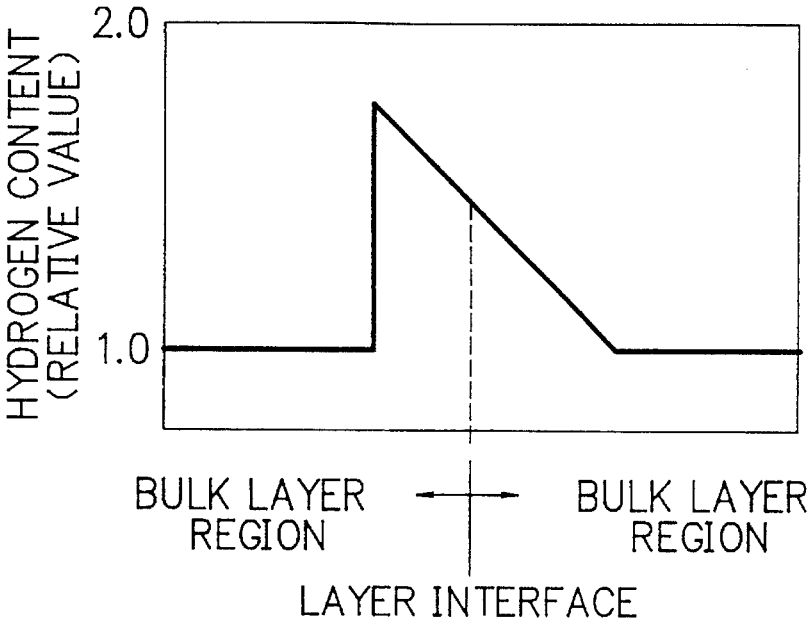
FIG. 6 is a schematic diagram showing a third pattern of the concentration distribution of hydrogen atoms in the vicinity of the interface between the adjacent layers of a light receiving member according to the present invention.
Figure 7:
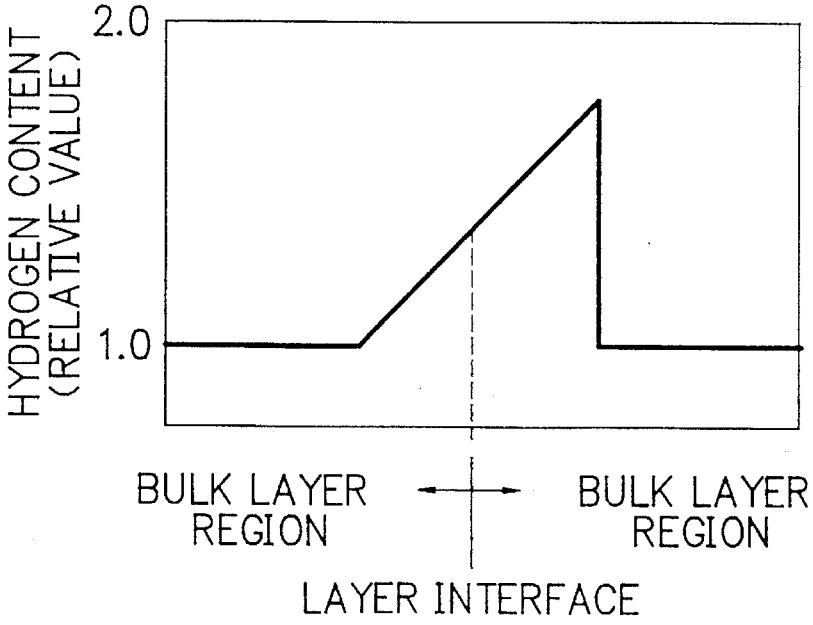
FIG. 7 is a schematic diagram showing a fourth pattern of the concentration distribution of hydrogen atoms in the vicinity of the interface between the adjacent layers of a light receiving member according to the present invention.
Figure 8:
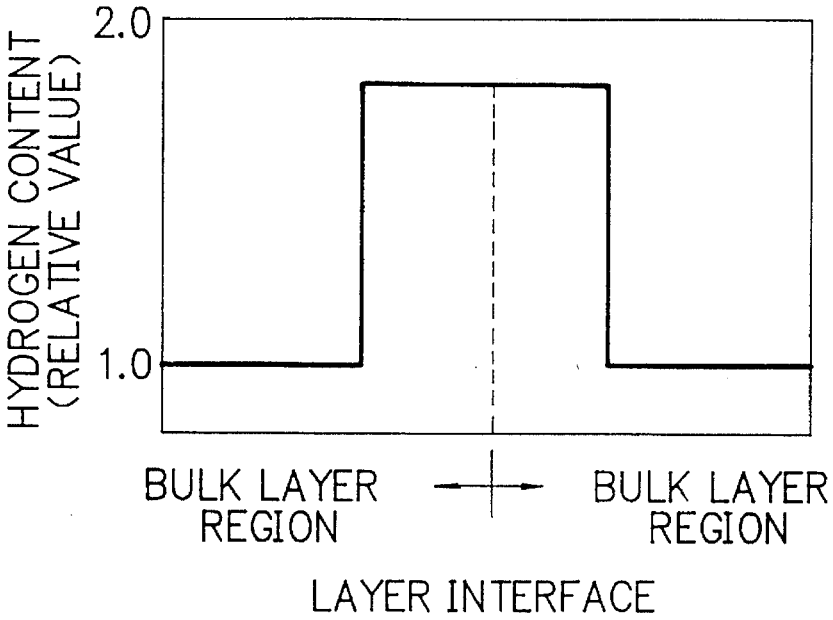
FIG. 8 is a schematic diagram showing a fifth pattern of the concentration distribution of hydrogen atoms in the vicinity of the interface between the adjacent layers of a light receiving member according to the present invention.
Figure 9:
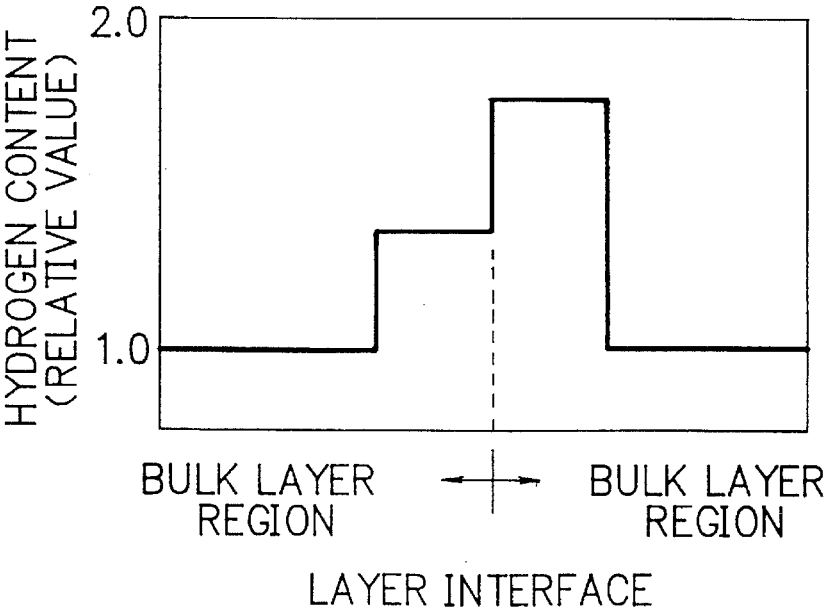
FIG. 9 is a schematic diagram showing a sixth pattern of the concentration distribution of hydrogen atoms in the vicinity of the interface between the adjacent layers of a light receiving member according to the present invention.
Figure 10:
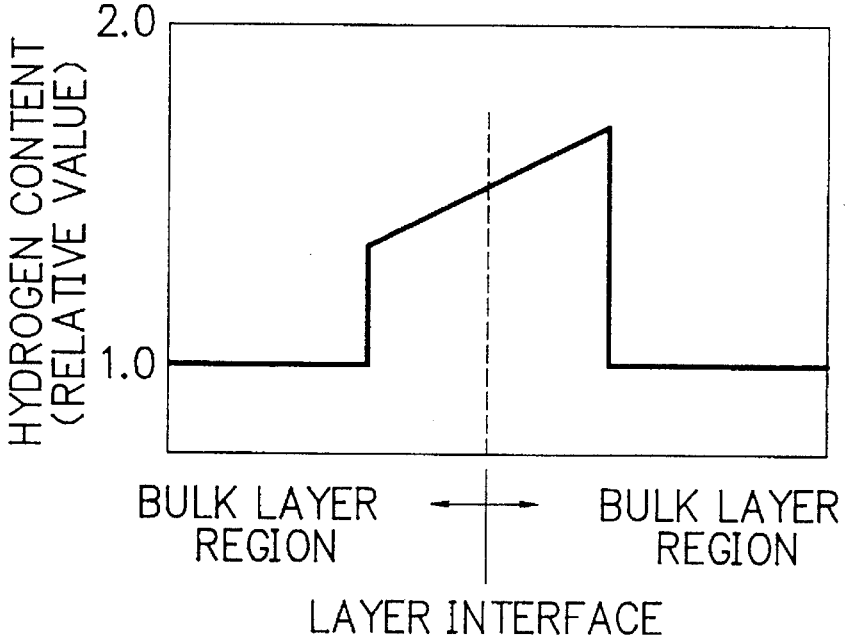
FIG. 10 is a schematic diagram showing a seventh pattern of the concentration distribution of hydrogen atoms in the vicinity of the interface between the adjacent layers of a light receiving member according to the present invention.
Figure 11:
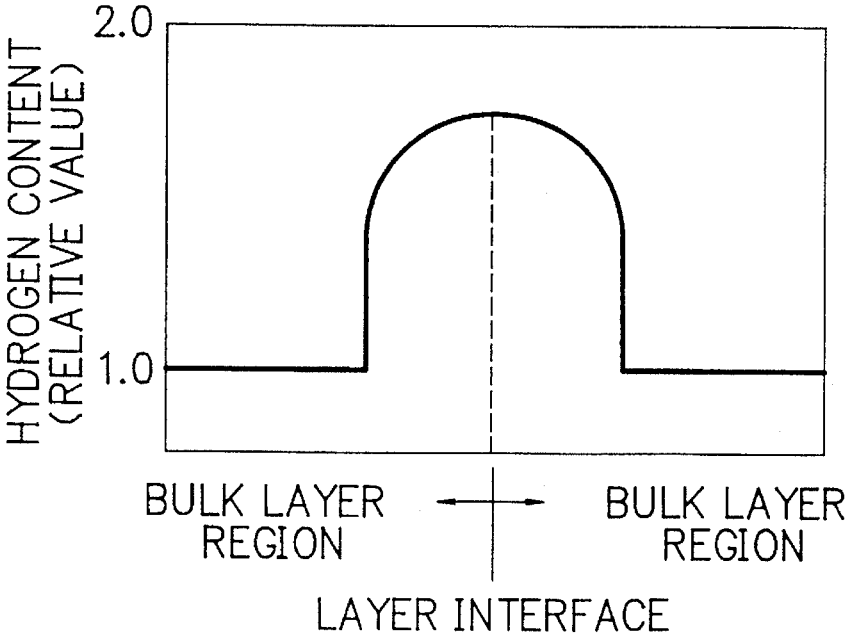
FIG. 11 is a schematic diagram showing a eighth pattern of the concentration distribution of hydrogen atoms in the vicinity of the interface between the adjacent layers of a light receiving member according to the present invention.

FIGS. 6 and 7 illustrate respectively a concentration distribution pattern of the hydrogen atoms in the neighborhood region of the interface of given adjacent layer in which a maximum concentration peak is established on the bulk layer region side of either adjacent layer. FIG. 8 illustrates a concentration distribution pattern of the hydrogen atoms in the neighborhood region of the interface of given adjacent layer in which the content of the hydrogen atoms is made constant at a desired value. FIG. 9 illustrates a concentration distribution pattern of the hydrogen atoms in the neighborhood region of the interface of given adjacent layer in which the content of the hydrogen atoms is stepwise varied. FIG. 10 illustrates a concentration distribution pattern of the hydrogen atoms in the neighborhood region of the interface of given adjacent layer in which the content of the hydrogen atoms is linearly varied. FIG. 11 illustrates a concentration distribution pattern of the hydrogen atoms in the neighborhood region of the interface of given adjacent layer in which the content of the hydrogen atoms is varied in a curved state.

Although the concentration distribution patterns shown in FIGS. 4 to 11 are of the hydrogen atoms (H), but these concentration distribution patterns are applicable also to the halogen atoms (X).

To employ which concentration distribution with respect to the hydrogen atoms (H) or/and the halogen atoms (X) should be properly determined depending upon the related factors such as the functions required for a light receiving member to be produced, the kind of a manufacturing apparatus used, and the like.

The amount of the hydrogen atoms (H) or/and halogen atoms (X) contained in the bulk layer region of each adjacent layer may be the same or different from each other. The bulk layer region of each adjacent layer may contain the hydrogen atoms (H) or/and halogen atoms (X) in such a state that their concentration is constant or varied in the thickness direction. In the latter case, the concentration of the hydrogen atoms or/and halogen atoms may be continuously or stepwise varied in the thickness direction. However, in any case, it is essential that the content of the hydrogen atoms (H) or/and halogen atoms (X) in the bulk layer region of each adjacent layer is always smaller than that in the neighborhood region of the interface of the adjacent layers.

In the case where both hydrogen atoms (H) and halogen atoms (X) are contained in the neighborhoods of the interface between the adjacent layers, the bulk layer region may be incorporated with no halogen atom. Particularly in this case, the content of halogen atoms in the bulk layer region of each adjacent layer may be substantially zero (or less than the detection limit).

As for the concentration distribution of the hydrogen atoms (H) or/and halogen atoms (X) contained in the bulk layer region of each adjacent layer, it should be properly determined depending upon the related factors such as the functions required for a light receiving member to be produced, the kind of a manufacturing apparatus used, and the like.

As apparent from the above description, it is a basically important factor for the multi-layered light receiving layer of the light receiving member according to the present invention to have a region containing hydrogen atoms (H) or/and halogen atoms (X) at an enhanced concentration distribution in the vicinity of the interface between given adjacent layers. In addition to this, the content of the hydrogen atoms (H) and halogen atoms in the multi-layered light receiving layer of the light receiving layer is also a very important factor.

In order to attain the objects of the present invention, it is important that these factors be sufficiently fulfilled.

In the case where the above neighborhood region containing the hydrogen atoms (H) or/and halogen atoms (X) at an enhanced concentration distribution in the vicinity of the interface between given adjacent layers is greater than necessary or the content of the hydrogen atoms (H) or/and halogen atoms (X) in said region is excessive, there is a tendency that the multi-layered light receiving layer becomes poor in terms of structural stability and also in terms of quality. Particularly, in the case where the neighborhood region contains the hydrogen atoms in an excessive amount which is larger that its amount required for attaining relaxation of a structural distortion, the networks among the silicon atoms in the layer structure become liable to distort or break, resulting in making the layer structure unstable. Where the neighborhood region is smaller than necessary or the content of the hydrogen atoms (H) or/and halogen atoms (X) in said region is excessively small, there is a tendency that the effects of the present invention are hardly attained. Hence, the neighborhood region containing the hydrogen atoms (H) or/and halogen atoms (X) at an enhanced concentration distribution in the vicinity of the interface between given adjacent layers and the content of the hydrogen atoms (H) or/and halogen atoms (X) in said region should be properly determined while having due care so that these problems do not occur.

Specifically, as for the content of the hydrogen atoms (H) or/and halogen atoms (X) present in the neighborhood region of the interface between the adjacent layers, it is desired to be preferably 1.1 to 2 times or most preferably 1.2 to 1.8 times over that contained in the bulk layer regions of the adjacent layers. As for the thickness of the above neighborhood region, it is desired to be preferably 100 to 10000Å, more preferably 100 to 5000Å or most preferably 500 to 3000Å in the thickness direction, centered on the interface between the adjacent layers. In the case where at least one of the two bulk layer regions is relatively thin, the thickness of the neighborhood region containing the hydrogen atoms (H) or/and halogen atoms (X) at a relatively high concentration distribution is desired to be in the range corresponding to 30% or less of the thickness of such thin bulk layer region.

As for the content of the content of the hydrogen atoms (H) contained in each adjacent layer, it should be decided while having due care not only for the content in the region where it is maximized (that is, the layer interface neighborhood region) but also for the content in each bulk layer region. Specifically, the content of the hydrogen atoms (H) contained in the layer interface neighborhood region is preferably in the range of 0.1 to 45 atomic %, more preferably in the range of 1 to 40 atomic %, most preferably in the range of 3 to 35 atomic %, based on the amount of the entire constituent atoms thereof. The content of the hydrogen atoms (H) contained in each bulk layer region is preferably in the range of 0.05 to 40 atomic %, more preferably in the range of 0.3 to 30 atomic %, most preferably in the range of 0.5 to 30 atomic %, based on the amount of the entire constituent atoms thereof.

The halogen atom (X) contained in the multi-layered light receiving layer of the light receiving member according to the present invention can include F (fluorine), Cl (chlorine), I (iodine) and Br (bromine), among these, F and Cl being the most desirable. The content of the halogen atoms (X) contained in each bulk layer region of the multi-layered light receiving layer according to the present invention is preferably in the range of 0.05 atomic ppm to 20 atomic %, more preferably in the range of 0.3 atomic ppm to 15 atomic %, most preferably in the range of 0.5 atomic ppm to 10 atomic %, based on the amount of the entire constituent atoms thereof. In the case where the halogen atoms (X) are contained together with the hydrogen atoms (H) in each bulk layer region, the sum (H+ X) of the amount for the hydrogen atoms (H) and the amount for the halogen atoms (X) is made to be preferably in the range of 0.3 to 50 atomic %, more preferably in the range of 0.5 to 45 atomic %, most preferably in the range of 1.0 to 30 atomic %, based on the amount of the entire constituent atoms involved.

In the case where the neighborhood region of the interface between the adjacent layers is incorporated with the halogen atoms (X), the content thereof is desired to be preferably 0.5 atomic ppm to 30 atomic %, or more preferably 1 atomic ppm to 20 atomic %, based on the amount of the entire constituent atoms thereof. In addition, as for the content of the halogen atoms (X) contained in the neighborhood region of the interface between the adjacent layers, in the case where each bulk layer region is also incorporated with the halogen atoms (X), it is desired to be greater preferably by more than 1.1 times, more preferably by more than 1.15 times, or most preferably by more than 1.2 holds the content thereof in the bulk layer region which is the greatest in terms of the halogen content. As for the thickness of the neighborhood region of the interface between the adjacent layers containing the halogen atoms (X) at an enhanced concentration distribution, it is desired to be preferably 100Å to 1 μm, or more preferably 500 to 5000 Å.

However, for instance, in the case where the photoconductive layer or surface layer as one of the adjacent layers is relatively thin, the thickness of the neighborhood region is desired to be of a thickness corresponding to 30% or less of the thickness of the thinner layer. In the case where the neighborhood region containing both the hydrogen atoms (H) and halogen atoms (X) at an enhanced concentration distribution at the interface between the adjacent layers, the sum of the contents of these two kinds of atoms is desired to be preferably 0.5 to 55 atomic %, more preferably 1 to 50 atomic %, or most preferably 1 to 35 atomic %.

The pattern of the foregoing concentration distribution for the hydrogen atoms (H) or/and halogen atoms (X) may be employed to not only the neighborhood region of the interface between the substrate and the multi-layered light receiving layer but also the neighborhood region at the free surface of the outermost layer of the light receiving layer, wherein the effects of the present invention are afforded. For instance, in the case of the layer constitution of FIG. 1, it is possible that the neighborhood region of the interface between the nc-Si (H,X) photoconductive layer 102 and the nc-Si (H,X) surface layer 103 is replaced by the neighborhood region between the substrate 101 and the nc-Si (H,X) photoconductive layer or the neighborhood region at the free surface of the nc-Si (H,X) surface layer 103 and the pattern of the foregoing concentration distribution for the hydrogen atoms (H) or/and halogen atoms (X) is employed thereto. In this case, when the neighborhood region at the free surface of the nc-Si (H,X) surface layer 103 is involved, there is no particular upper limitation for the content of the hydrogen atoms (H) or/and halogen atoms (X), but due care should be taken so that the region containing the hydrogen atoms (H) or/and halogen atoms (X) at an enhanced concentration distribution is not excessively thickened as well as in the case where the neighborhood region of the interface between the adjacent layers is involved.

In the case where the multi-layered light receiving layer does not contain a constituent layer having conductivity, the content of the hydrogen atoms (H) or/and halogen atoms (X) in such layer and a given layer region thereof containing the hydrogen atoms (H) or/and halogen atoms (X) can be optionally designed as desired. However, it is necessary that the region wherein the content of the hydrogen atoms (H) or/and halogen atoms (X) is enhanced is limited to a given region within a limited distance from the interface between the adjacent layers and the enhancement of the content of the hydrogen atoms (H) or/and halogen atoms (X) is made within said given region.

In the case where the neighborhood region at the free surface of the outermost layer of the multi-layered light receiving layer is involved, there is not a particular limitation for the content of the hydrogen atoms (H) or/and halogen atoms (X), since this concerns the free surface of the outermost layer and the adhesion between the adjacent layers and the adhesion between the substrate and the multi-layered light receiving layer are not influenced by this. Even in this case, a given region wherein the hydrogen atoms (H) or/and halogen atoms (X) are contained at an enhanced concentration distribution is desired to be of a thickness of 100Å to 1 μm as well as in the case where the neighborhood region of the interface between the adjacent layers is involved, in order to prevent the bulk layer region of each adjacent layer from suffering a negative influence in terms of the inherent electric characteristics.

In the case where the multi-layered light receiving layer comprises three or more nc-Si (H,X) constituent layers each having a different chemical composition and have two or more interfaces, it is necessary to make the foregoing control of the content of the hydrogen atoms (H) or/and halogen atoms (X) for all the interfaces, wherein the effects of the present invention are afforded even in the case where the foregoing control of the content of the hydrogen atoms (H) or/and halogen atoms (X) is made for one of the interfaces.

In the present invention, in order to obtain a high quality light receiving member having an improved multi-layered light receiving layer in which a desirable, enhanced concentration distribution of hydrogen atoms (H) or/and halogen atoms (X) is established in the neighborhood region of the interface between the adjacent layers of the multi-layered light receiving layer, the neighborhood region at the free surface of the outermost layer of the multi-layered light receiving layer or the neighborhood region of the interface between the substrate and the multi-layered light receiving layer, it important to grasp the film-forming parameters which enable to establish such enhanced concentration distribution in terms of the content of the hydrogen atoms (H) or/and halogen atoms (X) in such neighborhood region in advance of the preparation of the light receiving member. Specifically, for example, in the case of preparing the light receiving member by means of the plasma CVD technique, a number of light receiving members each having a multi-layered light receiving layer are prepared by properly changing the related film-forming parameters including flow rate of film-forming raw material gas, discharging power applied, bias voltage applied, and the like, and the content of the hydrogen atoms or/and halogen atoms contained in the multi-layered light receiving layer of each light receiving member obtained is examined by an appropriate analysis method. Based on the analyzed results, there is obtained a reference standard in terms of the film-forming parameters which enables to establish such enhanced concentration distribution in terms of the content of the hydrogen atoms (H) or/and halogen atoms (X) in any of the foregoing neighborhood regions. The formation of the above multi-layered light receiving layer is conducted based on the reference standard.

The above analysis method can include SIMS, infrared-absorbing analysis method, and thermal desorption analysis method. Other than these methods, nuclear reaction method, nuclear magnetic resonance method, ESCA, RBS, Auger electron spectroscopy, radiation chemical analysis method, mass spectrometry, absorptiometry, and gas analysis method can be used. These analysis methods can be used either singly or in combination of two or more of them.

In the present invention, the thickness of the nc-Si (H,X) layer having photoconductivity (that is, the photoconductive layer 102; see, FIGS. 1 to 3) as one of the constituent layers of the nc-Si (H,X) multi-layered light receiving layer 100 is one of the important factors, in order to effectively attain the objects of the present invention, and due care should be made thereof so that the resulting light receiving member provides desirable characteristics. In general, it is made to be in the range of 1 to 100 μm. However, it is made to be in the range of 1 to 80 μm in a preferred embodiment, and to be in the range of 2 to 50 μm in a more preferred embodiment.

In the present invention, in order to effectively attain its objects, the photoconductive layer 102 (see, FIGS. 1 to 3) disposed on the substrate 101 is constituted by a nc-Si:(H,X) material (including an a-Si:(H,X) material) which exhibits photoconductivity against light irradiated and has the semiconductor characteristics. The nc-Si:(H,X) material can include those materials as show below:

(a) p-type nc-Si:(H,X) material containing only an acceptor which is high concentration in terms of acceptor concentration (Na);

(b) p-type nc-Si:(H,X) containing both a donor and acceptor in which the acceptor concentration (Na) is relatively higher than the donor concentration (Nd);

(c) $p^-$-type nc-Si:(H,X) comprising the material (a) in which the acceptor concentration (Na) is low;

(d) $p^-$-type nc-Si:(H,X) comprising the material (b) in which the acceptor concentration (Na) is a little higher;

(e) n-type nc-Si:(H,X) material containing only a donor which is high in terms of donor concentration (Nd);

(f) n-type nc-Si:(H,X) material containing both a donor and acceptor in which the donor concentration (Nd) is relatively higher than the acceptor concentration (Na);

(g) $n^-$-type nc-Si:(H,X) material comprising the material (e) in which the donor concentration (Nd) is low;

(h) $n^-$-type nc-Si:(H,X) material comprising the material (f) in which the donor concentration (Nd) is a little higher;

(i) i-type nc-Si:(H,X) material in which the acceptor concentration (Na) and the donor concentration (Nd) are substantially zero; and (j) i-type nc-Si:(H,X) materialor in which the acceptor concentration (Na) and the donor concentration (Nd) are substantially the same.

The light receiving layer of the light receiving member according to the present invention may contain atoms of a conductivity controlling element or/and at least one kind of atoms selected from the group consisting of oxygen atoms, carbon atoms and nitrogen atoms.

In the case where the light receiving layer of the light receiving member according to the present invention is incorporated with atoms of a given conductivity controlling element, the atoms may be contained in the entire layer region or in a partial layer region thereof such that they are uniformly or unevenly distributed in the thickness direction.

Such conductivity controlling element can include so-called impurities used in the field of semiconductor such as elements capable of imparting a p-type conductivity which belong to group IIIB of the periodic table (hereinafter referred to as group IIIB element) and elements capable of imparting an n-type conductivity which belong to group VB of the periodic table (hereinafter referred to as group VB element).

Specific examples of the group IIIB element are B, Al, Ga, In, and Tl, and among these, B and Ga being the most desirable.

Specific examples of the group VB element are P, As, Sb, and Bi, and among these, P and Sb being the most desirable.

Atoms of these group IIIB or group VB elements as the conductivity controlling element may be contained either in the entire layer region or in a given partial layer region of the light receiving layer in a uniformly distributed state or in an unevenly distributed state while taking into account their amount contained, depending upon the requirements for a light receiving member obtained.

For the purpose of controlling the conduction type or/and conductivity of the photoconductive layer, a given element selected from the group consisting of the above group IIIB and group VB elements is contained in the entire layer region thereof in a relatively small amount. Specifically, the amount is usually $1\times10^{-3}$ to $1\times10^{3}$ atomic ppm, preferably $5\times10^{-2}$ to $5\times10^{2}$, or more preferably $1\times10^{-1}$ to $2\times10^{2}$ atomic ppm.

For the purpose of making the photoconductive layer capable of functioning also as a charge injection inhibition layer, a given element selected from the group consisting of the above group IIIB and group VB elements is contained in a partial layer region thereof adjacent to the substrate such that atoms of the element are uniformly distributed at a relatively high concentration, or a given element selected from the group consisting of the above group IIIB and group VB elements is contained in the photoconductive layer such that atoms of the element are contained therein so as to establish a concentration distribution in the thickness direction which is enhanced in a layer region of thereof situated on the substrate side, wherein any of the above layer regions each being incorporated with atoms of a given element selected from the group consisting of the above group IIIB and group VB elements at a high concentration functions as a charge injection inhibition layer.

It is possible to dispose an independent charge injection inhibition layer instead of the above layer region as shown in FIG. 3, wherein the charge injection inhibition layer 106 is disposed between the substrate 101 and the photoconductive layer 102. In this case, the charge injection inhibition layer is designed to contain atoms of a given element selected from the group consisting of the above group IIIB and group VB elements such that the atoms are uniformly distributed at a relatively high concentration therein or that the atoms are contained to establish a enhanced concentration distribution in the thickness direction in a layer region thereof adjacent to the substrate.

In the case where a group IIIB element is contained in the photoconductive layer or charge injection inhibition layer in such a state as above described, electrons are effectively prevented from injecting from the substrate side into the light receiving layer when the free surface of the light receiving layer is positively charged. In the case where a group VB element is contained in the photoconductive layer or charge injection inhibition layer in such a state as above described, holes are effectively prevented from injecting from the substrate side into the light receiving layer when the free surface of the light receiving layer is negatively charged. In any case, the conductivity controlling element is contained in a relatively large amount, specifically, usually in an amount in the range of 30 to $5\times10^4$ atomic ppm, preferably in an amount in the range of 50 to $1\times10^4$ atomic ppm, or more preferably in an amount in the range of 100 to $5\times10^3$ atomic ppm.

In the case where any of the foregoing layer regions is provided in the photoconductive layer, such layer region is designed to satisfy the equation $t/t+t_o \leqq 0.4$, with t being a thickness of the layer region in which the atoms of a given conductivity controlling element are contained at a high concentration, and $t_o$ being a thickness of the remaining layer region. Particularly, the value of the above equation is desired to be 0.35 or less in a preferred embodiment or 0.3 or less in a more preferred embodiment. Specifically, the thickness (t) of the layer region of the photoconductive layer in which the atoms of the conductivity controlling element are contained at a high concentration is made to be preferably in the range of $3\times 10^{-3}$ to 10 μm, more preferably in the range of $4\times10^{-3}$ to 8 μm, or most preferably in the range of $5\times10^{-3}$ to 5 μm.

In the case where the independent charge injection inhibition layer is disposed as above described, the thickness thereof is usually made to be at least $3\times10^{-3}$ μm. However it is preferably in the range of $4\times10^{-3}$ to 8 μm or more preferably in the range of $1\times10^{-3}$ to 5 μm.

Other than the above, the above group IIIB and VB elements may be selectively contained in the light receiving layer at a desired concentration distribution while taking into account the amount thereof depending upon the requirements for a light receiving member obtained. For instance, in the case where the multi-layered light receiving layer comprises a photoconductive layer and a charge injection inhibition layer situated on the substrate side, the photoconductive layer may be incorporated with a conductivity controlling element having a different polarity from that of the conductivity controlling element contained in the charge injection inhibition layer. Alternatively, it is possible that both the photoconductive layer and charge injection inhibition layer are incorporated with the same conductivity controlling element and the content of the conductivity controlling element in the charge injection inhibition layer is significantly greater than that in the photoconductive layer.

As for the concentration distribution for the conductivity controlling element contained in the multi-layered light receiving layer, it is not always necessary for each layer to have an independent concentration gradient. It is possible for the multi-layered light receiving layer to contain the conductivity controlling element such that a desired concentration gradient is established in a given layer region or the entire layer region of the multi-layered light receiving layer. For instance, it is possible for the multi-layered light receiving layer to contain the conductivity controlling element such that the content of the conductivity controlling element in a layer region adjacent to the substrate is maximum and it decreases as the distance from the substrate increases or such that the content of the conductivity controlling element in a layer region adjacent to the substrate is minimum and it increases as the distance from the substrate increases. Other than these, it is possible that the conductivity controlling element is contained so as to have a maximum or minimum concentration value in a given layer region of the photoconductive layer.

In the light receiving member according to the present invention, it is possible to have a so-called barrier layer composed of an electrically insulating material which is disposed between the foregoing multi-layered light receiving layer and the substrate. It is a matter of course that the barrier layer may be employed even in the case where the foregoing charge injection inhibition layer is disposed. Specific examples of such electrically insulating material are inorganic electrically insulating materials such as $Al_2O_3$, $SiO_2$, $Si_3N_4$, or the like, and organic electrically insulating materials such polycarbonate, or the like.

In addition, the light receiving member according to the present invention may have an infrared absorption layer composed of a material having a relatively narrow optical band gap which is disposed under the foregoing multi-layered light receiving layer, for the purpose of preventing interference phenomena from occurring when coherent monochromic light such as laser is used. It is a matter of course that the infrared absorption layer may be employed even in the case where the foregoing charge injection inhibition layer is disposed. The material by which the infrared absorption layer can include nc-Si:(H,X) materials incorporated with germanium atoms (Ge) or tin atoms (Sn), specifically, nc-SiGe:(H,X) materials and nc-SiSn:(H,X) materials.

The surface layer 103 (see, FIGS. 1 and 2) of the light receiving member according to the present invention may comprise a nc-SiC:(H,X) material, nc-SiN:(H,X) material or nc-SiO:(H,X) material. This surface layer may contain atoms of an element belonging to group III of the periodic table (hereinafter referred to as group III element) or atoms of an element belonging to group V (excluding N) of the periodic table (hereinafter referred to as group V element) in such a state that the atoms are distributed either uniformly or unevenly in the thickness direction in the layer. In this case, the surface layer becomes to contain, in addition to the C, N or O, the atoms of the group III or V element in a desired distribution state. By this, the electrical and photoconductive properties of the surface layer are controlled as desired. The concentration distribution state of the atoms of the group III or V element in the surface layer may be designed such that the content of the atoms is enhanced on the free surface side or it is enhanced on the photoconductive layer side.

Alternatively, it is possible for the surface layer to comprise an inorganic electrically insulating material such as $Al_2O_3$, $SiO_2$, or the like, or a resin.

In the following, description will be made of the manner of preparing a light receiving member according to the present invention.

The multi-layered light receiving layer comprising a nc-Si:(H,X) material (including a-Si:(H,X) material) of the light receiving member according to the present invention may be formed by a conventional sputtering method, ion plating method, thermal-induced CVD method wherein raw material gas is thermally decomposed to form a deposited film on a substrate, photo-assisted CVD method wherein raw material gas is decomposed with the action of light energy to form a deposited film on a substrate, or plasma CVD method wherein direct current, high frequency or microwave grow discharge is caused to produce plasma whereby raw material gas is decomposed to form a deposited film on a substrate. These methods can be properly used selectively depending upon the related factors such as the manufacturing conditions, installation cost required, production scale and properties required for the light receiving members to be prepared. Among these methods, the plasma CVD method or sputtering method is suitable since the control for the conditions upon preparing the light receiving members having desired properties can be relatively easily carried out. And the plasma CVD method and the sputtering method may be used together in one identical system.

Basically, when a layer constituted by a nc-Si:(H,X) material is formed, for example, by the plasma CVD method, gaseous raw material capable of supplying silicon atoms (Si) is introduced together with gaseous raw material capable of supplying hydrogen atoms (H) or/and gaseous raw material capable of supplying halogen atoms (X) into a deposition chamber capable of being vacuumed, and glow discharge is caused in the deposition chamber to form said nc-Si:(H,X) layer on a substrate placed in the deposition chamber.

The Si-supplying raw material can include gaseous or gasifiable silicon hydride (silanes) such as $SiH_4$, $Si_2H_6$, $Si_3H_8$, $Si_4H_{10}$, and the like, among these, $SiH_4$ and $Si_2H_6$ being particularly preferred in view of the easy layer forming work and the good efficiency for the supply of Si.

Further, various gaseous or gasifiable halogen compounds can be mentioned as the raw material for supplying the halogen atoms (X), for example, gaseous halogen, halides, interhalogen compounds, and halogen-substituted silane derivatives. Specific examples are halogen gas such as of fluorine, chlorine, bromine, and iodine; interhalogen compounds such as BrF, ClF, $ClF_3$, $BrF_3$, $BrF_5$, $IF_3$, $IF_7$, ICl, IBr, and the like; and silicon halides such as $SiF_4$, $Si_2F_6$, $SiCl_4$, $SiBr_4$, and the like. The use of the gaseous or gasifiable silicon halide as above described is particularly advantageous since the layer comprising a halogen atom-containing nc-Si material can be formed with no additional use of the gaseous raw material for supplying Si.

The gaseous raw material usable for supplying the hydrogen atoms (H) can include various gaseous or gasifiable materials such as hydrogen gas ($H_2$ gas), halides such as HF, HCl, HBr, HI, and the like, silicon hydrides such as $SiH_4$, $Si_2H_6$, $Si_3H_8$, $Si_4H_{10}$, and the like, and halogen-substituted silicon hydrides such as $SiH_2F_2$, $SiH_2Cl_2$, $SiH_2I_2$, $SiHCl_3$, $SiH_2Br_2$, $SiHBr_3$, and the like. The use of these gaseous raw materials is advantageous since the content of the hydrogen atoms (H), which are extremely effective in view of the control for the electrical or photoconductive properties, can controlled with ease. Then, the use of the hydrogen halide or the halogen-substituted silicon hydride as above described is particularly advantageous since the hydrogen atoms (H) are also introduced together with the introduction of the halogen atoms (X).

To control the content of the hydrogen atoms (H) or/and halogen atoms (X) in the neighborhood region of the interface between adjacent nc-Si:(H,X) layers so as to provide a desired concentration distribution pattern can be conducted by an appropriate manner such as (i) a manner of adjusting the amount of these atoms contained by properly varying the flow rate for the foregoing hydrogen atom-supplying gaseous raw material or/and the foregoing halogen atom-supplying gaseous raw material to be introduced into the discharging space (that is, the deposition chamber), (ii) a manner of adjusting the amount of these atoms contained by properly varying the discharging power applied, (iii) a manner of adjusting the amount of these atoms by properly varying the bias voltage applied, (iv) a manner of adjusting the amount of these atoms contained by properly varying the inner pressure of the discharging space (that is, the deposition chamber), or (v) a manner of adjusting the amount of these atoms contained by selectively using proper gaseous raw material and properly varying the flow rate thereof upon introducing the gaseous raw material into the discharging space (that is, the deposition chamber). These manners can be selectively used either singly or in combination of two or more of them.

In the case of using the microwave plasma CVD method, the above manner (i) and manner (iii) are particularly effective.

In any case, the flow rate for the foregoing hydrogen atom-supplying gaseous raw material or/and the foregoing halogen atom-supplying gaseous raw material to be introduced into the discharging space can be precisely controlled as desired, for example, by using a piezo valve.

Specifically, for example, in the case where the plasma CVD method is employed, to control the amount of hydrogen atoms (H) or/and halogen atoms (X) contained in the nc-Si:(H,X) layer so as to provide a desired concentration distribution pattern can be conducted by properly adjusting the flow rate of the foregoing raw material gas capable of supplying hydrogen atoms (H) or/and halogen atoms (X) to be introduced and the discharging power applied as desired.

As above described, it is possible to form a multi-layered nc-Si:(H,X) layer having a desired concentration distribution pattern in therms of the content of hydrogen atoms (H) or/and halogen atoms (X) in the neighborhood region of the interface between adjacent nc-Si:(H,X) layers by the sputtering method or ion plating method. For example, in the case where the sputtering method is employed, the formation of said layer is conducted by using a Si-target comprising a single crystal or polycrystalline Si-wafer and introducing the foregoing gaseous halogen atom-supplying raw material and/or hydrogen gas, if necessary inert gas such as He or Ar in addition, into the deposition chamber having said Si-target placed therein, and generating a plasma to sputter the Si-target, to thereby form respective nc-Si:(H,X) layers on a substrate. In this case, the control for the amount of hydrogen atoms (H) or/and halogen atoms (X) contained in the neighborhood region of the interface of adjacent nc-Si:(H,X) layers so as to provide a desired concentration distribution pattern can be conducted by increasing the flow rate of the hydrogen gas and/or the flow rate of the gaseous halogen atom-supplying raw material as desired upon forming the interface neighborhood region. It is effective that this control step is conducted while maintaining the substrate constant at a desired temperature and properly varying the partial gas pressure of the hydrogen gas and/or that of the gaseous halogen atom-supplying raw material in the deposition chamber.

In the case of forming a nc-Si:(H,X) layer incorporated with a given group IIIB or VB element of the periodic table by the plasma CVD method, a given gaseous raw material capable of supplying the group IIIB or VB element is introduced into the deposition chamber while properly controlling the flow rate thereof as desired, together with the foregoing film-forming raw material gase upon conducting the formation of a nc-Si:(H,X) layer by the plasma CVD method in the manner as above described.

In the case of forming a nc-Si:(H,X) layer incorporated with a given group IIIB or VB element of the periodic table by the sputtering method, a given gaseous raw material capable of supplying the group IIIB or VB element is introduced into the deposition chamber while controlling the flow rate thereof upon conducting the formation of a nc-Si:(H,X) layer by the sputtering method in the manner as above described.

Specific examples of the group IIIB element-supplying gaseous raw material are boron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_3$, $BCl_3$, and $BBr_3$. Other than these, $AlCl_3$, $GaCl_3$, $Ga(CH_3)_3$, $InCl_3$, and $TlCl_3$ can also mentioned.

Specific examples of the group VB element-supplying gaseous raw material are phosphorous hydrides such as $PH_3$, and $P_2H_4$, and phosphorous halides such as $PH_4I$, $PF_3$, $PF_5$, $PCl_3$, $PCl_5$, $PBr_3$, $PBr_5$, and $PI_3$. Other than these, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$ can also be mentioned.

In order to form a nc-Si:(H,X) layer or partial layer region containing oxygen atoms (O) (hereinafter referred to as nc-SiO:(H,X) layer or partial layer region) by the plasma CVD method, a gaseous raw material capable of supplying oxygen atoms (O) is introduced into the deposition chamber while properly controlling the flow rate thereof, together with the film-forming gaseous raw material upon forming the foregoing nc-Si:(H,X) layer by the plasma CVD method. The oxygen atom-supplying raw material (hereinafter referred to as O-supplying raw material) can include most of those gaseous or gasifiable materials which contain at least oxygen atoms as the constituent atoms.

As for the raw material gases used in combination, it is possible to employ, for example, a combination of a gaseous raw material containing silicon atoms (Si) as the constituent atoms, a gaseous raw material containing oxygen atoms (O) as the constituent atoms and as required, a gaseous raw material containing hydrogen atoms (H) and/or halogen atoms (X) as the constituent atoms in a desired mixing ratio; a combination of a gaseous raw material containing silicon atoms (Si) as the constituent atoms and a gaseous raw material containing oxygen atoms (O) and hydrogen atoms (H) as the constituent atoms in a desired mixing ratio; a combination of a gaseous raw material containing silicon atoms (Si) as the constituent atoms and a gaseous raw material containing oxygen atoms (O) and halogen atoms (X) as the constituent atoms in a desired mixing ratio; or a combination of a gaseous raw material containing silicon atoms (Si) as the constituent atoms and a gaseous raw material containing silicon atoms (Si), oxygen atoms (O) and hydrogen atoms (H) as the constituent atoms in a desired mixing ratio. Other than these, it is possible to employ a combination of a gaseous raw material containing silicon atoms (Si) and hydrogen atoms (H) as the constituent atoms and a gaseous raw material containing oxygen atoms (O) as the constituent atoms in a desired mixing ratio.

Specific examples of the O-supplying raw material are oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising three kind atoms, i.e., silicon atom (Si), oxygen atom (O) and hydrogen atom (H) as the constituent atoms, for example, disiloxane ($H_3SiOSiH_3$), trisiloxane ($H_3SiOSiH_2OSiH_3$), and the like.

In order to form a nc-SiO:(H,X) layer or partial layer region by the sputtering method, the formation thereof is conducted in the same manner as that in the foregoing case of forming the nc-Si:(H,X) layer by the sputtering method, except that wherein a given O-supplying raw material gas is additionally introduced into the deposition chamber or the foregoing Si-target is replaced by a target comprising a single crystal or polycrystalline Si-wafer and a $SiO_2$ wafer or a wafer composed of Si and $SiO_2$.

As the O-supplying raw material gas herein, the above-mentioned O-supplying raw materials may be selectively used.

Specifically, the manner of additionally using the O-supplying gas is conducted by introducing the O-supplying raw material gas, if required, the gaseous halogen atom-supplying raw material and/or hydrogen gas, and if necessary, inert gas such as He or Ar in addition, into the deposition chamber having the Si-target placed therein, and generating a plasma to sputter the Si-target, to thereby form a nc-SiO:(H,X) layer or partial layer region on a substrate. Similarly, the manner of using the target comprising a single crystal or polycrystalline Si-wafer and a $SiO_2$ wafer or a wafer composed of Si and $SiO_2$ is conducted by introducing the gaseous halogen atom-supplying raw material and/or hydrogen gas, and if necessary, inert gas such as He or Ar in addition, into the deposition chamber having said target placed therein, and generating a plasma to sputter said target, to thereby form a nc-SiO:(H,X) layer or partial layer region on a substrate.

In order to form a nc-Si:(H,X) layer or partial layer region containing nitrogen atoms (N) (hereinafter referred to as nc-SiN:(H,X) layer or partial layer region) by the plasma CVD method, a gaseous raw material capable of supplying nitrogen atoms (N) is introduced into the deposition chamber while properly controlling the flow rate thereof, together with the film-forming gaseous raw material upon forming the foregoing nc-Si:(H,X) layer by the plasma CVD method. The nitrogen atom-supplying raw material (hereinafter referred to as N-supplying raw material) can include most of those gaseous or gasifiable materials which contain at least nitrogen atoms (N) as the constituent atoms.

As for the raw material gases used in combination, instance, it is possible to employ, for example, a combination of a gaseous raw material containing silicon atoms (Si) as the constituent atoms, a gaseous raw material containing nitrogen atoms (N) as the constituent atoms and as required, a gaseous raw material containing hydrogen atoms (H) and/or halogen atoms (X) as the constituent atoms in a desired mixing ratio, or a combination of a gaseous raw material containing silicon atoms (Si) as the constituent atoms and a gaseous raw material containing nitrogen atoms (N) and hydrogen atoms (H) as the constituent atoms in a desired mixing ratio. Other than these, it is possible to employ a combination of a gaseous raw material containing silicon atoms (Si) and hydrogen atoms (H) as the constituent atoms and a gaseous raw material containing nitrogen atoms (N) as the constituent atoms.

The N-supplying raw material can include gaseous or gasifiable nitrogen, nitrides, and nitrogen compounds comprising nitrogen atoms (N) as the constituent atoms. Specific examples are nitrogen ($N_2$), ammonia ($NH_3$), hydrazine ($H_2NNH_2$), hydrogen azide ($HN_3$), and ammonium azide ($NH_4N_3$). In addition, nitrogen halides such as nitrogen trifluoride ($F_3N$) and nitrogen tetrafluoride ($F_4N_2$) can be also mentioned in view that they can also supply halogen atoms (X) in addition to the supply of nitrogen atoms (N).

In order to form a nc-SiN:(H,X) layer or partial layer region by the sputtering method, the formation thereof is conducted in the same manner as that in the foregoing case of forming the nc-Si:(H,X) layer by the sputtering method, except that wherein a given N-supplying raw material gas is additionally introduced into the deposition chamber or the foregoing Si-target is replaced by a target comprising a single crystal or polycrystalline Si-wafer and a $Si_3N_4$ wafer or a wafer composed of Si and $Si_3N_4$.

As the N-supplying raw material gas herein, the above-mentioned N-supplying raw materials may be selectively used.

Specifically, the manner of additionally using the N-supplying gas is conducted by introducing the N-supplying raw material gas, if required, the gaseous halogen atom-supplying raw material and/or hydrogen gas, and if necessary, inert gas such as He or Ar in addition, into the deposition chamber having the Si-target placed therein, and generating a plasma to sputter the Si-target, to thereby form a nc-SiN:(H,X) layer or partial layer region on a substrate. Similarly, the manner of using the target comprising a single crystal or polycrystalline Si-wafer and a $Si_3N_4$ wafer or a wafer composed of Si and $Si_3N_4$ is conducted by introducing the gaseous halogen atom-supplying raw material and/or hydrogen gas, and if necessary, inert gas such as He or Ar in addition, into the deposition chamber having said target placed therein, and generating a plasma to sputter said target, to thereby form a nc-SiN:(H,X) layer or partial layer region on a substrate.

In order to form a nc-Si:(H,X) layer or partial layer region containing carbon atoms (C) (hereinafter referred to as nc-SiC:(H,X) layer or partial layer region) by the plasma CVD method, a gaseous raw material capable of supplying carbon atoms (C) is introduced into the deposition chamber while properly controlling the flow rate thereof, together with the film-forming gaseous raw material upon forming the foregoing nc-Si:(H,X) layer by the plasma CVD method. The carbon atom-supplying raw material (hereinafter referred to as C-supplying raw material) can include most of those gaseous or gasifiable materials which contain at least carbon atoms (C) as the constituent atoms.

As for the raw material gases used in combination, it is possible to employ, for example, a combination of a gaseous raw material containing silicon atoms (Si) as the constituent atoms, a gaseous raw material containing carbon atoms (C) as the constituent atoms and as required, a gaseous raw material containing hydrogen atoms (H) and/or halogen atoms (X) as the constituent atoms in a desired mixing ratio, a combination of a gaseous raw material containing silicon atoms (Si) as the constituent atoms and a gaseous raw material containing carbon atoms (C) and hydrogen atoms (H) as the constituent atoms in a desired mixing ratio, a combination of a gaseous raw material containing silicon atoms (Si) as the constituent atoms and a gaseous raw material containing silicon atoms (Si), carbon atoms (C) and hydrogen atoms (H) as the constituent atoms in a desired mixing ratio, or a combination of a gaseous raw material containing silicon atoms (Si) and hydrogen atoms (H) as the constituent atoms and a gaseous raw material containing silicon carbon atoms (C) as the constituent atoms in a desired mixing ratio.

The C-supplying raw material can include gaseous or gasifiable various hydrocarbon compounds such as saturated hydrocarbons of 1 to 5 carbon atoms, ethylenic hydrocarbons of 2 to 5 carbon atoms, and acetylenic hydrocarbons of 2 to 5 carbon atoms. Other than these, gaseous or gasifiable compounds comprising Si, C and H as the constituent atoms such as silicified alkyls.

Specific examples of such saturated hydrocarbon are methane ($CH_4$), ethane ($C_2H_4$), propane ($C_3H_8$), n-butane (n-$C_4H_{10}$), and pentane ($C_5H_{12}$). Specific examples of such ethylenic hydrocarbon are ethylene ($C_2H_4$), propylene ($C_3H_6$), butene-1 ($CH_2{=}CHC_2H_5$), butene-2 ($CH_3CH{=}CHCH_3$), isobutene ($(CH_3)_2C{=}CH_2$), and pentene ($C_5H_{10}$). Specific examples of such acetylenic hydrocarbon are acetylene ($C_2H_2$), methylacetylene ($CH_3CCH$), and butyne ($C_2H_5CCH$). Specific examples of such silicified alkyl are $Si(CH_3)_4$, $Si(C_2H_5)_4$, and the like.

In order to form a nc-SiC:(H,X) layer or partial layer region by the sputtering method, the formation thereof is conducted in the same manner as that in the foregoing case of forming the nc-Si:(H,X) layer by the sputtering method, except that wherein a given C-supplying raw material gas is additionally introduced into the deposition chamber or the foregoing Si-target is replaced by a target comprising a single crystal or polycrystalline Si wafer and a graphite wafer or a wafer composed of Si and C.

As the C-supplying raw material gas herein, the above-mentioned C-supplying raw materials may be selectively used.

Specifically, the manner of additionally using the C-supplying gas is conducted by introducing the C-supplying raw material gas, if required, the gaseous halogen atom-supplying raw material and/or hydrogen gas, and if necessary, inert gas such as He or Ar in addition, into the deposition chamber having the Si-target placed therein, and generating a plasma to sputter the Si-target, to thereby form a nc-SiC:(H,X) layer or partial layer region on a substrate. Similarly, the manner of using the target comprising a single crystal or polycrystalline Si-wafer and a graphite wafer or a wafer composed of Si and C is conducted by introducing the gaseous halogen atom-supplying raw material and/or hydrogen gas, and if necessary, inert gas such as He or Ar in addition, into the deposition chamber having said target placed therein, and generating a plasma to sputter said target, to thereby form a nc-SiC:(H,X) layer or partial layer region on a substrate.

As above explained, the respective nc-Si:(H,X) constituent layers of the light receiving layer of the light receiving member according to the present invention can be effectively formed by the plasma CVD method or sputtering method. The amount of oxygen atoms, nitrogen atoms, carbon atoms, or atoms of a given group IIIB or VB element contained in each nc-Si:(H,X) layer can be properly controlled by regulating the flow rate of each of the raw materials or the flow ratio among the raw materials respectively entering into the deposition chamber.

The conditions upon forming each constituent layer of the light receiving layer of the light receiving member according to the present invention, for example, the substrate temperature, gas pressure in the deposition chamber, and discharging power are important factors for obtaining the light receiving member having desired properties, and they are properly and selectively determined while having a due care about the functions of the layer formed. Further, since these layer-forming conditions may be varied depending upon the kind and the amount of each atoms contained in each constituent layer of the light receiving layer, these layer-forming conditions have to be determined while also taking the kind and the amount of the atom contained into consideration.

Specifically, as for the substrate temperature, it is desired to be preferably in the range of 50° to 400° C., more preferably in the range of 100° to 350° C.

As for the discharging power, it is desired to be preferably in the range of 0.01 to 8.0 W/cm$^2$, more preferably 0.2 to 4.0 W/cm$^2$.

As for the gas pressure in the deposition chamber in the case where the RF glow discharging process is employed, it is desired to be preferably in the range of 0.01 to 1 Torr, more preferably in the range of 0.1 to 0.5 Torr. In the case where the microwave glow discharging process is employed, it is desired to be preferably in the range of 0.2 to 100 mTorr, more preferably in the range of 1 to 50 mTorr.

However, the actual conditions for forming each constituent layer of the light receiving layer such as the substrate temperature, discharging power and gas pressure in the deposition chamber cannot usually determined with ease independence of each other. Accordingly, the conditions optimal to the layer formation are desirably determined based on relative and organic relationships for the respective constituent nc-Si:(H,X) layers to have desired properties.

It is necessary that the foregoing various conditions are kept constant upon forming a desirable nc-Si:(H,X) layer in which oxygen atoms, nitrogen atoms, carbon atoms, or atoms of a given group IIIB or VB element are uniformly distributed therein.

In order to attain a desired concentration distribution varied in the thickness direction for the content of oxygen atoms, nitrogen atoms, carbon atoms, or atoms of a given group IIIB or VB element contained in a given nc-Si:(H,X) layer, such concentration distribution pattern may be established, for example in the case where the plasma CVD method is employed, by properly varying the flow rate of the raw material gas capable of supplying oxygen atoms, nitrogen atoms, carbon atoms, or atoms of a given group IIIB or VB element upon introducing it into the deposition chamber in accordance with a desired variation coefficient while maintaining other conditions. The flow rate herein may be varied, specifically, by gradually varying the opening degree of a given needle valve or a mass flow controller (MFC) disposed on the midway of the gas flow system, for example, manually or any of other means usually employed such as in externally driving motor. In this case, the variation of the flow rate is not necessary to be linear but a desired concentration curve may be obtained, for example, by controlling the flow rate along with a previously designed variation coefficient curve by using a microcomputer or the like.

In order to attain a desired concentration distribution varied in the thickness direction for the content of oxygen atoms, nitrogen atoms, carbon atoms, or atoms of a given group IIIB or VB element contained in a given nc-Si:(H,X) layer in the case where the sputtering method is employed, such concentration distribution pattern may be established by properly varying the flow rate of the raw material gas capable of supplying oxygen atoms, nitrogen atoms, carbon atoms, or atoms of a given group IIIB or VB element upon introducing it into the deposition chamber in accordance with a desired variation coefficient while maintaining other conditions, as well as in the case of the plasma CVD method.

In the light receiving member according to the present invention, it is possible to dispose a so-called contact layer between the substrate 101 and the light receiving layer 102 for the purpose of further improving the adhesion of the light receiving layer with the substrate. The contact layer in this case may be comprised of an appropriate non-single crystal material such as $Si_3N_4$, $SiO_2$, SiO, or nc-Si materials containing at least one kind of atoms selected from the group consisting of hydrogen atoms and halogen atoms and at least one kind of atoms selected from the group consisting of nitrogen atoms and oxygen atoms.

The substrate 101 used in the light receiving member according to the present invention may be either electroconductive or electrically insulative.

The electroconductive substrate can include, for example, metals such as Ni, Cr, Al, Cr, Mo, Au, Nb, Ta, V, Ti, Pt, and Pb, and alloys of these metals. Among these, Al is the most desirable since it has a reasonable strength, excels in workability, and it is advantageous in terms of productivity and easiness in handling. In the case of using Al as the substrate, it is desired to contain magnesium in an amount of 1 to 10 wt. % in order to improve the cutting ability. In this case, the purity of the Al before magnesium is contained therein is desired to be 98 wt. % or above, or preferably 99 wt. % or above.

The electrically insulative substrate can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramics, and paper. It is desired that the electrically insulative substrate is applied with electroconductive treatment to at least one of the surfaces thereof and disposed with a light receiving layer on the thus treated surface. In the case of glass, for instance, electroconductivity is applied by disposing, at the surface thereof, a thin film made of NiCr, Al, Au, Cr, Mo, Ir, Nd, Ta, V, Ti, Pt, $In_2O_3$, $SnO_2$, or ITO ($In_2O_3$+ $SnO_2$). In the case of the synthetic resin film such as a polyester film, the electroconductivity is provided to the surface thereof by disposing a thin film of a metal such as NiCr, Al, Ag, Pb, Zn, Ni, Au, Cr, Mo, Ir, Nd, Ta, V, Tl, or Pt by means of vacuum deposition, electron beam vapor deposition, or sputtering, or by applying lamination with such metal to the surface thereof.

The substrate may be of any configuration such as cylindrical, belt-like or plate-like shape, which can be properly determined depending upon the application use. For instance, in the case of using the light receiving member shown in any of FIGS. 1 to 3, as an image-forming member for use in electrophotography, it is desired to be configured into an endless belt or cylindrical form for continuous high speed image reproduction.

The thickness of the substrate should be properly determined so that the light receiving member can be formed as desired. In the event that flexibility is required for the light receiving member, it can be made as thin as possible within a range capable of sufficiently providing the function as the substrate. However, the thickness is usually made to be greater than 10 um in view of the fabrication and handling easiness or mechanical strength of the substrate. Particularly, in view of attaining a firm adhesion for the layer formed on the substrate, the thickness is desired to be 2.5 mm or above in the case where the substrate is in a cylindrical shape.

It is possible for the electroconductive surface of the substrate to be processed into a desired surface state by way of precisely cutting given portions thereof. For instance, in the case where the light receiving member is for use in image formation using coherent monochromatic light such as laser beams, the electroconductive surface of the light receiving member may be provided with irregularities in order to eliminate occurrence of defective images caused by a so-called interference fringe pattern. The formation of such irregularities at the surface of the substrate may be conducted in accordance with the manner described in U.S. Pat. Nos. 4,650,736, 4,696,884, or 4,705,733. Other than this, in order to prevent the occurrence of defective images caused by the interference fringe pattern, the surface of the substrate may be treated so as to have an uneven surface shape provided with irregularities composed of a plurality of fine spherical dimples in accordance with the manner described in U.S. Pat. No. 4,773,244.

The present invention will be described in more detail. In the following, description will be made of the preparation of a light receiving member according to the present invention while focusing on the case where the preparation is conducted by the plasma CVD method (that is, the microwave glow discharging process).

Figure 12A:
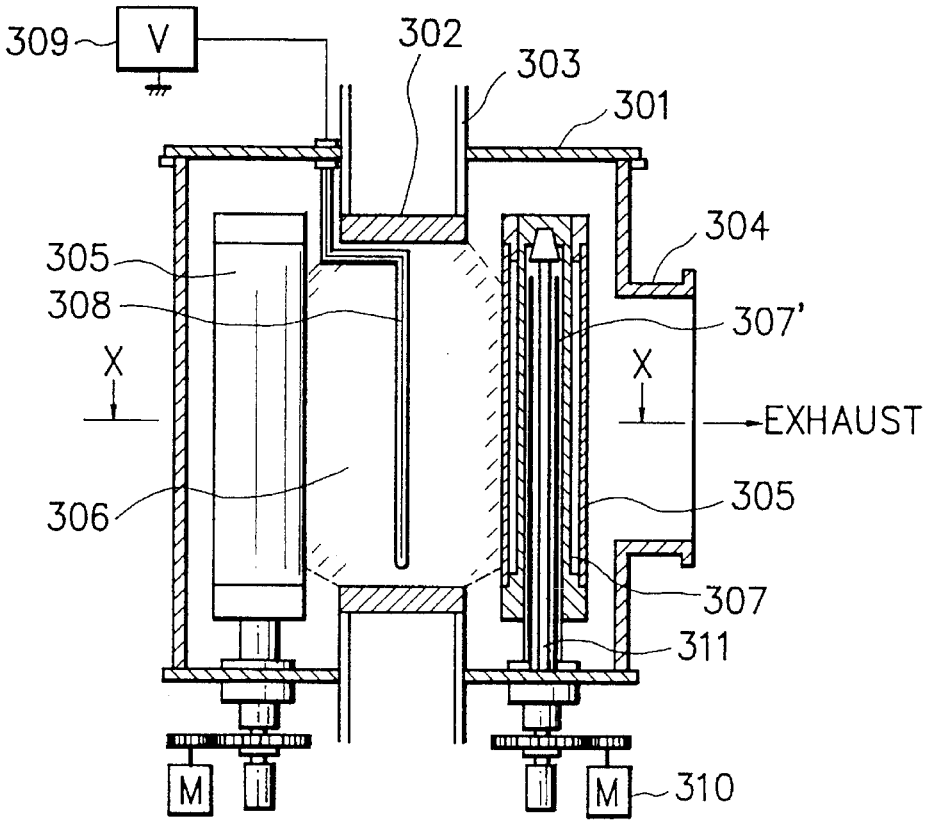
FIG. 12(A) is a schematic longitudinal-section view illustrating the constitution of a microwave CVD fabrication apparatus suitable for the preparation of a light receiving member according to the present invention.
Figure 12B:
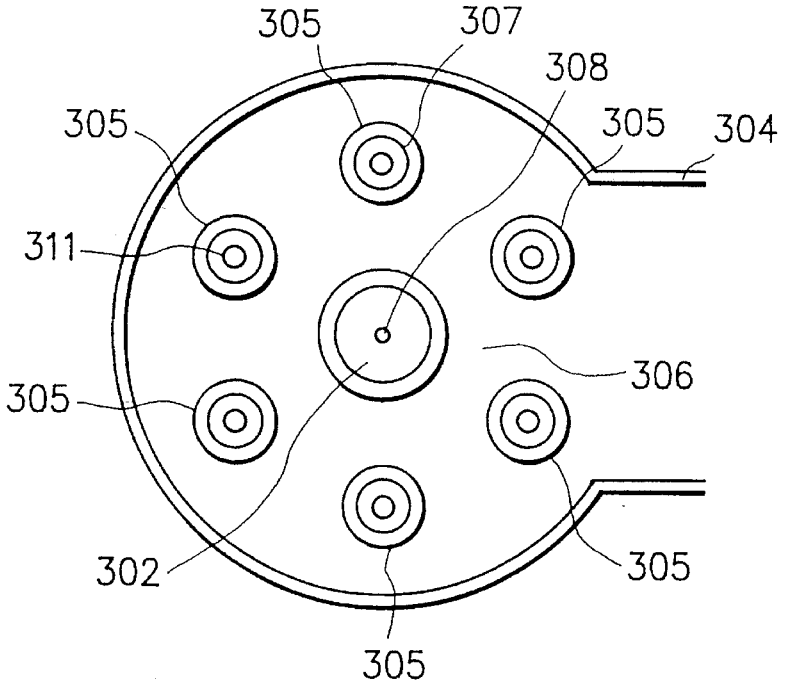
FIG. 12(B) is a schematic cross-section view, taken along the line X—X in FIG. 12(A).

FIG. 12(A) is a schematic longitudinal sectional view, partly broken away, of an example of the microwave discharging fabrication apparatus which is suitable for the production of a light receiving member for use in electrophotographic image reproduction (that is, an electrophotographic image-forming member). FIG. 12(B) is a schematic cross sectional view, taken along the line X—X in FIG. 12(A).

In FIGS. 12(A) and 12(B), reference numeral 301 indicates a substantially enclosed, cylindrical reaction chamber (or a substantially enclosed, cylindrical deposition chamber), the inside of which being capable of being vacuum-sealed. Reference numeral 303 indicates a waveguide which is connected to a microwave power source (not shown) through a stub tuner and an isolator (not shown). The waveguide 303 is extended through an end portion of the circumferential wall of the reaction chamber 301 into the reaction chamber such that the inside of the reaction chamber is vacuum-sealed. The waveguide 303 is rectangularly shaped between its end portion situated on the side of said microwave power source and the portion thereof situated in the vicinity of the reaction chamber 301 and the remaining portion thereof is cylindrically shaped. Reference numeral 302 indicates a microwave transmissive window which is hemetically disposed at the end of the cylindrically-shaped portion of the waveguide 303. The microwave transmissive window 302 is made of a material capable of allowing a microwave to transmit therethrough such quartz, alumina ceramics, or the like.

The reaction chamber 301 is provided with an exhaust pipe 304 which is connected through a main valve (not shown) to an exhaust device including diffusion pump, and the like (not shown). In view of preventing the residual gas in the previous film formation from influencing to the successive film formation, the reaction chamber 301 is desired to be provided with an exhaust system comprising such exhaust pipe and exhaust device which serves to evacuate the inside thereof and another exhaust system comprising such exhaust pipe and exhaust device which serves to exhaust gases used in the film formation.

In the reaction chamber 301, there are installed a plurality of rotatable cylindrical substrate holders 307 each having a substrate 305 (for example, a cylindrical substrate) being placed thereon so as to circumscribe a discharge space 306. Each of the cylindrical substrate holders 307 has an electric heater 307' installed therein, wherein the electric heater serves to heat the substrate on each cylindrical substrate holder to a desired temperature. Each cylindrical substrate holder 307 is supported by a rotary shaft connected to a driving means 310 (for example, a driving motor). Each cylindrical substrate holder 307 having the substrate 305 thereon can be rotated by actuating the driving means 310 upon film formation.

Reference numeral 308 indicates a bias electrode capable of serving also as a gas feed pipe which is longitudinally installed near or in the center of the discharge space 306. The bias electrode 308 is electrically connected to an external DC power source 309. The bias electrode 308 serves to apply a given bias voltage in order to desirably control the electric potential of a plasma generated in the discharge space 306 upon film formation. In the case where the bias electrode 308 is made to serve also as the gas feed pipe, it is desired to be designed such that it is provided with a plurality of gas liberation holes (not shown) so as to radiately supply a film-forming raw material gas in the discharge space 306. In this case, the bias electrode 308 as the gas feed pipe is connected to a gas supply system comprising pipe ways provided with flow controllers (not shown) connected to gas reservoirs (this gas supply system is not shown). Other than this, it is possible for the reaction chamber 301 to have one or more independent gas feed pipes (not shown) in the reaction chamber 301. In this case, the independent gas feed pipe is desired to have a plurality of gas liberation holes, and it is connected to the above gas supply system. In a preferred embodiment in the case employing such independent gas feed pipe, a gas feed pipe is disposed between every adjacent cylindrical substrate holders 307 such that the discharge space 306 is circumscribed by the cylindrical substrate holders 307 and a plurality of gas feed pipes.

Figure 15A:
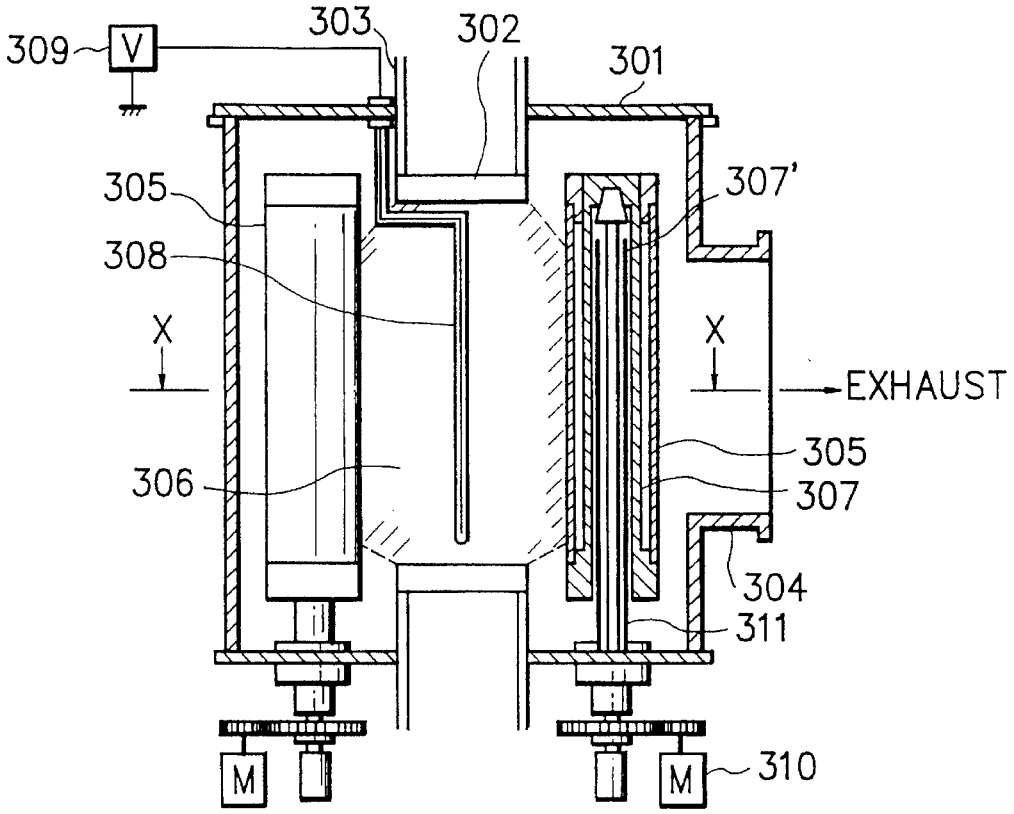
FIG. 15A is a schematic longitudinal-section view illustrating another microwave CVD apparatus suitable for preparing a light receiving member according to the present invention.
Figure 15B:
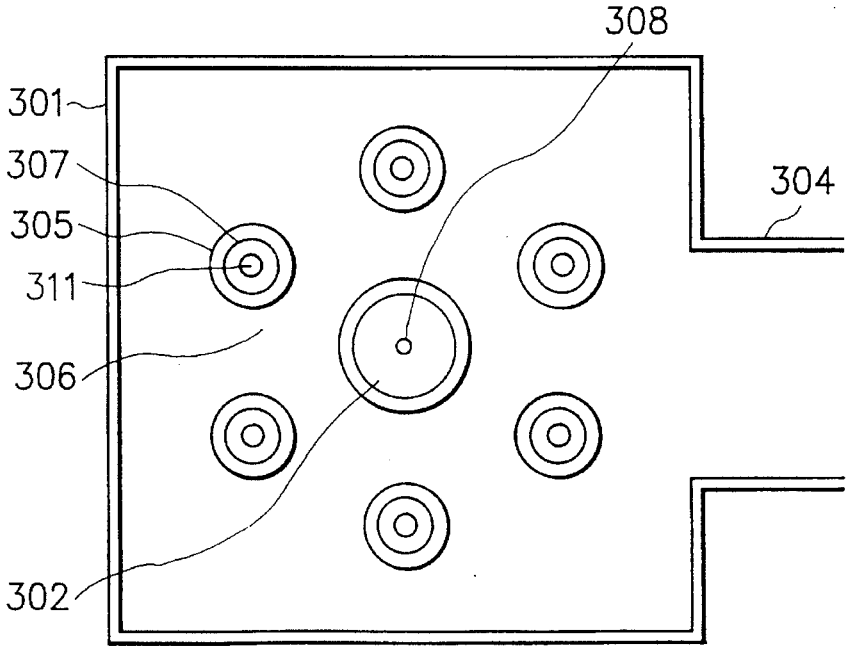
FIG. 15B is a schematic cross-section view, taken along the line X—X in FIG. 15A.

Shown in FIGS. 15(A) and 15(B) is of another example of the microwave discharging fabrication apparatus suitable for the production of a light receiving member for use in electrophotographic image reproduction (that is, an electrophotographic image-forming member). The constitution of the microwave discharging fabrication apparatus shown in FIGS. 15(A) and 15(B) is of a partial modification of the apparatus shown in FIGS. 12(A) and 12(B), wherein the shape of the cylindrical reaction chamber of the apparatus shown in FIGS. 12(A) and 12(B) is changed into a rectangular shape. Particularly, FIG. 15(A) is a schematic longitudinal sectional view, partly broken away, of another example of the microwave discharging fabrication apparatus, and FIG. 15(B) is a schematic cross sectional view, taken along the line X—X in FIG. 15(A). Description of the apparatus shown in FIGS. 15(A) and 15(B) is omitted because the constitution thereof is the same as that of the apparatus shown in FIGS. 12(A) and 12(B).

The light receiving member according to the present invention may be produced using any of the apparatus shown in FIGS. 12(A) and 12(B) and FIGS. 15(A) and 15(B) as will be described below.

That is, firstly, a cylindrical substrate 305 is placed on each cylindrical substrate holder 307 in the reaction chamber 301. Then all the cylindrical substrate holders 307 are made rotating by revolving the driving motor 310. Thereafter, the inside of the reaction chamber 301 is evacuated through the exhaust pipe by actuating the diffusion pump (not shown) to thereby bring the discharge space 306 to a vacuum of about $1\times10^{-7}$ Torr or less. The evacuation in this case is desired to be gently conducted at the beginning state in order to prevent foreign matters such as dust present in the reaction chamber 301 from blowing up to the substrates 305. Then, the electric heater 307' of each substrate holder 307 is energized to heat each cylindrical substrate 307 to a desired temperature.

In this case, in order to improve the heat conduction from the electric heater 307' to the cylindrical substrate 305 thereby uniformly heating the entire of the substrate to a desired temperature, it is possible to introduce a gas which is stable against heat and does not react with the substrate into the reaction chamber 301. Specific examples of such gas are inert gas, $H_2$ gas, and the like. In this case, such gas can be introduced into the reaction chamber through a separate feed pipe (not shown) which is provided at a given position of the reaction chamber 301 so as to open into the inside thereof. Other than this, it can attain a desirable heat conduction from the electric heater 307' to the cylindrical substrate 305 by supplying said gas into the space between the electric heater and the substrate of each cylindrical substrate holder through a feed pipe (not shown) which is installed so as to open into said space.

As said gas, there can be used, other than those above described, a gas containing $O_2$ in the case of forming a thermal oxide film on each cylindrical substrate 305.

In the above, when the surface temperature of each cylindrical substrate 305 has become stable at a desired temperature, the inside of the reaction chamber 301 is maintained at a desired vacuum degree. Then, the formation of a first layer (that is, a nc-Si:(H,X) layer) is conducted by introducing predetermined gases for the formation of said first layer into the reaction chamber 301 through the foregoing gas feed pipes. For example, silane gas (for example, $SiH_4$, $Si_2H_6$, $SiF_4$ or $SiH_2F_2$ gas) and a doping gas, for example, comprising $B_2H_6$ diluted to a desired dilution rate with a given dilution gas such as He gas, and $H_2$ gas or/and halogen gas are introduced into the reaction chamber 301 at predetermined respective flow rates. The gas pressure in the reaction chamber 301 is adjusted to a desired vacuum degree by regulating the foregoing main valve of the exhaust pipe. After the respective flow rates of the raw material gases and the gas pressure of the reaction chamber become stable, the microwave power source (not shown) is switched on to thereby introduce a microwave energy of a desired power (with a frequency of 500 MHz or above, preferably 2.45 GHz) into the discharge space 306 through the waveguide 303 and the microwave transmissive window 302. Concurrently, the DC power source 309 is switched on to apply a desired bias voltage into the reaction chamber through the bias electrode 308, whereby glow discharge is caused in the discharge space 306 to produce a plasma while the potential of said plasma being desirably controlled, wherein the raw material gases are decomposed in the discharge space to produce active species, resulting in causing the formation of a deposited non-single crystal film (specifically, an a-Si:(H, X) film doped with B in this case) on each cylindrical substrate 305. In this case, when each of the substrate holders 307 is rotated by the action of the driving motor 310 during the film formation, said non-single deposited film is formed uniformly on the entire surface of each cylindrical substrate.

In order to form a second layer (that is, another nc-Si:(H, X) layer) on the previously formed fist layer, given raw material gases for the second layer are introduced into the reaction chamber 301 while controlling their flow rates to respective desired values as well as in the case of forming the first layer. And the formation of the second layer is carried out in the same manner as in the case of forming the first layer, to thereby form a nc-Si:(H,X) film as the second layer on the first layer formed on each cylindrical substrate 305. The raw material gases used for the formation of the second layer may be the same as or different from those used for the formation of the first layer.

Upon conducting the formation of the second layer after the formation of the first layer, it is not always necessary to suspend the discharging and evacuate the inside of the reaction chamber 301 to a high vacuum degree, particularly in the case where the same raw material gases used in the formation of the first layer are used. In this case, the formation of the second layer may be conducted by switching the flow ratio among the flow rates of the raw material gases employed for the formation of the first layer to a desired flow ratio among the flow rates of the raw material gases for the formation of the second layer. For instance, when a first layer is formed under the conditions of using $SiH_4$ gas at 400 sccm, $B_2H_6$ gas (diluted to 3000 ppm with $H_2$ gas) (hereinafter referred to as "$B_2H_6/H_2$ gas (diluted to 3000 ppm)") at 150 sccm, and He gas at 1000 sccm, and a second layer is formed under the conditions of using $SiH_4$ gas at 200 sccm, $B_2H_6/H_2$ gas (diluted to 3000 ppm) at 10 sccm, and He gas at 2000 sccm, soon after the formation of the first layer has been completed, the flow rates of the three raw material gases used in the formation of the first layer are switched to those flow rates employed in the formation of the second layer, for example, by means of a mass flow controller without suspending the discharge.

Other than this, it is possible to continuously form the first and second layers without suspending the discharge even in the case of forming the second layer using a raw material gas which is not used in the formation of the first layer. For instance, when a first nc-Si:(H,X) layer is formed using a carbon atom-supplying gas (for example, $CH_4$ gas) in addition to other raw material gases (for example, $SiH_4$ gas, $B_2H_6/H_2$ gas, gas for supplying hydrogen atoms or halogen atoms, and He gas) and a second nc-Si:(H,X) layer is formed using the raw material gases used in the formation of the first layer except for the carbon atom-supplying gas, the flow rate of the carbon atom-supplying gas is made to be zero soon after the formation of the first layer has been completed by means of a mass flow controller, wherein the flow rates of the remaining raw material gases are switched to desired flow rates for the formation of the second layer, without suspending the discharge. And, when a first nc-Si:(H,X) layer is formed using raw material gases (for example, $SiH_4$ gas, $B_2H_6/H_2$ gas, gas for supplying hydrogen atoms or halogen atoms, and He gas) and a second nc-Si:(H,X) layer is formed using a carbon atom-supplying raw material gas in addition to the raw material gases used in the formation of the first layer, soon after the formation of the first layer has been completed, the flow rates of the raw material gases used in the formation of the first layer are switched to desired flow rates for the formation of the second layer, while promptly increasing the flow rate of the carbon atom-supplying gas to a desired value, without suspending the discharge.

In any case, to promptly switch from the flow rates of the raw material gases for the formation of the first layer to the flow rates for the second layer is important in order to attain a desirable neighborhood region at the interface between the first and second layers. In the case where the flow rate switching is not promptly conducted, there is a tendency that a relatively thick neighborhood region is provided at the interface between the first and second layer. Such relatively thick layer interface neighborhood region cannot be the layer interface neighborhood region in the present invention which contains hydrogen atoms (H) or/and halogen atoms at an enhanced concentration distribution, wherein the effects of the present invention are not provided.

To make the neighborhood region of the interface between the first and second layers to contain hydrogen atoms (H) or/and halogen atoms (X) such that any of the foregoing concentration distribution patterns (see, FIGS. 4 to 11) is established can be conducted by any of the following manners (1) to (3).

(1) A manner of temporally increasing the flow rate of the hydrogen gas or/and that of the halogen gas upon forming the neighborhood region, for example, by properly controlling the mass flow controller for the hydrogen gas or/and that for the halogen gas. In a preferred embodiment of this manner, a separate pipe line provided with a piezo valve for feeding hydrogen gas or/and a separate pipe line provided with a piezo valve for feeding halogen gas are connected to the foregoing gas feed pipe so that the hydrogen gas or/and halogen gas can be introduced through said separate pipe lines while precisely controlling their flow rate to a desired value into the reaction chamber together with the film-forming raw material gases. By this, the flow rate of the hydrogen gas or/and that of the halogen gas upon forming the neighborhood region can be precisely controlled as desired and as a result, a desired concentration distribution pattern in terms of the content of hydrogen atoms (H) or/and halogen atoms (X) can be established in the neighborhood region. The hydrogen gas herein used for the introduction of hydrogen atoms (H) may be replaced by other raw material gas capable of supplying hydrogen atoms (H) in a relatively large amount such as disilane gas ($Si_2H_6$) in the case where monosilane gas ($SiH_4$) is used for the layer formation.

(2) A manner of changing, upon forming the interface neighborhood region, the composition of active species (or the decomposed state of the raw material gases) in the plasma by temporally varying (increasing or decreasing) the discharging power supplied to control the amount of hydrogen atoms (H) or/and halogen atoms (X) incorporated into the neighborhood region as desired, thereby establishing a desired concentration distribution pattern in terms of the content of hydrogen atoms (H) or/and halogen atoms (X) in the neighborhood region.

(3) A manner of controlling, upon forming the interface neighborhood region, the potential of the plasma generated in the discharge space by temporally varying (increasing or decreasing) the bias voltage supplied to control the amount of hydrogen atoms (H) or/and halogen atoms (X) incorporated into the neighborhood region as desired, thereby establishing a desired concentration distribution pattern in terms of the content of hydrogen atoms (H) or/and halogen atoms (X) in the neighborhood region.

It is a matter of course that these manners may be properly combined if necessary.

Any of the above manners may be employed in the case of controlling the amount of hydrogen atoms or/and halogen atoms contained in the bulk layer region of each adjacent layer. However, in general, as for the amount of hydrogen atoms or/and halogen atoms contained in the bulk layer region of each adjacent layer, it is not always required to be precisely controlled as in the case of forming the interface neighborhood region, and therefore, it is sufficient to be controlled by way of properly adjusting the flow rate of the related raw material gas.

Description will be made of the manner of producing a light receiving member according to the present invention using the RF plasma CVD apparatus shown in FIG. 14.

Figure 14:
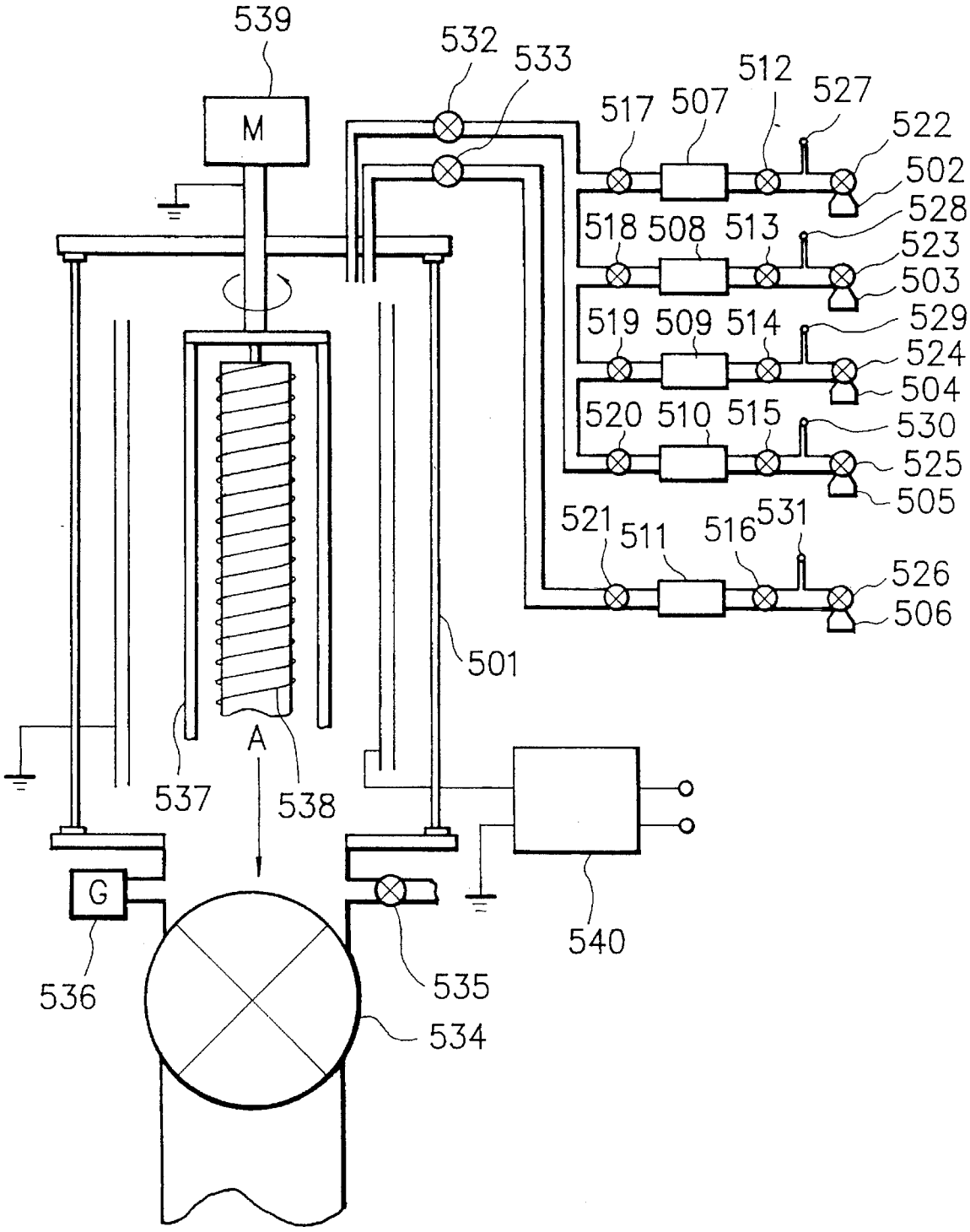
FIG. 14 is a schematic diagram illustrating the constitution of a glow discharge fabrication apparatus suitable for the preparation of a light receiving member according to the present invention.

FIG. 14 is a schematic diagram illustrating the constitution of an example of the RF plasma CVD apparatus suitable for the production of the light receiving member having the foregoing specific multi-layered light receiving layer according to the present invention.

In the figure, gas reservoirs 502, 503, 504, 505, and 506 are charged with gaseous raw materials for forming the respective constituent layers in the present invention, that is, for instance, $SiH_4$ gas (99.999% purity) in the gas reservoir 502, $B_2H_6$ gas (99.999% purity) diluted with $H_2$ (hereinafter referred to as $B_2H_6/H_2$ gas) in the gas reservoir 503, $CH_4$ gas (99.999% purity) in the gas reservoir 504, $SiF_4$ gas (99.999% purity) in the reservoir 505, and $H_2$ gas (99.999% purity) in the gas reservoir 506.

Prior to the entrance of these gases into a reaction chamber (or a deposition chamber) 501, it is confirmed that valves 522 through 526 for the gas reservoirs 502 through 506 and a leak valve 535 are closed and that inlet valves 512 through 516, exit valves 517 through 521, and sub-valves 532 and 533 are opened. Then, a main valve 534 is at first opened to evacuate the inside of the reaction chamber 501 and gas piping by means of a vacuum pump (not shown). Thereafter, upon observing that the reading on a vacuum gage 536 became about $5\times10^{-6}$ Torr, the sub-valves 532 and 533 and the exit valves 517 through 521 are closed.

Now, description will be made of an example in the case of forming a two-layered light receiving layer comprising a nc-Si:(H,X) material on the surface of an aluminum cylinder as the substrate 537.

Firstly, a first nc-Si:(H,X) constituent layer is formed in the following manner. That is, $SiH_4$ gas from the gas reservoir 502, $B_2H_6/H_2$ gas from the gas reservoir 503, $CH_4$ gas from the gas reservoir 504, and $H_2$ gas from the gas reservoir 506 are caused to flow into mass flow controllers 507, 508, 509, and 511 respectively by opening the valves 522, 523, 524, and 526, controlling the pressure of each of exit pressure gages 527, 528, 529, and 531 is controlled to 1 kg/cm$^2$, and gradually opening the inlet valves 512, 513, 514, and 516. Subsequently, the outlet valves 517, 518, 519, and 521 and the sub-valves 532 and 533 are gradually opened to enter the gases into the reaction chamber 501. In this case, the exit valves 517, 518, 519, and 521 are adjusted so as to attain a desired value for the ratio among the $SiH_4$ gas flow rate, $B_2H_6/H_2$ gas flow rate, $CH_4$ gas flow rate, and $H_2$ gas flow rate, and the opening of a main valve 534 is adjusted while observing the reading on the vacuum gage 536 so as to attain a desired value for the inner pressure of the reaction chamber 501.

Then, after confirming that the temperature of the cylinder substrate 537 has been controlled to a temperature in the range of 50° to 400° C. by a heater 538, a RF power source 540 is switched on to apply a desired RF power into the reaction chamber 501 to case glow discharge therein while controlling the flow rates for the $SiH_4$ gas, $B_2H_6/H_2$ gas, $CH_4$ gas, and $H_2$ gas in accordance with a given variation coefficient curve previously designed by using a microcomputer (not shown), thereby forming, for example, a nc-Si:(H, X) layer containing carbon atoms (C) and boron atoms (B) on the cylinder substrate 537.

Then, a second nc-Si:(H,X) constituent layer is formed in the following manner. That is, subsequent to the procedures as above described, closing the valves 523, 513, and 518 for the $B_2H_6/H_2$ gas, $SiH_4$ gas, $CH_4$ gas and $H_2$ gas are entered into the reaction chamber 501 while properly controlling the flow rates for the $SiH_4$ gas, $CH_4$ gas and $H_2$ gas in the same manner as in the above, whereby a nc-Si:(H,X) second layer containing carbon atoms but containing no boron atom is formed on the first layer.

All of the exit valves other than those required for upon forming the respective layers are of course closed.

Further, upon forming the respective layers, if necessary, the inside of the system is once evacuated to a high vacuum degree by closing the exit valves 517 through 521 while opening the sub-valves 532 and 533 and fully opening the main valve 534 for avoiding the gases having been used in the reaction chamber and in the gas pipeways from the exit valves to the inside of the reaction chamber.

As well as in the foregoing case where the microwave plasma CVD is used, upon conducting the formation of the second layer after the formation of the first layer, it is not always necessary to suspend the discharging and evacuate the inside of the reaction chamber 501 to a high vacuum degree, particularly in the case where the same raw material gases used in the formation of the first layer are used. In this case, the formation of the second layer may be conducted by switching the flow ratio among the flow rates of the raw material gases employed for the formation of the first layer to a desired flow ratio among the flow rates of the raw material gases for the formation of the second layer.

To make the neighborhood region of the interface between the first and second layers to contain hydrogen atoms (H) or/and halogen atoms (X) such that any of the foregoing concentration distribution patterns (see, FIGS. 4 to 11) is established can be conducted by any of the foregoing manners (1) to (3).

In the following, description will be made of the findings obtained as a result of experimental studies by the present inventor in order to attain the objects of the present invention.

That is, the present inventor prepared (a) a plurality of light receiving member samples each comprising a substrate and a two-layered nc-Si:H:X light receiving layer having a layer interface neighborhood region containing hydrogen atoms (H) in a fixed amount and halogen atoms (X) at a different concentration distribution by means of the foregoing microwave plasma CVD technique, (b) a plurality of light receiving member samples each comprising a substrate and a two-layered nc-Si:H:X light receiving layer having a layer interface neighborhood region containing halogen atoms (X) in a fixed amount and hydrogen atoms (H) a different concentration distribution by means of the foregoing microwave plasma CVD technique, and (c) a plurality of light receiving member samples each comprising a substrate and a two-layered nc-Si:H:X light receiving layer having a layer interface neighborhood region containing hydrogen atoms (H) and halogen atoms (X) respectively at a different concentration distribution by means of the foregoing microwave plasma CVD technique.

Each of the light receiving member samples (a) to (c) was cut in the layer thickness direction to obtain a light receiving member specimen. The resultant specimen was evaluated with respect to photocarrier mobility. This evaluation was conducted in the following viewpoints. That is, as previously described, the foregoing problems in the conventional light receiving member for use in electrophotography are mainly due to its insufficiency in terms of photocarrier mobility against the high image-forming process speed. By evaluating the photocarrier mobility of each light receiving member sample, it can be found out which concentration distribution state of the hydrogen atoms (H) or/and halogen atoms contained in the neighborhood region of the interface of the adjacent constituent layers is effective in improving the electrophotographic characteristics.

Figure 13:
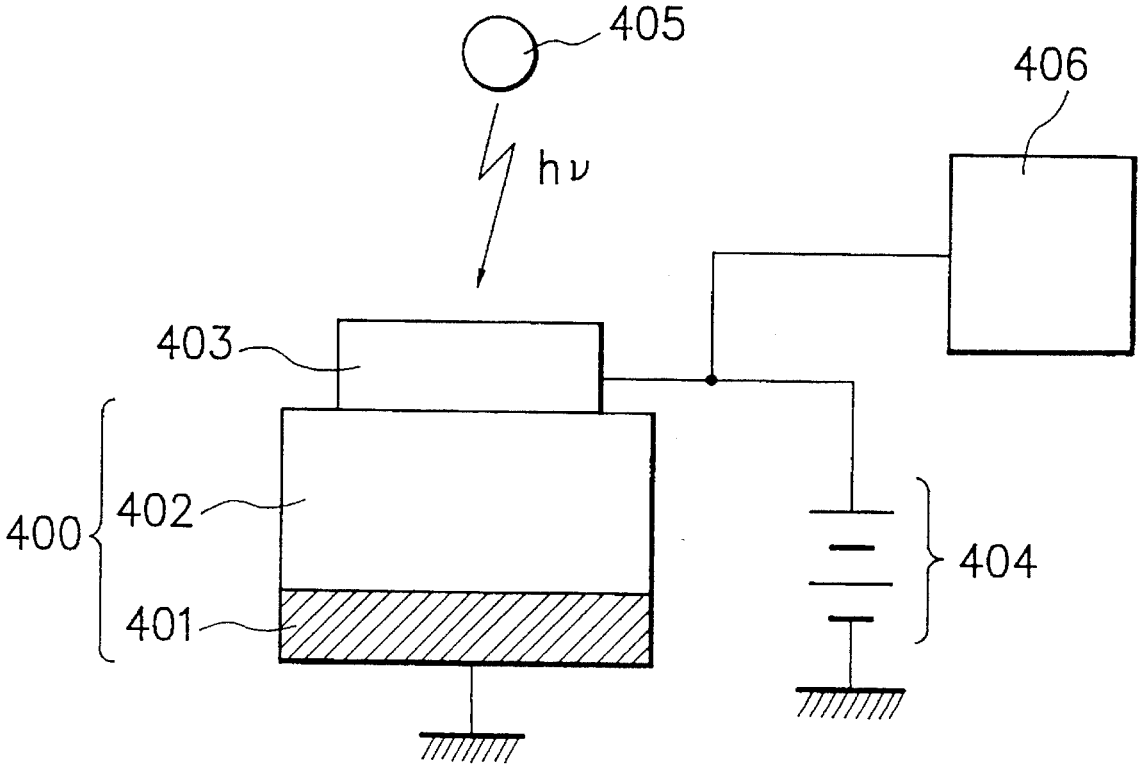
FIG. 13 is a schematic diagram illustrating a measuring device used for measuring the photoresponsibility and the mobility of a photocarrier of a light receiving member.

Now, the evaluation with respect to photocarrier mobility as for each light receiving member specimen was conducted by setting it in a measuring system of the constitution shown in FIG. 13.

In FIG. 13, reference numeral 400 indicates the light receiving member specimen comprising the substrate 401 and the two-layered nc-Si:H:X light receiving layer 402. Reference numeral 403 indicates a glass plate having a ITO film as a transparent and conductive electrode formed thereon by means of a conventional vacuum evaporation technique. The glass plate is contacted to the light receiving member specimen 400 through the ITO film side by using a material having a high dielectric constant (glycerin). Reference numeral 404 indicates a DC power source which is electrically connected to the ITO film. Reference numeral 405 indicates a light source, and reference numeral 406 indicates a conventional TFO (time of flight) measuring device.

Incidentally, in the image formation in electrophotography using a given electrophotographic non-single crystal silicon (or amorphous silicon) light receiving member, in general, the light receiving member is subjected to corona charging to provide a charge at the surface thereof, followed by subjecting to image exposure to form a latent image on the surface of the light receiving member, and the latent image formed is subjected to development. The measurement of photocarrier mobility of the light receiving member during the image-forming process is extremely difficult for the reasons that since the light receiving member is being rotated, the measurement of a surface charge must be conducted under noncontact condition, and in addition to this, the position for the measurement is limited because of the presence of the charger, exposure mechanism, and the like. In view of this, the measurement of photocarrier mobility in this experiment was conducted by establishing pseudoconditions of conducting electrophotographic image-forming process.

In addition, in order to precisely control the surface charge, it is necessary to impart a charge (that is, to apply a given voltage) to the light receiving member specimen by way of noncontact-charging. For this purpose, it is necessary to dispose an electrode on the outermost surface of the light receiving member specimen. In this experiment, in view of conducting the measurement while maintaining the light receiving member specimen in the form as an electrophotographic light receiving member as much as possible, an electrode was contacted on the free surface of the light receiving member specimen as above described.

In the measurement, the DC power source 404 was switched on to apply a given voltage between the substrate 401 and the light receiving layer 402 thereby imparting a given surface potential thereto, and a given pulse with short width from the light source 405 was irradiated through the glass 403 to the light receiving member specimen 400, wherein photocurrent was flown in the light receiving member specimen 400, and the value of the photocurrent flown and the period during which the photocurrent was flown were measured by the measuring device 406.

In the above, as the light source 405, there was used a dye laser of 460 nm in wavelength excited with $N_2$ laser. The irradiation of the pulse with short width was conducted under conditions of 100 to 500 V for the initialization surface potential and 20 nsec for the pulse duration.

Based on the measured results obtained, there was obtained a transit time during which a photocarrier generated by the irradiation of the short-pulse rays mobilizes within the light receiving layer. The transit time obtained was made to be $t_r$.

Based on the value of the $t_r$, the thickness of the light receiving layer (d), and the DC voltage (E) applied, there was obtained a photocarrier mobility ($\mu$) for the light receiving member specimen using the following equation: $u = d/(E \cdot t_r)$.

The above measurement was carried out for each of the foregoing light receiving member samples (a) and (c).

As a result, there was obtained a finding that any of the light receiving member samples each having a two-layered nc-Si:H:X light receiving layer with a interface neighborhood region containing the hydrogen atoms (H) or/and halogen atoms (X) at a concentration distribution which is higher than that in the bulk layer region of each adjacent layer markedly excels in photocarrier mobility, and when it used as an electrophotographic light receiving member, it exhibits excellent electrophotographic characteristics to sufficiently follow a higher image-forming process speed.

The reasons for this are considered as will be described below.

That is, there is a tendency that the characteristics of a light receiving member having a multi-layered light receiving layer are governed by the bonding state of atoms constituting the layer interface of the adjacent layers. Particularly, the layer structure of each of the adjacent layers situated opposite the layer interface is different from each other, and because of this, the interface forms a so-called heterojunction, wherein a structural distortion is liable to occur. In this case, the layer interface becomes an electrical barrier or poor in structural stability. Specifically, dangling bonds or/and various states (that is, so-called interfacial states) are formed within the optical band gap of the neighborhood region of the layer interface, resulting in hindering the transmission of light in the vicinity of the layer interface upon light irradiation to reduce the utilization efficiency of the light, and in deteriorating the properties of the neighborhood region of the layer interface to reduce the efficiency of generating photocarriers (that is, the quantum efficiency). In addition, in the case where the magnitude of the above interfacial levels is relatively great, a so-called band bending (that is, energy band bending) is caused at the layer interface, wherein the resistivity in the in-plane direction in parallel to the free surface of the light receiving member is reduced, resulting in causing drift of a charge. This becomes to be a cause of providing a smeared image upon conducting intense exposure in the electrophotographic image-forming process.

In the above, the contact between the adjacent layers at the layer interface becomes poor, resulting in making the light receiving member poor in mechanical strength.

On the other hand, in the case where hydrogen atoms (H) or/and halogen atoms (X) are contained in the neighborhood region of the layer interface between the adjacent layers at an enhanced concentration distribution as above described, the dangling bonds liable to trap photocarriers in the neighborhood region are compensated in a desirable state and the structure of the neighborhood region is markedly improved in terms of structural stability. Thus, the neighborhood region is markedly improved in terms of the characteristics and also in terms of the contact between the adjacent layers. Particularly, in the case where the halogen atoms (X) are contained in the neighborhood region of the interface between the adjacent layers at an enhanced concentration distribution, the halogen atoms (X) do not negatively influence to the optical band gap of each non-single crystal adjacent layer, and because of this, a desirable junction is attained at the layer interface between the adjacent layers. In this case, when the hydrogen atoms (H) are contained in the neighborhood region of the interface between the adjacent layers at an enhanced concentration distribution together with the halogen atoms (X), the dangling bonds which remain without being compensated by the halogen atoms (X) are entirely compensated by the hydrogen atoms (H). It is considered that this situation is provided as a result of the hydrogen atom (H) having a smaller atomic radius than that of the halogen atom (X) to have effectively worked. These factors make photocarries to smoothly mobilize in the layer thickness direction and to effectively prevent the photocarriers from mobilizing in the direction in parallel to the free surface of the light receiving member.

The foregoing suitable range for the specific interface neighborhood region of the multi-layered light receiving layer of the light receiving member according to the present invention not only in terms of the thickness but also in terms of the content of the hydrogen atoms (H) or/and halogen atoms (X) is based on the following findings obtained as a result of experimental studies by the present inventors.

That is, in a light receiving member having a light receiving layer having a stacked structure comprising at least two nc-Si:(H,X) layers each having a different chemical composition, when the content of hydrogen atoms (H) or/and halogen atoms (X) in (i) the neighborhood region of the interface between the adjacent constituent layers or in (ii) the neighborhood region of the interface between the substrate and the light receiving layer is excessive or when any of the neighborhood regions (i) and (ii) containing hydrogen atoms (H) or/and halogen atoms (X) at a relatively higher concentration distribution is excessively extended, not only the layer interface but also any of these interface neighborhood regions are liable to be poor not only in terms of the structural stability but also in terms of the quality. Specifically, when the hydrogen atoms (H) or/and halogen atoms (X) which serve to prevent occurrence of a structural distortion are contained in an excessive amount in any of these interface regions, a desirable contact is hardly attained not only between the adjacent constituent layers but also between the substrate and the light receiving layer, wherein the light receiving member eventually becomes poor in mechanical strength. In addition, in this case, there is a tendency that the networks among the layer constituent silicon atoms are deteriorated, resulting in reducing the characteristics of the light receiving member. This tendency becomes apparent especially in the case where the bulk layer region of each adjacent constituent layer contains the hydrogen atoms (H) or/and halogen atoms (X) in a greater amount than that in the interface neighborhood region.

On the other hand, when the content of hydrogen atoms (H) or/and halogen atoms (X) in the above neighborhood region (i) or in the above neighborhood region (ii) is excessively small or when any of the neighborhood regions (i) and (ii) containing hydrogen atoms (H) or/and halogen atoms (X) at a relatively higher concentration distribution is excessively narrow, there is a tendency that a structural distortion occurs in these neighborhood regions, and because of this, a desirable improvement is hardly seen in the characteristics of the light receiving member.

Then, the present inventor obtained a finding that the foregoing range for the specific interface neighborhood region of the multi-layered light receiving layer of the light receiving member not only in terms of the thickness but also in terms of the content of the hydrogen atoms (H) or/and halogen atoms (X) is especially important in order to attain the objects of the present invention.

In the following, the advantages of the present invention will be described in more detail by reference to examples and comparative examples, which are provided here for illustrative purposes only, and are not intended to limit the scope of the present invention.

Example 1

There were prepared various kinds of light receiving members each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate and said three-layered light receiving layer having a different layer interface neighborhood region in terms of the content of hydrogen atoms (H) at the interface between said charge injection inhibition layer and said photoconductive layer, in accordance with the foregoing film-forming manner using the microwave plasma CVD apparatus shown in FIGS. 12(A) and 12(B) under the conditions shown in Table 1.

Said layer interface neighborhood region in each case comprises a interface neighborhood region 1 situated on the charge injection inhibition layer side and another interface neighborhood region 2 situated on the photoconductive layer side, wherein the sum of the thicknesses of these two layer interface regions is designed to be of a given value in the range of 0.005 to 0.8 μm.

The constituent three layers of the three-layered nc-Si light receiving layer of each light receiving member were continuously formed without suspending the discharge under the conditions shown in Table 1, wherein the interface neighborhood region 1 was formed following the procedures of forming the charge injection inhibition layer except for additionally using $H_2$ gas at a given flow rate in the range of 0 to 1 slm and changing each of the inner pressure and bias voltage to a given value in the corresponding range of Table 1, and the interface neighborhood region 2 was formed following the procedures of forming the photoconductive layer except for additionally using $H_2$ gas at a given flow rate in the range of 0 to 1 slm and changing each of the inner pressure and bias voltage to a given value in the corresponding range of Table 1.

As for each kind light receiving member, there were prepared six electrophotographic light receiving member samples. In each case, of the six light receiving member samples, one was randomly chosen and subjected to the following evaluations.

That is, as for each light receiving member sample, it was cut in the layer thickness direction to obtain a plurality of specimens for evaluation. One of these specimens was subjected to analysis of the hydrogen content in each of the charge injection inhibition layer, layer interface neighborhood region and photoconductive layer by means of the secondary ion mass spectrometry (SIMS). Based on the results obtained, it was found that the relative value of the hydrogen content in the layer interface neighborhood region to that in the bulk layer region containing the hydrogen atoms at a relatively higher concentration (that is, the bulk layer region of the charge injection inhibition layer) is in the range of 1.0 to 2.2. And it was also found that the later interface neighborhood region is of a thickness in the range of 50 to 8000 Å.

The results obtained are collectively shown in Table 2. In Table 2, a to g indicate respective light receiving member samples which are different from each other in terms of the thickness of the layer interface neighborhood region, and A1 to A7 illustrate respectively the condition of the $H_2$ gas flow rate employed upon forming the layer interface neighborhood region, wherein A1 indicates the case where the $H_2$ gas flow rate was made to be 0 slm, A2 indicates the case where the $H_2$ gas flow rate was made to be 0.1 slm, A3 indicates the case where the $H_2$ gas flow rate was made to be 0.2 slm, A4 indicates the case where the $H_2$ gas flow rate was made to be 0.4 slm, A5 indicates the case where the $H_2$ gas flow rate was made to be 0.6 slm, A6 indicates the case where the $H_2$ gas flow rate was made to be 0.8 slm, and A7 indicates the case where the $H_2$ gas flow rate was made to be 1.0 slm.

Separately, one of the remaining light receiving member specimens obtained in the above as for each light receiving member sample was subjected to evaluation with respect to photoresponsibility in accordance with the foregoing measuring manner using the measuring system shown in FIG. 13, except for replacing the dye laser as the light source 405 by a halogen lamp. Particularly, light from the halogen lamp as the light source 405 was irradiated to the light receiving member specimen, wherein the photocurrent was measured from the initial stage when the light irradiation started to the stage when the photocurrent became to be of a fixed current value in relation to the lapse of time. Based on the measured results, there was obtained a change of rate in terms of photocurrent value per unit time period. The resultant value was made to be the photoresponsibility of the light receiving member sample involved.

In the above measurement, for the purpose of making the comparison to be easily conducted, the DC voltage applied, the light quantity irradiated, and the fixed current value were made to be 150 V, 5 uW, and 10 uA, respectively.

The evaluated results are collectively shown in Table 3 on the basis of the following criteria:

◎: the case where the photoresponsibility is excellent,

○: the case where the photoresponsibility is good,

Δ: the case where the photoresponsibility is not good but it is practically acceptable, and X: the case where the photoresponsibility is inferior but seems practically acceptable.

From the results shown in Table 3, it is understood that any of the light receiving member samples having a layer interface neighborhood region at the interface between the charge injection inhibition layer and the photoconductive layer wherein said layer interface neighborhood region containing the hydrogen atoms (H) at an enhanced concentration distribution which is higher than the concentration distribution of the hydrogen atoms (H) in the bulk layer region of each of the charge injection inhibition layer and the photoconductive layer markedly excels especially in photoresponsibility, and thus, these light receiving member samples may be desirably used as an image-forming member in electrophotography.

Example 2

The procedures of Example 1 were repeated, except that the thickness of the charge injection inhibition layer or/and the thickness of the photoconductive layer were thinned to be in the range of 1 to 2 μm, to thereby obtain various kinds of light receiving member samples each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate, and said three-layered light receiving layer having a different layer interface neighborhood region in terms of the content of hydrogen atoms (H) at the interface between said charge injection inhibition layer and said photoconductive layer.

Each light receiving member sample was evaluated with respect to photoresponsibility in the same manner as in Example 1.

As a result, there were obtained the following findings. That is, in the case where the thickness of the bulk layer region of the charge injection inhibition layer or/and the thickness of the bulk layer region of the photoconductive layer are relatively thin (that is, 1 to 2 μm thick), when the layer interface neighborhood region containing the hydrogen atoms at an enhanced concentration distribution is of a thickness corresponding to 30% or less of the thickness of the bulk layer region of the charge injection inhibition layer or the bulk layer region of the photoconductive layer which is thinner, the resulting light receiving member exhibits a significantly improved photoresponsibility.

Example 3

The procedures of Example 1 were repeated, except that the amount of the hydrogen atoms incorporated into not only the bulk layer region of each of the charge injection inhibition layer and the photoconductive layer but also the layer interface neighborhood region was varied, to thereby obtain various kinds of light receiving member samples each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer having a given hydrogen content, a photoconductive layer having a given hydrogen content and a surface layer being stacked in this order on the substrate, and said three-layered light receiving layer having a different layer interface neighborhood region in terms of the content of hydrogen atoms (H) at the interface between said charge injection inhibition layer and said photoconductive layer.

Each light receiving member sample was evaluated with respect to photoresponsibility in relation to the hydrogen content in each of the charge injection inhibition layer, the photoconductive layer and the layer interface neighborhood region in the same manner as in Example 1.

As a result, there were obtained the following findings. That is, any of the light receiving member samples in which the bulk layer region of each of the charge injection inhibition layer and the photoconductive layer has a hydrogen content in the range of 0.05 to 40 atomic %, the layer interface neighborhood region contains the hydrogen atoms at a concentration of 0.1 to 45 atomic % and has a thickness in the range of 100 to 5000Å, and the relative value of hydrogen content of the layer interface neighborhood region to the hydrogen content of the bulk layer region of either the charge injection inhibition layer or the photoconductive layer which is higher in terms of the hydrogen content is in the range of 1.2 to 2 is markedly excellent in photoresponsibility.

Example 4

The procedures of Example 1 were repeated, except that the layer-forming conditions of Table 1 were changed to those shown in Table 4, to thereby obtain various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate and said two-layered light receiving layer having a different layer interface neighborhood region in terms of the content of hydrogen atoms (H) at the interface between said photoconductive layer and said surface layer.

Said layer interface neighborhood region comprises a interface neighborhood region 1 situated on the photoconductive layer side and another interface neighborhood region 2 situated on the surface layer side, wherein the sum of the thicknesses of these two layer interface regions is designed to be of a given value in the range of 0.005 to 0.8 μm.

The constituent three layers of the two-layered nc-Si light receiving layer of each light receiving member were continuously formed without suspending the discharge under the conditions shown in Table 4, wherein the interface neighborhood region 1 was formed following the procedures of forming the photoconductive layer except for additionally using $H_2$ gas at a given flow rate in the range of 0 to 1 slm and changing each of the inner pressure and bias voltage to a given value in the corresponding range of Table 4, and the interface neighborhood region 2 was formed following the procedures of forming the surface layer except for additionally using $H_2$ gas at a given flow rate in the range of 0 to 1 slm and changing each of the inner pressure and bias voltage to a given value in the corresponding range of Table 4.

As for each kind light receiving member, there were prepared six electrophotographic light receiving member samples. In each case, of the six light receiving member samples, one was randomly chosen and subjected to the following evaluations.

That is, as for each light receiving member sample, it was cut in the layer thickness direction to obtain a plurality of specimens for evaluation. One of these specimens was subjected to analysis of the hydrogen content in each of the photoconductive layer, layer interface neighborhood region and surface layer by means of the SIMS.

Based on the results obtained, the relative value of the hydrogen content in the layer interface neighborhood region to that in the bulk layer region containing the hydrogen atoms at a relatively higher concentration (that is, the bulk layer region of the surface layer) was examined. It was found that the examined results are substantially the same as those shown in Table 2 which were obtained in Example 1.

Separately, one of the remaining light receiving member specimens obtained in the above as for each light receiving member sample was subjected to evaluation with respect to photocarrier mobility in accordance with the foregoing measuring manner using the measuring system shown in FIG. 13, wherein a photocarrier mobility (μ) was obtained based on the foregoing equation $u = d/(E \cdot t_r)$.

Based on the measured results, observation was made on the basis of the following criteria:

⊙: the case wherein the photocarrier mobility is excellent,

○: the case wherein the photocarrier mobility is good;

Δ: the case wherein the photocarrier mobility is not good but is practically acceptable, and X: the case wherein the photocarrier mobility is inferior but seems practically acceptable.

As a result, it was found that the evaluated results are substantially the same as those shown in Table 3.

From the results obtained, it is understood that any of the light receiving member samples having a 100 to 5000 Å thick layer interface neighborhood region containing hydrogen atoms at an enhanced concentration distribution at the interface between the photoconductive layer and the surface layer in which the relative value of the hydrogen content of the layer interface neighborhood region to that of the bulk layer region of either the photoconductive layer or the surface layer which is relatively higher in terms of the hydrogen content is in the range of 1.1 to 2.0 distinguishably excels especially in photocarrier mobility.

Example 5

The procedures of Example 4 were repeated, except that the layer-forming conditions of Table 4 were changed to those shown in Table 5, to thereby obtain various kinds of light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge transportation layer and a charge generation layer being stacked in this order on the substrate, and said two-layered light receiving layer having a different layer interface neighborhood region in terms of the content of hydrogen atoms (H) at the interface between said charge transportation layer and said charge generation layer.

Each of the light receiving member samples obtained was evaluated in the same manner as in Example 4. The evaluated results were found to be substantially the same as those obtained in Example 4.

Example 6

(1) The procedures of Example 4 were repeated, except that the thickness of the photoconductive layer or/and the thickness of the surface layer were thinned to be in the range of 1 to 2 μm, to thereby obtain various kinds of light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate, and said two-layered light receiving layer having a different layer interface neighborhood region in terms of the content of hydrogen atoms (H) at the interface between said photoconductive layer and said surface layer.

(2) The procedures of Example 5 were repeated, except that the thickness of the charge transportation layer or/and the thickness of the charge generation layer were thinned to be in the range of 1 to 2 μm, to thereby obtain various kinds of light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge transportation layer and a charge generation layer being stacked in this order on the substrate, and said two-layered light receiving layer having a different layer interface neighborhood region in terms of the content of hydrogen atoms (H) at the interface between said charge transportation layer and said charge generation layer.

Each of the light receiving member samples obtained in the above (1) and (2) was evaluated with respect to photocarrier mobility in the same manner as in Example 4.

As a result, there were obtained the following findings. That is, as for the light receiving member samples obtained in the above (1), in the case where the thickness of the bulk layer region of the photoconductive layer or/and the thickness of the bulk layer region of the surface layer are relatively thin (that is, 1 to 2 μm thick), when the layer interface neighborhood region containing the hydrogen atoms at an enhanced concentration distribution is of a thickness corresponding to 30% or less of the thickness of the bulk layer region of the photoconductive layer or the bulk layer region of the surface layer which is thinner, the resulting light receiving member is significantly excellent especially in terms of photocarrier mobility.

Similarly, as for the light receiving member samples obtained in the above (2), in the case where the thickness of the bulk layer region of the charge transportation layer or/and the thickness of the bulk layer region of the charge generation layer are relatively thin (that is, 1 to 2 μm thick), when the layer interface neighborhood region containing the hydrogen atoms at an enhanced concentration distribution is of a thickness corresponding to 30% or less of the thickness of the bulk layer region of the charge transportation layer or the bulk layer region of the charge generation layer which is thinner, the resulting light receiving member is significantly excellent especially in terms of photocarrier mobility.

Example 7

(1) The procedures of Example 4 were repeated, except that the amount of the hydrogen atoms incorporated into not only the bulk layer region of each of the photoconductive layer and the surface layer but also the layer interface neighborhood region was varied, to thereby obtain various kinds of light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer having a different hydrogen content, a photoconductive layer having a different hydrogen content and a surface layer having a different hydrogen content being stacked in this order on the substrate, and said two-layered light receiving layer having a different layer interface neighborhood region in terms of the content of hydrogen atoms (H) at the interface between said photoconductive layer and said surface layer.

(2) The procedures of Example 5 were repeated, except that the amount of the hydrogen atoms incorporated into not only the bulk layer region of each of the charge transportation layer and the charge generation layer but also the layer interface neighborhood region was varied, to thereby obtain various kinds of light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge transportation layer having a different hydrogen content and a charge generation layer having a different hydrogen content having a different hydrogen content being stacked in this order on the substrate, and said two-layered light receiving layer having a different layer interface neighborhood region in terms of the content of hydrogen atoms (H) at the interface between said charge transportation layer and said charge generation layer.

Each of the light receiving member samples obtained in the above (1) and (2) was evaluated with respect to photocarrier mobility in relation to the hydrogen content in each bulk layer region and the layer interface neighborhood region in the same manner as in Example 4.

As a result, there were obtained the following findings. That is, in the case of the light receiving member samples obtained in the above (1), any of the light receiving member samples in which the bulk layer region of each of the photoconductive layer and the surface layer has a hydrogen content in the range of 0.05 to 40 atomic %, the layer interface neighborhood region contains the hydrogen atoms at a concentration of 0.1 to 45 atomic % and has a thickness in the range of 100 to 5000Å, and the relative value of hydrogen content of the layer interface neighborhood region to the hydrogen content of the bulk layer region of either the photoconductive layer or the surface layer which is relatively higher in terms of the hydrogen content is in the range of 1.2 to 2 is markedly excellent in photocarrier mobility.

Similarly, in the case of the light receiving member samples obtained in the above (2), any of the light receiving member samples in which the bulk layer region of each of the charge transportation layer and the charge generation layer has a hydrogen content in the range of 0.05 to 40 atomic %, the layer interface neighborhood region contains the hydrogen atoms at a concentration of 0.1 to 45 atomic % and has a thickness in the range of 100 to 5000Å, and the relative value of hydrogen content of the layer interface neighborhood region to the hydrogen content of the bulk layer region of either the charge transportation layer or the charge generation layer which is relatively higher in terms of the hydrogen content is in the range of 1.2 to 2 is markedly excellent especially in photocarrier mobility.

Example 8

The procedures of Example 1 were repeated, except that the layer-forming conditions of Table 1 were changed to those shown in Table 6, to thereby obtain various kinds of light receiving members each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer, a charge generation layer and a surface layer being stacked in this order on the substrate, and said four-layered light receiving layer having a different layer interface neighborhood region in terms of the content of hydrogen atoms (H) at the interface between said charge transportation layer and said charge generation layer.

Said layer interface neighborhood region comprises a interface neighborhood region 1 situated on the charge transportation layer side and another interface neighborhood region 2 situated on the charge generation layer side, wherein the sum of the thicknesses of these two layer interface regions is designed to be of a given value in the range of 0.005 to 0.8 μm.

The constituent four layers of the four-layered nc-Si light receiving layer of each light receiving member were continuously formed without suspending the discharge under the conditions shown in Table 6, wherein the interface neighborhood region 1 was formed following the procedures of forming the charge transportation layer except for additionally using $H_2$ gas at a given flow rate in the range of 0 to 1 slm and changing each of the inner pressure and bias voltage to a given value in the corresponding range of Table 6, and the interface neighborhood region 2 was formed following the procedures of forming the charge generation layer except for additionally using $H_2$ gas at a given flow rate in the range of 0 to 1 slm and changing each of the inner pressure and bias voltage to a given value in the corresponding range of Table 6.

As for each kind light receiving member, there were prepared six electrophotographic light receiving member samples. In each case, of the six light receiving member samples, one was randomly chosen and subjected to the following evaluations.

That is, as for each light receiving member sample, it was cut in the layer thickness direction to obtain a plurality of specimens for evaluation. One of these specimens was subjected to analysis of the hydrogen content in each of the charge transportation layer, layer interface neighborhood region and charge generation layer by means of the SIMS.

Based on the results obtained, the relative value of the hydrogen content in the layer interface neighborhood region to that in the bulk layer region containing the hydrogen atoms at a relatively higher concentration (that is, the bulk layer region of the charge transportation layer) was examined. It was found that the examined results are substantially the same as those shown in Table 2 which were obtained in Example 1.

Separately, one of the remaining light receiving member specimens obtained in the above as for each light receiving member sample was subjected to evaluation with respect to photocarrier mobility in accordance with the foregoing measuring manner using the measuring system shown in FIG. 13, wherein a photocarrier mobility (μ) was obtained based on the foregoing equation $u= d/(E \cdot t_r)$.

Based on the measured results, observation was made on the basis of the same criteria employed in Example 4.

As a result, it is understood that any of the light receiving member samples having a 100 to 5000Å thick layer interface neighborhood region containing hydrogen atoms at an enhanced concentration distribution at the interface between the charge transportation layer and the charge generation layer in which the relative value of the hydrogen content of the layer interface neighborhood region to that of the bulk layer region of either the charge transportation layer or the charge generation layer which is relatively higher in terms of the hydrogen content is in the range of 1.1 to 2.0 distinguishably excels especially in photocarrier mobility.

Example 9

The procedures of Example 8 were repeated, except that the thickness of the charge transportation layer or/and the thickness of the charge generation layer were thinned to be in the range of 1 to 2 μm, to thereby obtain various kinds of light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer, a charge generation layer, and a surface layer being stacked in this order on the substrate, and said two-layered light receiving layer having a different layer interface neighborhood region in terms of the content of hydrogen atoms (H) at the interface between said charge transportation layer and said charge generation layer.

Each of the light receiving member samples obtained in the above was evaluated with respect to photocarrier mobility in the same manner as in Example 4.

As a result, there were obtained the following findings. That is, in the case where the thickness of the bulk layer region of the charge transportation layer or/and the thickness of the bulk layer region of the charge generation layer are relatively thin (that is, 1 to 2 μm thick), when the layer interface neighborhood region containing the hydrogen atoms at an enhanced concentration distribution is of a thickness corresponding to 30% or less of the thickness of the bulk layer region of the charge transportation layer or the bulk layer region of the charge generation layer which is thinner, the resulting light receiving member is significantly excellent especially in terms of photocarrier mobility.

Example 10

The procedures of Example 8 were repeated, except that the amount of the hydrogen atoms incorporated into not only the bulk layer region of each of the charge transportation layer and the charge generation layer but also the layer interface neighborhood region was varied, to thereby obtain various kinds of light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer having a different hydrogen content, a charge generation layer having a different hydrogen content, and a surface layer being stacked in this order on the substrate, and said four-layered light receiving layer having a different layer interface neighborhood region in terms of the content of hydrogen atoms (H) at the interface between said charge transportation layer and said charge generation layer.

Each of the light receiving member samples obtained in the above was evaluated with respect to photocarrier mobility in relation to the hydrogen content in each bulk layer region and the layer interface neighborhood region in the same manner as in Example 4.

As a result, there were obtained the following findings. That is, any of the light receiving member samples in which the bulk layer region of each of the charge transportation layer and the charge generation layer has a hydrogen content in the range of 0.05 to 40 atomic %, the layer interface neighborhood region contains the hydrogen atoms at a concentration of 0.1 to 45 atomic % and has a thickness in the range of 100 to 5000Å, and the relative value of hydrogen content of the layer interface neighborhood region to the hydrogen content of the bulk layer region of either the charge transportation layer or the charge generation layer which is relatively higher in terms of the hydrogen content is in the range of 1.2 to 2 is markedly excellent in photocarrier mobility.

Example 11

The procedures of preparing the light receiving member of Sample A3-e in Example 1 were repeated, except that no surface layer was formed, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate, and said two-layered light receiving layer having a 3000Å thick layer interface neighborhood region containing hydrogen atoms at an enhanced concentration distribution in terms of the content of hydrogen atoms (H) at the interface between said charge injection inhibition layer and said photoconductive layer wherein the hydrogen content of the layer interface region is as much as 1.3 times over that of the bulk layer region which is relatively higher in terms of the hydrogen content (that is, the bulk layer region of the charge injection inhibition layer).

EVALUATION

As for the light receiving member sample obtained in Example 11, evaluation was made with respect to (i) photosensitivity, (ii) charge retentivity, (iii) minute line reproduction, (iv) appearance of white fogging, and (v) appearance of uneven density image (or halftone reproduction), using a modification of a commercially available electrophotographic copying machine NP 7550 (product of CANON Kabushiki Kaisha), modified for experimental purposes such that the image-forming process can be conducted at a process speed which is higher as much as 1.2 holds over the ordinary image-forming speed (80 copies/minute), and all of the photosensitivity and charge retentivity can be evaluated.

Each of the evaluation items (i) to (v) was conducted in the following manner. The image-forming process was continuously repeated 500,000 times while applying a high voltage of + 6 kV to the charger.

Evaluation of the photosensitivity (i)

The light receiving member sample is set to the above electrophotographic copying machine, wherein the light receiving member sample is subjected to charging so as to provide a given surface potential in dark therefor by way of a conventional electrophotographic process, followed by subjecting to irradiation of light from a Xenon lamp while excluding light having a wavelength of less than 550 nm by means of a cut-filter wherein photocarriers are generated in the light irradiated portion of the light receiving member sample to attenuate the surface potential. The surface potential (that is, the surface potential in light) of the light receiving member sample in this case is measured by means of an electrostatic voltmeter. And the quantity of exposure light is so adjusted that the surface potential in light becomes to be a given value. The quantity of the exposure light used in this case is made to be a photosensitivity of the light receiving member sample. Particularly, in this case, the quantity of exposure light required to attain an identical surface potential in light is evaluated. In other words, the smaller the quantity of exposure light, the greater the photosensitivity.

This measurement is conducted at selected surface portions of the light receiving member sample at an interval 3 cm in the up-and-down direction. This measuring manner is conducted at the initial stage and at the stage after 500,000 times repeated shots. As for the measured values obtained at the stage after 500,000 timed repeated shots, a mean value is obtained, and the value which is the most distant from the mean value is made to be a photosensitivity for the light receiving member sample. Since the light receiving member sample comprises six samples, this evaluation is conducted for all of them. And one which is worst in terms of photosensitivity is dedicated for the evaluation on the following criteria.

- ⊚: the case wherein the light receiving member sample is excellent in photosensitivity uniformity,
- ○: the case wherein the light receiving member sample is good in photosensitivity uniformity,
- Δ: the case wherein the light receiving member sample is not so good in photosensitivity uniformity but is practically applicable, and
- X: the case wherein the light receiving member sample is practically acceptable in terms of photosensitivity when the image-forming process is conducted at the ordinary speed but it is not satisfactory when the image-forming process is conducted at a very high speed.

Evaluation of the charge retentivity (ii)

The light receiving member sample is set to the above electrophotographic copying machine, wherein the light receiving member sample is subjected to corona charging by applying a high voltage of + 6 kV to the charger, wherein a surface potential in dark is measured by means of the electrostatic voltmeter. This measurement is conducted at selected surface portions of the light receiving member sample at an interval 3 cm in the up-and-down direction. This measuring manner is conducted at the initial stage and at the stage after 500,000 times repeated shots. As for the measured values obtained at the stage after 500,000 timed repeated shots, a mean value is obtained. The mean value obtained is made to be a charge retentivity of the light receiving member sample. And the value which is the most distant from the mean value is made to of a charge retentivity unevenness. Since the light receiving member sample comprises six samples, this evaluation is conducted for all of them. And one which is worst in terms of charge retentivity is dedicated for the evaluation on the following criteria.

⊙: the case wherein charge retentivity is excellently uniform,

○: the case wherein charge retentivity is satisfactorily uniform,

Δ: the case wherein charge retentivity is not so good in uniformity but is practically applicable, and X: the case wherein charge retentivity is practically acceptable when the image-forming process is conducted at the ordinary speed but it is liable to deteriorate, resulting in providing defective copied images when the image-forming process is conducted at a very high speed.

Evaluation of the minute line reproduction (iii)

The light receiving member sample is set to the above electrophotographic copying machine, wherein using a test chart FY9-9058 (produced by CANON Kabushiki Kaisha) containing minute characters on the white background as an original, the image-forming process is continuously repeated 500,000 times. The copied image obtained at the initial stage and that obtained after 500,000 times repeated shots are examined of whether or not a defect is present in the reproduction of the minute characters. Since the light receiving member sample comprises six samples, this evaluation is conducted for all of them. And one which is worst in terms of reproduction of the minute characters of the original is dedicated for the evaluation on the following criteria.

⊙: the case wherein minute line reproduction is excellent,

○: the case wherein minute line reproduction is good,

Δ: the case wherein a certain defect is present in the minute line reproduction but not practically problematic, and X: the case wherein some distinguishable defects are present in the minute line reproduction but the reproduced minute characters can be distinguished.

Evaluation of the appearance of white fogging (iv)

The light receiving member sample is set to the above electrophotographic copying machine, wherein using a test chart FY9-9058 (produced by CANON Kabushiki Kaisha) containing minute characters on the white background as an original, the image-forming process is continuously repeated 500,000 times. The copied image obtained at the initial stage and that obtained after 500,000 times repeated shots are examined of whether or not white fogging is appeared in the reproduction of the minute characters. Since each light receiving member sample comprises six samples, this evaluation is conducted for all of them. And one which is worst in terms of appearance of white fogging is dedicated for the evaluation on the following criteria.

⊙: the case wherein no white fogging is appeared,

○: the case wherein extremely slight white fogging is appeared,

Δ: the case wherein somewhat white fogging is appeared, but the reproduced minute characters can be easily distinguished, and X: the case wherein white fogging is appeared over the entire area but the reproduced minute characters can be distinguished.

Evaluation of the appearance of uneven density image (halftone reproduction) (v)

The light receiving member sample is set to the above electrophotographic copying machine, wherein using a halftone test chart FY9-9042 (produced by CANON Kabushiki Kaisha) in which the entire area comprises a halftone image as an original, the image-forming process is continuously repeated 500,000 times. The copied image obtained at the initial stage and that obtained at the stage after 500,000 times repeated shots are examined in a manner that as for the copied image, 100 circular portions of 0.05 mm in diameter are randomly selected, the optical density of each circular portion is measured, and a mean value among the measured values is obtained. Since the light receiving member sample comprises six samples, this evaluation is conducted for all of them. And one which is worst in terms of halftone reproduction is dedicated for the evaluation on the following criteria.

⊙: the case wherein halftone image is reproduced in an excellent state with no uneven density, ○: the case wherein halftone image is reproduced in a satisfactory state, Δ: the case wherein certain uneven density portions are present in the reproduced halftone image but not practically problematic, and X: the case wherein distinguishable uneven density portions are present in the entire reproduced halftone image but the reproduced image can be distinguished.

The evaluated results with respect to the evaluation items (i) to (v) are collectively shown in Table 9.

Examples 12 to 14 and Comparative Examples 1 to 3

Example 12

The procedures of preparing the light receiving member of Sample A3-e in Example 1 were repeated, to thereby obtain six light receiving member samples each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate, and said three-layered light receiving layer having a 3000Å thick layer interface neighborhood region containing hydrogen atoms at an enhanced concentration distribution in terms of the content of hydrogen atoms (H) at the interface between said charge injection inhibition layer and said photoconductive layer wherein the hydrogen content of the layer interface region is as much as 1.3 times over that of the bulk layer region which is relatively higher in terms of the hydrogen content (that is, the bulk layer region of the charge injection inhibition layer).

Example 13

In accordance with the procedures of preparing a light receiving member using the microwave plasma CVD apparatus and under the conditions shown in Table 7, there were prepared six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising an infrared absorption layer (a IR absorption layer), a charge injection inhibition layer, a photoconductive layer and a surface layer being stacked in this order on the substrate, and said four-layered light receiving layer having a 3000Å thick layer interface neighborhood region (comprising a layer interface neighborhood region 1 situated on the charge injection inhibition layer and a layer interface neighborhood region 2 situated on the photoconductive layer side) containing hydrogen atoms at an enhanced concentration distribution in terms of the content of hydrogen atoms (H) at the interface between said charge injection inhibition layer and said photoconductive layer wherein the hydrogen content of the layer interface region is as much as 1.3 times over that of the bulk layer region which is relatively higher in terms of the hydrogen content (that is, the bulk layer region of the charge injection inhibition layer).

Example 14

In accordance with the procedures of preparing a light receiving member using the microwave plasma CVD apparatus and under the conditions shown in Table 8, there were prepared six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer, a charge generation layer and a surface layer being stacked in this order on the substrate, and said four-layered light receiving layer having a 3000Å thick layer interface neighborhood region (comprising a layer interface neighborhood region 1 situated on the charge injection inhibition layer and a layer interface neighborhood region 2 situated on the charge transportation layer side) containing hydrogen atoms at an enhanced concentration distribution in terms of the content of hydrogen atoms (H) at the interface between said charge injection inhibition layer and said charge transportation layer wherein the hydrogen content of the layer interface region is as much as 1.3 times over that of the bulk layer region which is relatively higher in terms of the hydrogen content (that is, the bulk layer region of the charge transportation layer).

Comparative Example 1

The procedures of Example 12 were repeated, except that no layer interface neighborhood region was formed, to thereby obtain six comparative light receiving member samples each having a three-layered nc-Si light receiving layer comprising a charge injection inhibition layer, a photoconductive layer and a surface layer.

Comparative Example 2

The procedures of Example 13 were repeated, except that no layer interface neighborhood region was formed, to thereby obtain six comparative light receiving member samples each having a four-layered nc-Si light receiving layer comprising an IR absorption layer, a charge injection inhibition layer, a photoconductive layer and a surface layer.

Comparative Example 3

The procedures of Example 14 were repeated, except that no layer interface neighborhood region was formed, to thereby obtain six comparative light receiving member samples each having a four-layered nc-Si light receiving layer comprising a charge injection inhibition layer, a charge transportation layer, a charge generation layer and a surface layer.

EVALUATION

As for each of the light receiving members obtained in Examples 12 to 14 and Comparative Examples 1 to 3, evaluation was made with respect to (i) photosensitivity, (ii) charge retentivity, (iii) minute line reproduction, (iv) appearance of white fogging, and (v) appearance of uneven density image (or halftone reproduction), respectively in the same evaluation manner as in Example 1.

The evaluated results with respect to the evaluation items (i) to (v) are collectively shown in Table 9.

From the results shown in Table 9, it is understood that any of the light receiving members obtained in Examples 11 to 14 belonging to the present invention are apparently surpassing the comparative light receiving members obtained in Comparative Examples 1 to 3, and they are excellent or satisfactory as for any of the evaluation items (i) to (v) which are related to photoresponsibility.

Example 15 and Comparative Examples 4 and 5

Example 15

The procedures of preparing the light receiving member of Sample A3-e in Example 4 were repeated, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate, and said two-layered light receiving layer having a 3000Å thick layer interface neighborhood region containing hydrogen atoms at an enhanced concentration distribution in terms of the content of hydrogen atoms (H) at the interface between said photoconductive layer and said surface layer wherein the hydrogen content of the layer interface region is as much as 1.3 times over that of the bulk layer region which is relatively higher in terms of the hydrogen content (that is, the bulk layer region of the surface layer).

Comparative Example 4

The procedures of the foregoing Example 11 were repeated, except that no layer interface neighborhood region was formed, to thereby obtain six comparative light receiving member samples each having a two-layered nc-Si light receiving layer comprising a charge injection inhibition layer and a photoconductive layer.

Comparative Example 5

The procedures of Example 15 were repeated, except that no layer interface neighborhood region was formed, to thereby obtain six comparative light receiving member samples each having a two-layered nc-Si light receiving layer comprising a photoconductive layer and a surface layer.

EVALUATION

As for each of the light receiving member samples obtained in Example 15 and Comparative Examples 4 and 5, evaluation was made with respect to charge retentivity, photosensitivity, residual potential, and appearance of uneven density image (or halftone reproduction). The evaluation of each of the charge retentivity, photosensitivity, and appearance of uneven density image (or halftone reproduction) was conducted in the same evaluation manner as in Example 1, wherein the evaluation as for each of the these evaluation items was conducted after 500,000 times repeated shots in the case where the image-forming process was conducted at ordinary process speed (A) and also in the case where the image-forming process was conducted at a process speed (B) which is higher as much as 1.2 times over the process speed (A).

The evaluation of the residual potential was conducted in the following manner. That is, the light receiving member sample is set to the foregoing electrophotographic copying machine modified for experimental purposes, wherein the light receiving member sample is charged so as to provide a given surface potential in dark therefor, soon after this, a given quantity of relatively intense light from a Xenon lamp is irradiated thereto while excluding light of less than 550 nm by means of a cut-filter, wherein the surface potential in light of the light receiving member sample is measured by means of an electrostatic voltmeter. The surface potential in light obtained in this case is made to be a residual potential of the light receiving member sample. Particularly, the electric potential remained without being attenuated when a given quantity of light is irradiated is evaluated as the residual potential.

This evaluation is conducted after 500,000 times repeated shots in the case where the image-forming process is conducted at ordinary process speed (A) and also in the case where the image-forming process is conducted at a process speed (B) which is higher as much as 1.2 times over the process speed (A).

The evaluated results with respect to each evaluation item are collectively shown in Table 10.

Separately, as for the light receiving member samples obtained in the foregoing Examples 11 to 14 and the foregoing Comparative Examples 1 and 3, each of them was evaluated in the same manner as in the above. The evaluated results are also collectively shown in Table 10.

From the results shown in Table 10, it is understood that any of the light receiving members obtained in Examples 11 to 15 belonging to the present invention are apparently surpassing the comparative light receiving members obtained in Comparative Examples 1 to 5 in terms of the electrophotographic characteristics required for conducting the electrophotographic image-forming process at an increased, high speed.

Examples 16 to 18 and Comparative Examples 6 and 8

Example 16

The procedures of preparing the light receiving member of Sample A3-e in Example 8 were repeated, except that no charge injection inhibition layer was formed, to thereby obtain six light receiving member samples each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge transportation layer, a charge generation layer and a surface layer being stacked in this order on the substrate, and said three-layered light receiving layer having a 3000Å thick layer interface neighborhood region containing hydrogen atoms at an enhanced concentration distribution in terms of the content of hydrogen atoms (H) at the interface between said charge transportation layer and said charge generation layer wherein the hydrogen content of the layer interface region is as much as 1.3 times over that of the bulk layer region which is relatively higher in terms of the hydrogen content (that is, the bulk layer region of the charge transportation layer).

Example 17

The procedures of preparing the light receiving member of Sample A3-e in Example 8 were repeated, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer, a charge generation layer and a surface layer being stacked in this order on the substrate, and said four-layered light receiving layer having a 3000Å thick layer interface neighborhood region containing hydrogen atoms at an enhanced concentration distribution in terms of the content of hydrogen atoms (H) at the interface between said charge transportation layer and said charge generation layer wherein the hydrogen content of the layer interface region is as much as 1.3 times over that of the bulk layer region which is relatively higher in terms of the hydrogen content (that is, the bulk layer region of the charge transportation layer).

Example 18

In accordance with the procedures of preparing a light receiving member using the microwave plasma CVD apparatus and under the conditions shown in Table 11, there were prepared six light receiving member samples each comprising a substrate comprising an aluminum cylinder having a mirror-ground surface and a five-layered non-single crystal silicon (nc-Si) light receiving layer disposed on said mirror-ground surface of the aluminum cylinder as the substrate, said five-layered nc-Si light receiving layer comprising an infrared absorption layer (a IR absorption layer), a charge injection inhibition layer, a charge transportation layer, a charge generation layer and a surface layer being stacked in this order on the substrate, and said four-layered light receiving layer having a 3000Å thick layer interface neighborhood region (comprising a layer interface neighborhood region 1 situated on the charge transportation layer and a layer interface neighborhood region 2 situated on the charge generation layer side) containing hydrogen atoms at an enhanced concentration distribution in terms of the content of hydrogen atoms (H) at the interface between said charge transportation layer and said charge generation layer wherein the hydrogen content of the layer interface neighborhood region is as much as 1.3 times over that of the bulk layer region which is relatively higher in terms of the hydrogen content (that is, the bulk layer region of the charge transportation layer).

Comparative Example 6

The procedures of Example 16 were repeated, except that no layer interface neighborhood region was formed, to thereby obtain six comparative light receiving member samples each having a three-layered nc-Si light receiving layer comprising a charge transportation layer, a charge generation layer and a surface layer.

Comparative Example 7

The procedures of Example 17 were repeated, except that no layer interface neighborhood region was formed, to thereby obtain six comparative light receiving member samples each having a four-layered nc-Si light receiving layer comprising a charge injection inhibition layer, a charge transportation layer, a charge generation layer and a surface layer.

Comparative Example 8

The procedures of Example 18 were repeated, except that no layer interface neighborhood region was formed, to thereby obtain six comparative light receiving member samples each having a five-layered nc-Si light receiving layer comprising an IR absorption layer, a charge injection inhibition layer, a charge transportation layer, a charge generation layer and a surface layer.

EVALUATION

As for each of the light receiving member samples obtained in Examples 16 to 18 and Comparative Examples 6 to 8, evaluation was made with respect to charge retentivity, photosensitivity, residual potential, and photomemory. The evaluation of each of the charge retentivity, photosensitivity, and residual potential was conducted in the foregoing corresponding evaluation manner, wherein the evaluation as for each of the these evaluation items was conducted after 500,000 times repeated shots in the case where the image-forming process was conducted at ordinary process speed (A) and also in the case where the image-forming process was conducted at a process speed (B) which is higher as much as 1.2 holds over the process speed (A).

The evaluation of the photomemory was conducted in the following manner. That is, in general, upon continuously conducting the image-forming process, blank exposure light is irradiated in order to extinguish the surface charges of the light receiving member so that toner deposition on the surface portion of the light receiving member which is situated between successively feeding papers is not occurred. The history of the portion of the light receiving member which has been irradiated with the blank exposure light in the previous image-forming process is compared with the remaining portion of the light receiving member which has been irradiated with no blank exposure light, and the difference between them in terms of surface potential is numerically evaluated. And the potential difference obtained in this case is made to be a photomemory. In more detail, the light receiving member sample is set to the foregoing electrophotographic copying machine modified for experimental purposes, wherein a given surface portion of the light receiving member sample which is corresponding to the space between successively feeding papers is charged so as to provide a given surface potential in dark therefor under the condition that no blank exposure light is irradiated. A surface potential in dark in the circumferential direction of the light receiving member sample in this case is measured by means of an electrostatic voltmeter and the measured result (Data 1) obtained is memorized in a computer. Then, under the condition that blank exposure light is irradiated to said surface portion corresponding to the space between successively feeding papers, a surface potential in dark in the circumferential direction of the light receiving member sample is measured in the same manner as in the above and the measured result (Data 2) obtained is memorized in the computer. Based on the Data 1 and 2, the difference in terms of the surface potential in dark is obtained and the value of the difference is made to be a photomemory of the light receiving member sample due to irradiation of blank exposure light. If the light receiving member sample is desirable one which is free of photomemory, the Data 1 and 2 are equivalent wherein no history due to the irradiation of blank exposure light is remained on the light receiving member sample. On the other hand, if the light receiving member sample is one which is accompanied by a photomemory, the history based on the irradiation of blank exposure light is remained on the portion of light receiving member sample having been irradiated with blank exposure light to cause a difference in terms of the surface potential in dark between the Data 1 and 2. The evaluation of photomemory is conducted based on the magnitude of this difference. In order to precisely measure the difference in terms of the surface potential in dark by overlapping the Data 1 and 2, the measuring timing is adjusted so that each measurement may be conducted for the same portion of the light receiving member sample.

The evaluation is conducted after 500,000 times repeated shots in the case where the image-forming process is conducted at ordinary process speed (A) and also in the case where the image-forming process is conducted at a process speed (B) which is higher as much as 1.2 times over the process speed (A).

Since each light receiving member sample comprises six samples, this evaluation is conducted for all of them. And one which is worst in terms of photomemory is dedicated for the evaluation on the following criteria.

⊙: the case wherein the result is excellent,

○: the case wherein the result is good,

Δ: the case wherein the result is not so good but practically acceptable, and

X: the case wherein the result is inferior but seems practically acceptable.

The evaluated results with respect to each evaluation item are collectively shown in Table 12.

From the results shown in Table 12, it is understood that any of the light receiving members obtained in Examples 16 to 18 belonging to the present invention is apparently surpassing the comparative light receiving members obtained in Comparative Examples 6 to 8 in terms of the electrophotographic characteristics required for conducting the electrophotographic image-forming process at an increased, high speed.

Example 19

The procedures of each of the foregoing Examples 11 to 18 were repeated, except that the layer interface neighborhood region was made such that it has a thickness in the range of 100 to 5000Å and the hydrogen content thereof is as much as 1.1 to 2.0 times over that of the bulk layer region which is relatively higher, to thereby obtain various kinds of light receiving member samples in each case.

These light receiving member samples obtained were evaluated in the foregoing evaluation manners. As a result, satisfactory results were obtained as well as in the foregoing Examples 11 to 18.

Example 20

The procedures of each of the foregoing Examples 11 to 18 were conducted in accordance with the foregoing layer-forming manner using the RF CVD apparatus shown in FIG. 14, to thereby obtain various kinds of light receiving member samples in each case.

These light receiving member samples obtained were evaluated in the foregoing evaluation manners. As a result, satisfactory results were obtained as well as in the foregoing Examples 11 to 18.

Example 21

In accordance with the film-forming manner using the microwave plasma CVD apparatus shown in FIGS. 12(A) and 12(B) and under the conditions shown in Table 13, there were prepared various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate and said two-layered light receiving layer having a different layer interface neighborhood region in terms of the content of halogen atoms (X) and also in terms of the thickness at the interface between said charge injection inhibition layer and said photoconductive layer.

Said layer interface neighborhood region in each case comprises a interface neighborhood region 1 situated on the charge injection inhibition layer side and another interface neighborhood region 2 situated on the photoconductive layer side, wherein the sum of the thicknesses of these two layer interface regions is designed to be of a given value in the range of 0.005 μm (50Å) to 2 μm, and the amount of the halogen atoms (X) is varied in the range of 0.1 atomic ppm to 35 atomic % in terms of the ratio to the amount of the total constituent atoms thereof.

The constituent two layers of the two-layered nc-Si light receiving layer of each light receiving member were continuously formed without suspending the discharge under the conditions shown in Table 13, wherein the interface neighborhood region 1 was formed following the procedures of forming the charge injection inhibition layer except for additionally using $SiF_4$ gas at a given flow rate in the range of 0 to 400 sccm and changing each of the inner pressure and bias voltage to a given value in the corresponding range of Table 13, and the interface neighborhood region 2 was formed following the procedures of forming the photoconductive layer except for additionally using $SiF_4$ gas at a given flow rate in the range of 0 to 400 sccm and changing each of the inner pressure and bias voltage to a given value in the corresponding range of Table 13.

As for each kind light receiving member, there were prepared six electrophotographic light receiving member samples. In each case, of the six light receiving member samples, one was randomly chosen and subjected to the following evaluations.

That is, as for each light receiving member sample, it was cut in the layer thickness direction to obtain a plurality of specimens for evaluation. One of these specimens was subjected to analysis of the halogen content in the layer interface neighborhood region by means of the SIMS. The results obtained are collectively shown in Table 14.

Separately, one of the remaining light receiving member specimens obtained in the above as for each light receiving member sample was subjected to evaluation with respect to photocarrier mobility (μ) in accordance with the foregoing photocarrier mobility measuring manner using the measuring system shown in FIG. 13.

The evaluated results are collectively shown in Table 15 on the basis of the following criteria:

⊚: the case wherein the photocarrier mobility is excellent,

○: the case wherein the photocarrier mobility is good;

Δ: the case wherein the photocarrier mobility is not so good, and

X: the case wherein the photocarrier mobility is inferior but it is practically acceptable.

From the results shown in Table 15, it is understood that any of the light receiving member samples having a 0.01 μm (100Å) to 1 μm thick layer interface neighborhood region at the interface between the charge injection inhibition layer and the photoconductive layer wherein said layer interface neighborhood region containing the halogen atoms (X) at an enhanced concentration distribution in the range of 0.5 atomic ppm to 30 atomic % in terms of the ratio of the amount of the halogen atoms (X) to that of the total constituent atoms markedly excels especially in photocarrier mobility, and thus, these light receiving member samples may be desirably used as an image-forming member in electrophotography.

Example 22

(1) In accordance with the film-forming manner using the microwave plasma CVD apparatus shown in FIGS. 12(A) and 12(B) and under the conditions shown in 16, there were prepared various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate, and said two-layered light receiving layer having a different layer interface neighborhood region in terms of the content of halogen atoms (X) and also in terms of the thickness at the interface between said photoconductive layer and said surface layer.

Said layer interface neighborhood region in each case comprises a interface neighborhood region 1 situated on the photoconductive layer side and another interface neighborhood region 2 situated on the surface layer side, wherein the sum of the thicknesses of these two layer interface regions is designed to be of a given value in the range of 0.005 μm (50Å) to 2 μm, and the amount of the halogen atoms (X) is varied in the range of 0.1 atomic ppm to 35 atomic % in terms of the ratio to the amount of the total constituent atoms thereof.

The constituent two layers of the two-layered nc-Si light receiving layer of each light receiving member were continuously formed without suspending the discharge under the conditions shown in Table 16, wherein the interface neighborhood region 1 was formed following the procedures of forming the photoconductive layer except for additionally using $SiF_4$ gas at a given flow rate in the range of 0 to 400 sccm and changing each of the inner pressure and bias voltage to a given value in the corresponding range of Table 16, and the interface neighborhood region 2 was formed following the procedures of forming the surface layer except for additionally using $SiF_4$ gas at a given flow rate in the range of 0 to 400 sccm and changing each of the inner pressure and bias voltage to a given value in the corresponding range of Table 16.

(2) In accordance with the film-forming manner using the microwave plasma CVD apparatus shown in FIGS. 12(A) and 12(B) and under the conditions shown in 17, there were prepared various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge transportation layer and a charge generation layer being stacked in this order on the substrate, and said two-layered light receiving layer having a different layer interface neighborhood region in terms of the content of halogen atoms (X) and also in terms of the thickness at the interface between said charge transportation layer and said charge generation layer.

Said layer interface neighborhood region in each case comprises a interface neighborhood region 1 situated on the charge transportation layer side and another interface neighborhood region 2 situated on the charge generation layer side, wherein the sum of the thicknesses of these two layer interface regions is designed to be of a given value in the range of 0.005 μm (50Å) to 2 μm, and the amount of the halogen atoms (X) is varied in the range of 0.1 atomic ppm to 35 atomic % in terms of the ratio to the total constituent atoms thereof.

The constituent two layers of the two-layered nc-Si light receiving layer of each light receiving member were continuously formed without suspending the discharge under the conditions shown in Table 17, wherein the interface neighborhood region 1 was formed following the procedures of forming the charge transportation layer except for additionally using $SiF_4$ gas at a given flow rate in the range of 0 to 400 sccm and changing each of the inner pressure and bias voltage to a given value in the corresponding range of Table 17, and the interface neighborhood region 2 was formed following the procedures of forming the charge generation layer except for additionally using $SiF_4$ gas at a given flow rate in the range of 0 to 400 sccm and changing each of the inner pressure and bias voltage to a given value in the corresponding range of Table 17.

Each of the light receiving members obtained in the above (1) and (2) was evaluated with respect to photocarrier mobility in relation to the halogen content of the layer interface neighborhood region in the same manner as in Example 21. As a result, it was found that the evaluated results are substantially the same as those obtained in Example 21.

Example 23

(1) The procedures of Example 21 were repeated, except that the thickness of the charge injection inhibition layer or/and the thickness of the photoconductive layer were thinned to be in the range of 1 to 2 μm, to thereby obtain various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate, and said two-layered light receiving layer having a different layer interface neighborhood region in terms of the content of halogen atoms (X) and also in terms of the thickness at the interface between said charge injection inhibition layer and said photoconductive layer.

(2) The procedures of Example 22-(1) were repeated, except that the thickness of the photoconductive layer or/and the thickness of the surface layer were thinned to be in the range of 1 to 2 μm, to thereby obtain various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate, and said two-layered light receiving layer having a different layer interface neighborhood region in terms of the content of halogen atoms (X) and also in terms of the thickness at the interface between said photoconductive layer and said surface layer.

(2) The procedures of Example 22-(2) were repeated, except that the thickness of the charge transportation layer or/and the thickness of the charge generation layer were thinned to be in the range of 1 to 2 μm, to thereby obtain various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge transportation layer and a charge generation layer being stacked in this order on the substrate, and said two-layered light receiving layer having a different layer interface neighborhood region in terms of the content of halogen atoms (X) and also in terms of the thickness at the interface between said charge transportation layer and said charge generation layer.

Each of the light receiving members obtained in the above (1), (2) and (3) was evaluated with respect to photocarrier mobility in relation to the halogen content of the layer interface neighborhood region in the same manner as in Example 21.

As a result, there were obtained the following findings. That is, in the case where the thickness of the bulk layer region of any of the adjacent constituent layers is relatively thin (that is, 1 to 2 μm thick), when the layer interface neighborhood region containing the halogen atoms (X) at an enhanced concentration distribution is of a thickness corresponding to 30% or less of the thickness of the bulk layer region which is relatively thinner, the resulting light receiving member exhibits a significantly improved photocarrier mobility.

The present inventor made studies of this situation. As a result, it was found that the above effects are not provided in the case where the layer involved does not exhibit photoconductivity. The reason for this is considered that for instance, in the case where a insulating layer substantially having no photoconductivity is involved, the layer does not become to exhibit photoconductivity by the incorporation of halogen atoms thereinto.

Examples 24 to 28 and Comparative Examples 9 to 13

Example 24

The procedures of preparing the light receiving member of the light receiving member sample B8-e (see, Table 14) in Example 21 were repeated wherein the formation of each of the charge injection inhibition layer and photoconductive layer was carried out under the conditions shown in Table 18, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate, and said two-layered light receiving layer having a 5000Å thick layer interface neighborhood region containing halogen atoms (X) at an enhanced concentration distribution of 1 atomic % in terms of the ratio of the amount of the halogen atoms (X) to that of the total constituent atoms at the interface between said charge injection inhibition layer and said photoconductive layer.

Example 25

The procedures of Example 24 were repeated, except that the conditions shown in Table 18 was replaced by the conditions shown in Table 20, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate, and said two-layered light receiving layer having a 5000Å thick layer interface neighborhood region containing halogen atoms (X) at an enhanced concentration distribution of 1 atomic % in terms of the ratio of the amount of the halogen atoms (X) to that of the total constituent atoms at the interface between said photoconductive layer and said surface layer.

Example 26

The procedures of Example 24 were repeated, except that the conditions shown in Table 18 was replaced by the conditions shown in Table 21, to thereby obtain six light receiving member samples each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate, and said three-layered light receiving layer having a 5000Å thick layer interface neighborhood region containing halogen atoms (X) at an enhanced concentration distribution of 1 atomic % in terms of the ratio of the amount of the halogen atoms (X) to that of the total constituent atoms at the interface between said charge injection inhibition layer and said photoconductive layer.

Example 27

The procedures of Example 24 were repeated, except that the conditions shown in Table 18 was replaced by the conditions shown in Table 22, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising an IR absorption layer, a charge injection inhibition layer, a photoconductive layer and a surface layer being stacked in this order on the substrate, and said four-layered light receiving layer having a 5000Å thick layer interface neighborhood region containing halogen atoms (X) at an enhanced concentration distribution of 1 atomic % in terms of the ratio of the amount of the halogen atoms (X) to that of the total constituent atoms at the interface between said charge injection inhibition layer and said photoconductive layer.

Example 28

The procedures of Example 24 were repeated, except that the conditions shown in Table 18 was replaced by the conditions shown in Table 23, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer, a charge generation layer and a surface layer being stacked in this order on the substrate, and said four-layered light receiving layer having a 5000Å thick layer interface neighborhood region containing halogen atoms (X) at an enhanced concentration distribution of 1 atomic % in terms of the ratio of the amount of the halogen atoms (X) to that of the total constituent atoms at the interface between said charge transportation layer and said charge generation layer.

Comparative Example 9

The procedures of Example 24 were repeated, except that no layer interface layer region was formed, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate.

Comparative Example 10

The procedures of Example 25 were repeated, except that no layer interface layer region was formed, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate.

Comparative Example 11

The procedures of Example 26 were repeated, except that no layer interface layer region was formed, to thereby obtain six light receiving member samples each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate.

Comparative Example 12

The procedures of Example 27 were repeated, except that no layer interface layer region was formed, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising an IR absorption layer, a charge injection inhibition layer, a photoconductive layer and a surface layer being stacked in this order on the substrate.

Comparative Example 13

The procedures of Example 28 were repeated, except that no layer interface layer region was formed, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer, a charge generation layer and a surface layer being stacked in this order on the substrate.

Evaluation

As for the light receiving member samples obtained in Examples 24 to 28 and Comparative Examples 9 to 13, evaluation was made with respect to electrophotographic characteristics including photosensitivity, charge retentivity, residual potential and halftone reproduction, respectively in the foregoing corresponding evaluation manner, wherein the evaluation as for each of these evaluation items was conducted at the stage after 500,000 times repeated shots in the case where the image-forming process was conducted at ordinary process speed and also in the case where the image-forming process was conducted at a process speed which is higher as much as 1.2 holds over the ordinary process speed.

The evaluated results are collectively shown in Table 19. From the results shown in Table 19, it is understood that any of the light receiving members obtained in Examples 24 to 28 belonging to the present invention is apparently surpassing the light receiving members obtained in Comparative Examples 9 to 13 in terms of the electrophotographic characteristics required for conducting the electrophotographic image-forming process at an increased, high speed.

Example 29

The procedures of each of the foregoing Examples 24 to 28 were repeated, except that each adjacent bulk layer region situated opposite the layer interface neighborhood region was designed to contain halogen atoms (X) such that the content of the halogen atoms (X) of said each adjacent bulk layer region was smaller than that of the layer interface neighborhood region, to thereby a plurality of light receiving member samples in each case.

The light receiving member samples obtained were evaluated in the same evaluation manner as in Example 24. A a result, satisfactory results were obtained as well as in Examples 24 to 28.

Example 30

The procedures of each of the foregoing Examples 24 to 28 were repeated, except that each adjacent bulk layer region situated opposite the layer interface neighborhood region was designed to contain halogen atoms (X) such that the content of the halogen atoms (X) of said each adjacent bulk layer region was smaller than that of the layer interface neighborhood region wherein the neighborhood region of the free surface of the outermost layer was designed to contain halogen atoms (X) at an enhanced concentration distribution, to thereby a plurality of light receiving member samples in each case.

The light receiving member samples obtained were evaluated in the same evaluation manner as in Example 24. A a result, satisfactory results were obtained as well as in Examples 24 to 28.

Example 31

The procedures of each of the foregoing Examples 24 to 28 were repeated, except that the layer interface neighborhood region was designed to be of the same configuration of the layer interface neighborhood region of the light receiving member sample B1-a, B1-b, B1-c, B1-d, or B1-g (see, Table 14) wherein the layer interface neighborhood region was made to be of a thickness in the range of 50Å to 2 μm and have a halogen concentration of 0.1 atomic ppm to 35 atomic % in terms of the ratio of the amount of the halogen atoms (X) to that of the total constituent atoms, to thereby a plurality of light receiving member samples in each case.

The light receiving member samples obtained were evaluated in the same evaluation manner as in Example 24. As a result, it was found that any of the light receiving member samples in which the layer interface neighborhood region is of a thickness in the range of 100Å to 1 μm and has a halogen concentration of 0.5 atomic ppm to 30 atomic % in terms of the ratio of the content of the halogen atoms (X) to that of the total constituent atoms excels in the electrophotographic characteristics required especially in the case of conducting the image-forming process at an improved, high speed.

Separately, in each of the above cases, the neighborhood region of the free surface of the outermost layer was designed to contain halogen atoms (X) at an enhanced concentration distribution, to thereby a plurality of light receiving member samples in each case.

The light receiving member samples obtained were evaluated in the same evaluation manner as in Example 24. A a result, satisfactory results were obtained in terms of the electrophotographic characteristics. In any of the light receiving members, it was found that there is not any particular upper limit for the halogen content in the neighborhood region of the free surface of the outermost layer was designed to contain halogen atoms (X).

Example 32

The procedures of each of the foregoing Examples 26 to 30 were repeated, except that the layer interface neighborhood region was designed such that it contained hydrogen atoms (H) at an enhanced concentration distribution in a pattern equivalent to any of the concentration distribution patterns shown in FIGS. 4 to 11, to thereby obtain a plurality of light receiving member samples in each case.

The light receiving member samples obtained were evaluated in the same manner as in Example 24. As a result, satisfactory results were obtained in terms of the electrophotographic characteristics required especially in the case of conducting the image-forming process at an improved, high speed.

Example 33

The procedures of each of Examples 26 to 32 were conducted in accordance with the foregoing layer-forming manner using the RF CVD apparatus shown in FIG. 14, to thereby obtain a plurality of light receiving member samples in each case.

The light receiving member samples obtained were evaluated in the same manner as in Example 24. As a result, satisfactory results were obtained in terms of the electrophotographic characteristics required especially in the case of conducting the image-forming process at an improved, high speed.

Example 34

In accordance with the film-forming manner using the microwave plasma CVD apparatus shown in FIGS. 12(A) and 12(B) and under the conditions shown in Table 13, there were prepared various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate and said two-layered light receiving layer having a different layer interface neighborhood region in terms of the content of each hydrogen atoms (H) and halogen atoms (X) and also in terms of the thickness at the interface between said charge injection inhibition layer and said photoconductive layer.

Said layer interface neighborhood region in each case comprises a interface neighborhood region 1 situated on the charge injection inhibition layer side and another interface neighborhood region 2 situated on the photoconductive layer side.

The constituent two layers of the two-layered nc-Si light receiving layer of each light receiving member were continuously formed without suspending the discharge under the conditions shown in Table 24, wherein the interface neighborhood region 1 was formed following the procedures of forming the charge injection inhibition layer except for additionally using $H_2$ gas at a given flow rate in the range of 0 to 1 slm and $SiF_4$ gas at a given flow rate in the range of 0 to 400 sccm and changing each of the inner pressure and bias voltage to a given value in the corresponding range of Table 24, and the interface neighborhood region 2 was formed following the procedures of forming the photoconductive layer except for additionally using $H_2$ gas at a given flow rate in the range of 0 to 1 slm and $SiF_4$ gas at a given flow rate in the range of 0 to 400 sccm and changing each of the inner pressure and bias voltage to a given value in the corresponding range of Table 24.

As for each kind light receiving member, there were prepared six electrophotographic light receiving member samples. In each case, of the six light receiving member samples, one was randomly chosen and subjected to the following evaluations.

That is, as for each light receiving member sample, it was cut in the layer thickness direction to obtain a plurality of specimens for evaluation. One of these specimens was subjected to analysis of the hydrogen content and the halogen content in the layer interface neighborhood region by means of the SIMS.

As a result, it was found that the resultant light receiving member samples have respectively such a layer interface neighborhood region that the sum of the thicknesses of these two layer interface neighborhood regions containing the halogen atoms (X) (specifically, fluorine atoms) is of a value in the range of 0.005 μm (50 Å) to 2 μm and the ratio of the content of the halogen atoms (X) to that of the total constituent atoms is in the range of 0.1 atomic ppm to 35 atomic ppm and that the sum of the thicknesses of the two layer interface neighborhood regions containing the hydrogen atoms (H) is of a value in the range of 50 to 8000Å and the hydrogen content thereof is a value of as much as 1.2 to 2.2 times over that of the adjacent bulk layer region which is relatively greater in terms of the hydrogen content (specifically, the bulk layer region of the charge injection inhibition layer).

Separately, one of the remaining light receiving member specimens obtained in the above as for each light receiving member sample was subjected to evaluation with respect to photocarrier mobility (μ) in accordance with the foregoing photocarrier mobility measuring manner using the measuring system shown in FIG. 13.

The evaluated results are collectively shown in Tables 25 and 26 on the basis of the following criteria:

⊙: the case wherein the photocarrier mobility is excellent,

○: the case wherein the photocarrier mobility is good;

Δ: the case wherein the photocarrier mobility is not so good, and

X: the case wherein the photocarrier mobility is inferior but it is practically acceptable.

From the results shown in Tables 25 and 26, it is understood that any of the light receiving member samples having a layer interface neighborhood region including (i) a 100 to 5000Å thick region containing the hydrogen atoms (H) at an enhanced concentration distribution which is greater as much as 1.1 to 2.0 times over the hydrogen content of the adjacent bulk layer region which is relatively greater in terms of the hydrogen content (specifically, the bulk layer region of the charge injection inhibition layer) and (ii) a 0.01 μm (100Å) to 1 μm thick region containing the halogen atoms (X) (that is, the fluorine atoms) at an enhance concentration distribution of 0.5 atomic ppm to 30 atomic % in terms of the ratio of the amount of the halogen atoms (X) to the amount of the total constituent atoms markedly excels especially in photocarrier mobility, and thus, these light receiving member samples may be desirably used as an image-forming member in electrophotography.

Example 35

(1) In accordance with the film-forming manner using the microwave plasma CVD apparatus shown in FIGS. 12(A)

and 12(B) and under the conditions shown in 27, there were prepared various kinds of light receiving members each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate, and said three-layered light receiving layer having a different layer interface neighborhood region in terms of the content of each of hydrogen atoms (H) and halogen atoms (X) and also in terms of the thickness at the interface between said photoconductive layer and said surface layer.

Said layer interface neighborhood region in each case comprises a interface neighborhood region 1 situated on the photoconductive layer side and another interface neighborhood region 2 situated on the surface layer side.

The constituent three layers of the three-layered nc-Si light receiving layer of each light receiving member were continuously formed without suspending the discharge under the conditions shown in Table 27, wherein the interface neighborhood region 1 was formed following the procedures of forming the photoconductive layer except for additionally using $H_2$ gas at a given flow rate in the range of 0 to 1 slm and $SiF_4$ gas at a given flow rate in the range of 0 to 400 sccm and changing each of the inner pressure and bias voltage to a given value in the corresponding range of Table 27, and the interface neighborhood region 2 was formed following the procedures of forming the surface layer except for additionally using $H_2$ gas at a given flow rate in the range of 0 to 1 slm and $SiF_4$ gas at a given flow rate in the range of 0 to 400 sccm and changing each of the inner pressure and bias voltage to a given value in the corresponding range of Table 27.

(2) In accordance with the film-forming manner using the microwave plasma CVD apparatus shown in FIGS. 12(A) and 12(B) and under the conditions shown in 28, there were prepared various kinds of light receiving members each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a charge transportation layer and a charge generation layer being stacked in this order on the substrate, and said three-layered light receiving layer having a different layer interface neighborhood region in terms of the content of each of hydrogen atoms (H) and halogen atoms (X) and also in terms of the thickness at the interface between said charge transportation layer and said charge generation layer.

Said layer interface neighborhood region in each case comprises a interface neighborhood region 1 situated on the charge transportation layer side and another interface neighborhood region 2 situated on the charge generation layer side.

The constituent three layers of the three-layered nc-Si light receiving layer of each light receiving member were continuously formed without suspending the discharge under the conditions shown in Table 28, wherein the interface neighborhood region 1 was formed following the procedures of forming the charge transportation layer except for additionally using $H_2$ gas at a given flow rate in the range of 0 to 1 slm and $SiF_4$ gas at a given flow rate in the range of 0 to 400 sccm and changing each of the inner pressure and bias voltage to a given value in the corresponding range of Table 28, and the interface neighborhood region 2 was formed following the procedures of forming the charge generation layer except for additionally using $H_2$ gas at a given flow rate in the range of 0 to 1 slm and $SiF_4$ gas at a given flow rate in the range of 0 to 400 sccm and changing each of the inner pressure and bias voltage to a given value in the corresponding range of Table 28.

Each of the light receiving members obtained in the above (1) and (2) was evaluated with respect to photocarrier mobility in relation to the hydrogen content and the halogen content of the layer interface neighborhood region in the same manner as in Example 34. As a result, it was found that the evaluated results are substantially the same as those obtained in Example 34.

Example 36

(1) The procedures of Example 34 were repeated, except that the thickness of the charge injection inhibition layer or/and the thickness of the photoconductive layer were thinned to be in the range of 1 to 2 μm, to thereby obtain various kinds of light receiving members each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate, and said two-layered light receiving layer having a different layer interface neighborhood region in terms of the content of each of hydrogen atoms (H) and halogen atoms (X) and also in terms of the thickness at the interface between said charge injection inhibition layer and said photoconductive layer.

(2) The procedures of Example 35-(1) were repeated, except that the thickness of the photoconductive layer or/and the thickness of the surface layer were thinned to be in the range of 1 to 2 μm, to thereby obtain various kinds of light receiving members each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate, and said three-layered light receiving layer having a different layer interface neighborhood region in terms of the content of each of hydrogen atoms (H) and halogen atoms (X) and also in terms of the thickness at the interface between said photoconductive layer and said surface layer.

(3) The procedures of Example 35-(2) were repeated, except that the thickness of the charge transportation layer or/and the thickness of the charge generation layer were thinned to be in the range of 1 to 2 μm, to thereby obtain various kinds of light receiving members each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a charge transportation layer and a charge generation layer being stacked in this order on the substrate, and said three-layered light receiving layer having a different layer interface neighborhood region in terms of the content of each of hydrogen atoms (H) and halogen atoms (X) and also in terms of the thickness at the interface between said charge transportation layer and said charge generation layer.

Each of the light receiving members obtained in the above (1), (2) and (3) was evaluated with respect to photocarrier mobility in relation to the hydrogen content and the halogen content in the layer interface neighborhood region in the same manner as in Example 34.

As a result, there were obtained the following findings. That is, in the case where the thickness of the bulk layer region of any of the adjacent constituent layers is relatively thin (that is, 1 to 2 μm thick), when the layer interface neighborhood region containing the halogen atoms (X) at an enhanced concentration distribution is of a thickness corresponding to 30% or less of the thickness of the bulk layer region which is relatively thinner, the resulting light receiving member exhibits a significantly improved photocarrier mobility.

Example 37

The procedures of each of Examples 34 to 36 were repeated, except that a given amount of halogen atoms (fluorine atoms) was incorporated also into one or both of the adjacent bulk layer regions, to thereby obtain various kinds of light receiving member samples in each case. The resultant light receiving member samples were evaluated in the same evaluation manner as in Example 34. As a result, it was found that in the case where the content of the halogen atoms (X) of the layer interface neighborhood region is greater as much as 1.1 times or above over the halogen content of the adjacent bulk layer region which is relatively greater in terms of the hydrogen content, an improved photocarrier mobility is attained.

Example 38

The procedures of each of Examples 34 to 37 were repeated, except that the $SiF_4$ gas for the introduction of the halogen atoms (X) was replaced by one selected from $SiH_2Cl_2$ gas, $SiH_2Br_2$ gas and $SiH_2I_3$ gas, to thereby obtain various kinds of light receiving member samples in each case. The resultant light receiving member samples were evaluated in the same evaluation manner as in Example 34. As a result, satisfactory results were obtained as well as in said examples.

Examples 39 to 44 and Comparative Examples 14 to 19

Example 39

The procedures of preparing the light receiving member sample having a layer interface neighborhood region including a 3000Å thick hydrogen rich region and a 5000Å thick halogen rich region (see, Table 26) which provided excellent evaluation results in Example 34 were repeated wherein the formation of each of the charge injection inhibition layer and photoconductive layer was carried out under the conditions shown in Table 29, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate, and said two-layered light receiving layer having a layer interface neighborhood region between said charge injection inhibition layer and said photoconductive layer, including (i) a 3000Å thick region containing hydrogen atoms (H) at an enhanced concentration distribution which is greater as much as 1.5 times over the hydrogen content of the adjacent bulk layer region which is relatively greater in terms of the hydrogen content (specifically, the bulk layer region of the charge injection inhibition layer) and (ii) a 5000Å thick region containing halogen atoms (X) (that is, fluorine atoms) at an enhanced concentration distribution of 1 atomic % in terms of the ratio of the content of the halogen atoms (X) to the amount of the total constituent atoms.

Evaluation

As for the light receiving member samples obtained in the above, evaluation was made with respect to electrophotographic characteristics including (i) photosensitivity, (ii) charge retentivity, (iii) residual potential, (iv) appearance of faint image, (v) appearance of white spots, (vi) appearance of smeared image, (vii) appearance of ghost, and (viii) halftone reproduction, respectively. The evaluation of each of these evaluation items (i) to (viii) was conducted using the foregoing electrophotographic copying machine, modified for experimental purposes, wherein the evaluation was conducted at the stage after 500,000 times repeated shots in the case where the image-forming process was conducted at ordinary process speed and also in the case where the image-forming process was conducted at a process speed which is higher as much as 1.2 holds over the ordinary process speed.

The evaluation of each of the evaluation items (i), (ii), (iii) and (viii) was conducted in the foregoing corresponding evaluation manner. The evaluation of each of the remaining evaluation items (iv) to (vii) was conducted in a evaluation manner as will be described below.

The evaluated results obtained are collectively shown in Table 30.

Evaluation of the appearance of faint image

The light receiving member sample is set to the above electrophotoelectric copying machine, wherein the light receiving member sample is subjected to charging so as to provide a given surface potential in dark therefor, then the value of an electric current flown to the charger is so adjusted that the surface potential of the light receiving member sample becomes to be 400 V at the position of the developing mechanism, and thereafter, the reproduction of an original containing a number of minute lines is conducted while irradiating light from a halogen lamp at an intensity of about 21 lux sec to obtain a copied image. The copied image obtained is examined of whether or not it contains a faint image. This evaluation is conducted as for the copied image obtained at the initial stage and the copied image obtained at the stage after 500,000 times repeated shots. Since the light receiving member sample comprises six samples, this evaluation conducted for all of them. An one which is worst in terms of the appearance of faint image is dedicated for the observation on the following criteria:

⊙: the case wherein the copied image is excellent in quality,

○: the case wherein the copied image is good in quality,

Δ: the case wherein the copied image is not so good in quality but is practically acceptable, and X: the case wherein the copied image is inferior in quality but is practically acceptable.

Evaluation of the appearance of white spots (v)

The light receiving member sample is set to the above electrophotographic copying machine, wherein using a whole black test chart FY9-9073 (produced by CANON Kabushiki Kaisha) as an original, the image-forming process is continuously repeated 500,000 times. The copied image obtained at the initial stage and that obtained after 500,000 repeated shots are examined of whether or not they contain white spots. Since the light receiving member sample comprises six samples, this evaluation conducted for all of them. An one which is worst in terms of the appearance of white spot is dedicated for the observation on the following criteria:

⊙: the case wherein the copied image is excellent in quality,

○: the case wherein the copied image is good in quality,

Δ: the case wherein the copied image is not so good in quality but is practically acceptable, and X: the case wherein the copied image is inferior in quality but is practically acceptable.

Evaluation of the appearance of smeared image (vi)

The light receiving member sample is set to the above electrophotographic copying machine, wherein using a test chart FY9-9058 (produced by CANON Kabushiki Kaisha) as an original, the image-forming process is continuously repeated 500,000 times. The copied image obtained at the initial stage and that obtained after 500,000 repeated shots are examined of whether or not they contain smeared image. Since the light receiving member sample comprises six samples, this evaluation conducted for all of them. An one which is worst in terms of the appearance of smeared image is dedicated for the observation on the following criteria:

⊙: the case wherein the copied image is excellent in quality,

○: the case wherein the copied image is good in quality,

Δ: the case wherein the copied image is not so good in quality but is practically acceptable, and X: the case wherein the copied image is inferior in quality but is practically acceptable.

Evaluation of the appearance of ghost

The light receiving member sample is set to the above electrophotographic copying machine, wherein using an original comprising a test chart FY9-9040 (produced by CANON Kabushiki Kaisha) and a plurality of black circles of 1.1 in reflection density and 5 mm in diameter being spacedly arranged at given positions of the surface of said chart, the image-forming process is continuously repeated 500,000 times. The copied image obtained at the initial stage and that obtained after 500,000 repeated shots are examined of whether or not they contain a ghost image based on the black circle of the original, wherein in the case where such ghost image is appeared, the difference between the reflection density of the reproduced halftone image and that of the ghost image is examined. Since the light receiving member sample comprises six samples, this evaluation conducted for all of them. An one which is worst in terms of the appearance of ghost is dedicated for the observation on the following criteria:

⊙: the case wherein the copied image is excellent in quality,

○: the case wherein the copied image is good in quality,

Δ: the case wherein the copied image is not so good in quality but is practically acceptable, and X: the case wherein the copied image is inferior in quality but is practically acceptable.

Example 40

The procedures of Example 39 were repeated, except that the conditions shown in Table 29 was replaced by the conditions shown in Table 31, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate, and said two-layered light receiving layer having a layer interface neighborhood region between said photoconductive layer and said surface layer, including (i) a 3000Å thick region containing hydrogen atoms (H) at an enhanced concentration distribution which is greater as much as 1.5 times over the hydrogen content of the adjacent bulk layer region which is relatively greater in terms of the hydrogen content (specifically, the bulk layer region of the surface layer) and (ii) a 5000Å thick region containing halogen atoms (X) (that is, fluorine atoms) at an enhanced concentration distribution of 1 atomic % in terms of the ratio of the content of the halogen atoms (X) to the amount of the total constituent atoms.

The light receiving member samples obtained in the above were evaluated in the same manner as in Example 39.

The evaluated results obtained are collectively shown in Table 30.

Example 41

The procedures of Example 39 were repeated, except that the conditions shown in Table 29 was replaced by the conditions shown in Table 32, to thereby obtain six light receiving member samples each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate, and said three-layered light receiving layer having a layer interface neighborhood region between said charge injection inhibition layer and said photoconductive layer, including (i) a 3000Å thick region containing hydrogen atoms (H) at an enhanced concentration distribution which is greater as much as 1.5 times over the hydrogen content of the adjacent bulk layer region which is relatively greater in terms of the hydrogen content (specifically, the bulk layer region of the charge injection inhibition layer) and (ii) a 5000Å thick region containing halogen atoms (X) (that is, fluorine atoms) at an enhanced concentration distribution of 1 atomic % in terms of the ratio of the content of the halogen atoms (X) to the amount of the total constituent atoms.

The light receiving member samples obtained in the above were evaluated in the same manner as in Example 39.

The evaluated results obtained are collectively shown in Table 30.

Example 42

The procedures of Example 39 were repeated, except that the conditions shown in Table 29 was replaced by the conditions shown in Table 33, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising an IR absorption layer, a charge injection inhibition layer, a photoconductive layer and a surface layer being stacked in this order on the substrate, and said four-layered light receiving layer having a layer interface neighborhood region between said charge injection inhibition layer and said photoconductive layer, including (i) a 3000Å thick region containing hydrogen atoms (H) at an enhanced concentration distribution which is greater as much as 1.5 holds over the hydrogen content of the adjacent bulk layer region which is relatively greater in terms of the hydrogen content (specifically, the bulk layer region of the charge injection inhibition layer) and (ii) a 5000Å thick region containing halogen atoms (X) (that is, fluorine atoms) at an enhanced concentration distribution of 1 atomic % in terms of the ratio of the content of the halogen atoms (X) to the amount of the total constituent atoms.

The light receiving member samples obtained in the above were evaluated in the same manner as in Example 39.

The evaluated results obtained are collectively shown in Table 30.

Example 43

The procedures of Example 39 were repeated, except that the conditions shown in Table 29 was replaced by the conditions shown in Table 34, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer, a charge generation layer and a surface layer being stacked in this order on the substrate, and said four-layered light receiving layer having a layer interface neighborhood region between said charge transportation layer and said charge generation layer, including (i) a 3000Å thick region containing hydrogen atoms (H) at an enhanced concentration distribution which is greater as much as 1.5 times over the hydrogen content of the adjacent bulk layer region which is relatively greater in terms of the hydrogen content (specifically, the bulk layer region of the charge transportation layer) and (ii) a 5000Å thick region containing halogen atoms (X) (that is, fluorine atoms) at an enhanced concentration distribution of 1 atomic % in terms of the ratio of the content of the halogen atoms (X) to the amount of the total constituent atoms.

The light receiving member samples obtained in the above were evaluated in the same manner as in Example 39.

The evaluated results obtained are collectively shown in Table 30.

Example 44

The procedures of Example 39 were repeated, except that the conditions shown in Table 29 was replaced by the conditions shown in Table 35, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate, and said two-layered light receiving layer having a layer interface neighborhood region between said photoconductive layer and said surface layer, including (i) a 3000Å thick region containing hydrogen atoms (H) at an enhanced concentration distribution which is greater as much as 1.5 times over the hydrogen content of the adjacent bulk layer region which is relatively greater in terms of the hydrogen content (specifically, the bulk layer region of the surface layer) and (ii) a 5000Å thick region containing halogen atoms (X) (that is, fluorine atoms) at an enhanced concentration distribution of 1 atomic % in terms of the ratio of the content of the halogen atoms (X) to the amount of the total constituent atoms.

The light receiving member samples obtained in the above were evaluated in the same manner as in Example 39.

The evaluated results obtained are collectively shown in Table 30.

Comparative Example 14

The procedures of Example 39 were repeated, except that no layer interface layer region was formed, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a charge injection inhibition layer and a photoconductive layer being stacked in this order on the substrate.

The light receiving member samples obtained in the above were evaluated in the same manner as in Example 39.

The evaluated results obtained are collectively shown in Table 30.

Comparative Example 15

The procedures of Example 40 were repeated, except that no layer interface layer region was formed, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate.

The light receiving member samples obtained in the above were evaluated in the same manner as in Example 39.

The evaluated results obtained are collectively shown in Table 30.

Comparative Example 16

The procedures of Example 41 were repeated, except that no layer interface layer region was formed, to thereby obtain six light receiving member samples each comprising a substrate comprising an aluminum cylinder having a mirror-ground surface and a three-layered non-single crystal silicon (nc-Si) light receiving layer disposed on said mirror-ground surface of the aluminum cylinder as the substrate, said three-layered nc-Si light receiving layer comprising a charge injection inhibition layer, a photoconductive layer and a surface layer being stacked in this order on the substrate.

The light receiving member samples obtained in the above were evaluated in the same manner as in Example 39.

The evaluated results obtained are collectively shown in Table 30.

Comparative Example 17

The procedures of Example 42 were repeated, except that no layer interface layer region was formed, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising an IR absorption layer, a charge injection inhibition layer, a photoconductive layer and a surface layer being stacked in this order on the substrate.

The light receiving member samples obtained in the above were evaluated in the same manner as in Example 39.

The evaluated results obtained are collectively shown in Table 30.

Comparative Example 18

The procedures of Example 43 were repeated, except that no layer interface layer region was formed, to thereby obtain six light receiving member samples each comprising a substrate comprising an aluminum cylinder having a mirror-ground surface and a four-layered non-single crystal silicon (nc-Si) light receiving layer disposed on said mirror-ground surface of the aluminum cylinder as the substrate, said four-layered nc-Si light receiving layer comprising a charge injection inhibition layer, a charge transportation layer, a charge generation layer and a surface layer being stacked in this order on the substrate.

The light receiving member samples obtained in the above were evaluated in the same manner as in Example 39.

The evaluated results obtained are collectively shown in Table 30.

Comparative Example 19

The procedures of Example 44 were repeated, except that no layer interface layer region was formed, to thereby obtain six light receiving member samples each comprising a substrate comprising an aluminum cylinder having a mirror-ground surface and a two-layered non-single crystal silicon (nc-Si) light receiving layer disposed on said mirror-ground surface of the aluminum cylinder as the substrate, said two-layered nc-Si light receiving layer comprising a photoconductive layer and a surface layer being stacked in this order on the substrate.

The light receiving member samples obtained in the above were evaluated in the same manner as in Example 39.

The evaluated results obtained are collectively shown in Table 30.

From the results shown in Table 30, it is understood that any of the light receiving members obtained in Examples 39 to 44 belonging to the present invention is apparently surpassing the light receiving members obtained in Comparative Examples 14 to 19 in terms of the electrophotographic characteristics required for conducting the electrophotographic image-forming process at an increased, high speed.

Example 45

The procedures of each of the foregoing Examples 39 to 43 were repeated, except that a layer interface neighborhood region containing both hydrogen atoms and halogen atoms respectively at an enhanced concentration distribution was formed in the vicinity of the interface between the substrate and the multi-layered nc-Si light receiving layer, to thereby obtain a plurality of light receiving member samples in each case.

The light receiving member samples obtained were evaluated in the same evaluation manner as in Example 39. As a result, satisfactory results were obtained as well as in Examples 39 to 43.

Example 46

The procedures of Examples 39 were repeated, except that the layer interface neighborhood region was designed to be of the same configuration of the layer interface neighborhood region of each of the light receiving member samples which provided excellent or good evaluation results in Example 34, to thereby various light receiving member samples of the same layer constitution as in Example 39.

The light receiving member samples obtained were evaluated in the same evaluation manner as in Example 39.

As a result, it was found that any of the light receiving member samples in which the layer interface neighborhood region includes (i) a 100 to 5000Å thick region containing hydrogen atoms (H) at an enhanced concentration distribution which is greater as much as 1.1 to 2.0 times over the hydrogen content of the adjacent bulk layer region which is relatively greater in terms of the hydrogen content (specifically, the bulk layer region of the charge injection inhibition layer) and (ii) a 100Å to 1 μm thick region containing halogen atoms (X) (that is, fluorine atoms) at an enhanced concentration distribution of 0.5 atomic ppm to 30 atomic % in terms of the ratio of the content of the halogen atoms (X) to the amount of the total constituent atoms excels in the electrophotographic characteristics required especially in the case of conducting the image-forming process at an improved, high speed.

Example 47

The procedures of Examples 43 were repeated, except that an additional layer interface neighborhood region was established between the charge injection inhibition layer and the charge transportation layer, said additional layer interface neighborhood region including (i) a 3000Å thick region containing hydrogen atoms (H) at an enhanced concentration distribution which is greater as much as 1.5 times over the hydrogen content of the adjacent bulk layer region which is relatively greater in terms of the hydrogen content (specifically, the bulk layer region of the charge transportation layer) and (ii) a 5000Å thick region containing halogen atoms (X) (that is, fluorine atoms) at an enhanced concentration distribution of 1 atomic % in terms of the ratio of the content of the halogen atoms (X) to the amount of the total constituent atoms, to thereby obtain a plurality of light receiving member samples.

The light receiving member samples obtained were evaluated in the same manner as in Example 39. As a result, satisfactory results were obtained in terms of the electrophotographic characteristics required especially in the case of conducting the image-forming process at an improved, high speed.

Example 48

The procedures of each of Examples 39 to 47 were repeated, except that the $SiF_4$ gas for the introduction of the halogen atoms (X) was replaced by one selected from $SiH_2Cl_2$ gas, $SiH_2Br_2$ gas and $SiH_2I_2$ gas, to thereby obtain various kinds of light receiving member samples.

The light receiving member samples obtained were evaluated in the same manner as in Example 39. As a result, satisfactory results were obtained in terms of the electrophotographic characteristics required especially in the case of conducting the image-forming process at an improved, high speed.

Example 49

The procedures of each of Examples 39 to 48 were conducted in accordance with the foregoing layer-forming manner using the RF CVD apparatus shown in FIG. 14, to thereby obtain various kinds of light receiving member samples in each case.

The light receiving member samples obtained were evaluated in the same manner as in Example 39. As a result, satisfactory results were obtained in terms of the electrophotographic characteristics required especially in the case of conducting the image-forming process at an improved, high speed.

TABLE 3

| | A1 | A2 | A3 | A4 | A5 | A6 | A7 |
|---|---|---|---|---|---|---|---|
| a | Δ | Δ | Δ | Δ | X | X | X |
| b | Δ | ○ | ○ | ○ | ○ | ○ | X |
| c | Δ | ○ | ◎ | ◎ | ◎ | ○ | X |
| d | Δ | ○ | ◎ | ◎ | ◎ | ○ | X |
| e | Δ | ○ | ◎ | ◎ | ◎ | ○ | X |
| f | Δ | ○ | ○ | ○ | ○ | ○ | X |
| g | Δ | Δ | Δ | Δ | X | X | X |

TABLE 1

| layer constitution | gas used and its flow rate (sccm) | inner pressure (mTorr) | microwave power applied (W) | bias voltage applied (V) | layer thickness (μm) |
|---|---|---|---|---|---|
| charge injection inhibition layer | $SiH_4$ 400<br>He 200<br>$SiF_4$ 10<br>$B_2H_6$ 2000 ppm | 15 | 700 | 100 | 3 |
| layer interface neighborhood region 1 | $SiH_4$ 400<br>He 200<br>$SiF_4$ 10<br>$B_2H_6$ 2000 ppm<br>$H_2$ 0~1 slm | 15~20 | 700 | 30~120 | 0.005~0.8 |
| layer interface neighborhood region 2 | $SiH_4$ 250<br>He 2500<br>$SiF_4$ 5<br>$B_2H_6$ 0.5 ppm<br>$H_2$ 0~1 slm | 15~20 | 750 | 30~120 | |
| photo-conductive layer | $SiH_4$ 250<br>He 2500<br>$SiF_4$ 5<br>$B_2H_6$ 0.5 ppm | 18 | 750 | 50 | 25 |
| surface layer | $SiH_4$ 80<br>$CH_4$ 500<br>He 150 | 15 | 750 | 70 | 0.5 |

TABLE 2

| | A1 | A2 | A3 | A4 | A5 | A6 | A7 |
|---|---|---|---|---|---|---|---|
| a | 1.0 | 1.1 | 1.3 | 1.5 | 1.8 | 2.0 | 2.2 |
| | 50 | 50 | 50 | 50 | 50 | 50 | 50 |
| b | 1.0 | 1.1 | 1.3 | 1.5 | 1.8 | 2.0 | 2.2 |
| | 100 | 100 | 100 | 100 | 100 | 100 | 100 |
| c | 1.0 | 1.1 | 1.3 | 1.5 | 1.8 | 2.0 | 2.2 |
| | 500 | 500 | 500 | 500 | 500 | 500 | 500 |
| d | 1.0 | 1.1 | 1.3 | 1.5 | 1.8 | 2.0 | 2.2 |
| | 1000 | 1000 | 1000 | 1000 | 1000 | 1000 | 1000 |
| e | 1.0 | 1.1 | 1.3 | 1.5 | 1.8 | 2.0 | 2.2 |
| | 3000 | 3000 | 3000 | 3000 | 3000 | 3000 | 3000 |
| f | 1.0 | 1.1 | 1.3 | 1.5 | 1.8 | 2.0 | 2.2 |
| | 5000 | 5000 | 5000 | 5000 | 5000 | 5000 | 5000 |
| g | 1.0 | 1.1 | 1.3 | 1.5 | 1.8 | 2.0 | 2.2 |
| | 8000 | 8000 | 8000 | 8000 | 8000 | 8000 | 8000 |

Note)
upper value: the relative value in terms of the hydrogen content
lower value: the thickness of the layer interface neighborhood region

TABLE 4

| layer constitution | gas used and its flow rate (sccm) | inner pressure (mTorr) | microwave power applied (W) | bias voltage applied (V) | layer thickness (μm) |
|---|---|---|---|---|---|
| photo-conductive layer | $SiH_4$ 250<br>He 2000<br>$SiF_4$ 0<br>$B_2H_6$ 0.5 ppm | 12 | 750 | 90 | 25 |
| layer interface neighborhood region 1 | $SiH_4$ 250<br>He 2000<br>$SiF_4$ 0<br>$B_2H_6$ 0.5 ppm<br>$H_2$ 0~1 slm | 12~18 | 750 | 30~120 | 0.005~0.8 |
| layer interface neighborhood region 2 | $SiH_4$ 100<br>$CH_4$ 450<br>He 200<br>$SiF_4$ 10<br>$H_2$ 0~1 slm | 12~18 | 730 | 30~120 | |
| surface layer | $SiH_4$ 100<br>$CH_4$ 450<br>He 200<br>$H_2$ 100<br>$SiF_4$ 10 | 12 | 730 | 90 | 0.5 |

TABLE 5

| layer constitution | gas used and its flow rate (sccm) | inner pressure (mTorr) | micro-wave power applied (W) | bias voltage applied (V) | layer thick-ness (μm) |
|---|---|---|---|---|---|
| charge transporta-tion layer | $SiH_4$ 350<br>$CH_4$ 30<br>He 2500<br>$B_2H_6$ 1.0 ppm<br>$H_2$ 150 | 18 | 750 | 50 | 20 |
| layer interface neighbor-hood region 1 | $SiH_4$ 350<br>$CH_4$ 30<br>He 2500<br>$B_2H_6$ 1.0 ppm<br>$H_2$ 0~1 slm | 15~20 | 700 | 30~120 | 3000 Å |

TABLE 5-continued

| layer constitution | gas used and its flow rate (sccm) | inner pressure (mTorr) | micro-wave power applied (W) | bias voltage applied (V) | layer thick-ness (μm) |
|---|---|---|---|---|---|
| layer interface neighbor-hood region 2 | $SiH_4$ 250<br>He 2000<br>$B_2H_6$ 0.5 ppm<br>$H_2$ 0~1 slm | 15~20 | 750 | 30~120 | |
| charge generation layer | $SiH_4$ 250<br>He 2000<br>$B_2H_6$ 0.5 ppm | 15 | 750 | 50 | 5 |

TABLE 6

| layer constitution | gas used and its flow rate (sccm) | inner pressure (mTorr) | microwave power applied (W) | bias voltage applied (V) | layer thickness (μm) |
|---|---|---|---|---|---|
| charge injection inhibition layer | $SiH_4$ 400<br>$C_2H_2$ 30<br>He 200<br>$SiF_4$ 10<br>$B_2H_6$ 1000 ppm | 12 | 700 | 100 | 3 |
| charge transporation layer | $SiH_4$ 250<br>$C_2H_2$ 20<br>He 2500<br>$B_2H_6$ 1.0 ppm<br>$H_2$ 150 | 15 | 720 | 70 | 20 |
| layer interface neighborhood region 1 | $SiH_4$ 250<br>$C_2H_2$ 20<br>He 2500<br>$B_2H_6$ 1.0 ppm<br>$H_2$ 0~1 slm | 15~18 | 720 | 0~120 | 0.005~0.8 |
| layer interface neighborhood region 2 | $SiH_4$ 250<br>He 2000<br>$B_2H_6$ 0.5 ppm<br>$H_2$ 0~1 slm | 12~18 | 750 | 0~120 | |
| charge generation layer | $SiH_4$ 250<br>He 2000<br>$B_2H_6$ 0.5 ppm | 12 | 750 | 90 | 5 |
| surface | $SiH_4$ 100 | 12 | 730 | 90 | 0.5 |

TABLE 6-continued

| layer constitution | gas used and its flow rate (sccm) | inner pressure (mTorr) | microwave power applied (W) | bias voltage applied (V) | layer thickness (μm) |
|---|---|---|---|---|---|
| layer | $C_2H_2$ 300<br>He 200<br>$SiF_4$ 10<br>$H_2$ 100 | | | | |

TABLE 7

| layer constitution | gas used and its flow rate (sccm) | inner pressure (mTorr) | microwave power applied (W) | bias voltage applied (V) | layer thickness (μm) |
|---|---|---|---|---|---|
| IR absorption layer | $SiH_4$ 300<br>$B_2H_6$ 2000 ppm<br>$GeH_4$ 100 | 15 | 700 | 100 | 0.5 |
| charge injection inhibition layer | $SiH_4$ 400<br>$CH_4$ 30<br>He 200<br>$B_2H_6$ 2000 ppm | 15 | 700 | 100 | 3 |
| layer interface neighborhood region 1 | $SiH_4$ 400<br>$CH_4$ 30<br>He 200<br>$B_2H_6$ 2000 ppm<br>$H_2$ 0~1 slm | 15~20 | 700 | 30~120 | 3000 Å |
| layer interface neighborhood region 2 | $SiH_4$ 250<br>He 2500<br>$B_2H_6$ 0.5 ppm<br>$H_2$ 0~1 slm | 15~20 | 750 | 30~120 | |
| photo-conductive layer | $SiH_4$ 250<br>He 2500<br>$B_2H_6$ 0.5 ppm | 18 | 750 | 50 | 25 |
| surface layer | $SiH_4$ 80<br>$C_2H_2$ 500<br>He 150 | 15 | 750 | 70 | 0.5 |

TABLE 8

| layer constitution | gas used and its flow rate (sccm) | inner pressure (mTorr) | microwave power applied (W) | bias voltage applied (V) | layer thickness (μm) |
|---|---|---|---|---|---|
| charge injection inhibition layer | $SiH_4$ 400<br>$CH_4$ 30<br>He 200<br>$B_2H_6$ 2000 ppm | 15 | 700 | 100 | 3 |
| layer interface neighborhood region 1 | $SiH_4$ 400<br>$CH_4$ 30<br>He 200<br>$B_2H_6$ 2000 ppm<br>$H_2$ 0~1 slm | 15~20 | 700 | 30~120 | 3000 Å |
| layer interfacz neighborhood region 2 | $SiH_4$ 350<br>$CH_4$ 30<br>He 200<br>$H_2$ 0~1 slm | 15~20 | 750 | 30~120 | |
| charge transportation layer | $SiH_4$ 350<br>$CH_4$ 30<br>He 2500<br>$H_2$ 100 | 18 | 750 | 50 | 20 |
| charge generation layer | $SiH_4$ 350<br>He 2500<br>$B_2H_6$ 0.5 ppm | 15 | 750 | 50 | 5 |
| surface layer | $SiH_4$ 80<br>$CH_4$ 500<br>He 150 | 15 | 750 | 70 | 0.5 |

TABLE 9

| | charge retentivity | | photosensitivity | | reproduction of minute lines | | appearance of white-fogging image | | appearance of uneven density (half-tone reproduction) | |
|---|---|---|---|---|---|---|---|---|---|---|
| | I | II | I | II | I | II | I | II | I | II |
| Example 11 | ◎ | ○ | ◎ | ◎ | ◎ | ○ | ◎ | ◎ | ◎ | ○ |
| Example 12 | ◎ | ◎ | ◎ | ◎ | ◎ | ◎ | ◎ | ◎ | ◎ | ◎ |
| Example 13 | ◎ | ◎ | ◎ | ◎ | ◎ | ◎ | ◎ | ◎ | ◎ | ◎ |
| Example 14 | ◎ | ◎ | ◎ | ◎ | ◎ | ◎ | ◎ | ◎ | ◎ | ◎ |
| Comparative Example 1 | ○ | X | Δ | X | Δ | X | ○ | Δ | Δ | X |
| Comparative Example 2 | ○ | X | ○ | X | ◎ | Δ | ◎ | Δ | ○ | X |
| Comparative Example 3 | ◎ | Δ | ○ | X | ◎ | ○ | ◎ | ○ | ○ | X |

Note)
I: initial stage
II: after 500,000 times repeated shots

TABLE 10

| | charge retentivity | | photosensitivity | | residual potential | | halftone reproduction | |
|---|---|---|---|---|---|---|---|---|
| | A | B | A | B | A | B | A | B |
| Example 11 | ◎ | ○ | ◎ | ○ | ◎ | ◎ | ◎ | ◎ |
| Example 12 | ◎ | ◎ | ◎ | ◎ | ◎ | ◎ | ◎ | ◎ |
| Example 13 | ◎ | ◎ | ◎ | ◎ | ◎ | ◎ | ◎ | ◎ |
| Example 14 | ◎ | ◎ | ◎ | ◎ | ◎ | ◎ | ◎ | ◎ |
| Example 15 | ◎ | ◎ | ◎ | ◎ | ◎ | ◎ | ◎ | ◎ |
| Comparative Example 1 | ◎ | Δ | ○ | X | ◎ | ○ | ◎ | ○ |
| Comparative Example 2 | ◎ | ○ | ◎ | Δ | ◎ | ○ | ○ | X |
| Comparative Example 3 | ◎ | ○ | ◎ | Δ | ○ | Δ | ◎ | ○ |
| Comparative Example 4 | ○ | X | Δ | X | Δ | X | ○ | Δ |
| Comparative Example 5 | ○ | X | ○ | X | ◎ | Δ | ◎ | Δ |

Note)
A: ordinary image-forming process speed
B: image-forming process speed as much as 1.2 times higher than the process speed A

TABLE 11

| layer constitution | gas used and its flow rate (sccm) | | inner pressure (mTorr) | microwave power applied (W) | bias voltage applied (V) | layer thickness (μm) |
|---|---|---|---|---|---|---|
| IR absorption layer | $SiH_4$ | 300 | 15 | 650 | 100 | 0.5 |
| | $B_2H_6$ | 2800 ppm | | | | |
| | $GeH_4$ | 120 | | | | |

TABLE 11-continued

| layer constitution | gas used and its flow rate (sccm) | | inner pressure (mTorr) | microwave power applied (W) | bias voltage applied (V) | layer thickness (μm) |
|---|---|---|---|---|---|---|
| charge injection inhibition layer | $SiH_4$ | 400 | 12 | 700 | 100 | 3 |
| | $C_2H_2$ | 25 | | | | |
| | He | 300 | | | | |
| | $SiF_4$ | 10 | | | | |
| | $B_2H_6$ | 2000 ppm | | | | |
| charge transportation layer | $SiH_4$ | 250 | 15 | 720 | 70 | 20 |
| | $C_2H_2$ | 20 | | | | |
| | He | 2500 | | | | |
| | $B_2H_6$ | 1.0 ppm | | | | |
| | $H_2$ | 150 | | | | |
| layer interface neighborhood region 1 | $SiH_4$ | 250 | 15~18 | 720 | 0~120 | 3000 Å |
| | $C_2H_2$ | 20 | | | | |
| | He | 2500 | | | | |
| | $B_2H_6$ | 1.0 ppm | | | | |
| | $H_2$ | 0~1 slm | | | | |
| layer interface neighborhood region 2 | $SiH_4$ | 250 | 12~18 | 750 | 0~120 | |
| | He | 2000 | | | | |
| | $B_2H_6$ | 0.5 ppm | | | | |
| | $H_2$ | 0~1 slm | | | | |
| charge generation layer | $SiH_4$ | 250 | 12 | 750 | 90 | 5 |
| | He | 2000 | | | | |
| | $B_2H_6$ | 0.5 ppm | | | | |
| surface layer | $SiH_4$ | 100 | 12 | 730 | 90 | 0.5 |
| | $C_2H_2$ | 450 | | | | |
| | He | 200 | | | | |
| | $SiF_4$ | 10 | | | | |

TABLE 12

| | charge retentivity | | photosensitivity | | residual potential | | photomemory | |
|---|---|---|---|---|---|---|---|---|
| | A | B | A | B | A | B | A | B |
| Example 16 | ◎ | ○ | ◎ | ○ | ◎ | ◎ | ◎ | ◎ |
| Example 17 | ◎ | ◎ | ◎ | ◎ | ◎ | ◎ | ◎ | ◎ |
| Example 18 | ◎ | ◎ | ◎ | ◎ | ◎ | ◎ | ◎ | ◎ |
| Comparative Example 6 | ○ | x | Δ | x | Δ | Δ | ○ | x |
| Comparative Example 7 | ◎ | x | ○ | x | ◎ | Δ | ◎ | x |
| Comparative Example 8 | ○ | x | ○ | x | ◎ | ○ | ◎ | Δ |

Note)
A: ordinary image-forming process speed
B: image-forming process speed as much as 1.2 times higher than the process speed A

TABLE 13

| film-forming conditions | layer constitution: charge injection inhibition layer | layer interface neighborhood region 1 | layer interface neighborhood region 2 | photo-conductive layer |
|---|---|---|---|---|
| flow rate of raw material gas | | | | |
| $SiH_4$ | 200 sccm | 200 sccm | 200 sccm | 200 sccm |
| $CH_4$ | 50 sccm | 50 sccm | 0 sccm | 0 sccm |
| He | 300 sccm | 300 sccm | 2000 sccm | 2000 sccm |
| $SiF_4$ | 0 sccm | 0~400 sccm | 0~400 sccm | 0 sccm |
| $B_2H_6$ | 1000 ppm | 1000 ppm | 0.5 ppm | 0.5 ppm |
| $H_2$ | 10 sccm | 10 sccm | 0 sccm | 0 sccm |
| inner pressure | 12 mTorr | 12~18 mTorr | 12~18 mTorr | 12 mTorr |
| microwave power applied | 600 W | 630 W | 650 W | 650 W |
| bias voltage applied | 100 V | 30~120 V | 30~120 V | 90 V |
| layer thickness | 3 μm | 0.005~2.0 μm | | 25 μm |

TABLE 14

| | B1 | B2 | B3 | B4 | B5 | B6 | B7 | B8 | B9 | B10 | B11 | B12 | B13 | B14 | B15 | B16 |
|---|---|---|---|---|---|---|---|---|---|---|---|---|---|---|---|---|
| a | 1E-5 | 3E-5 | 5E-5 | 1E-4 | 1E-3 | 0.01 | 0.1 | 1.0 | 3.0 | 5.0 | 10 | 15 | 20 | 25 | 30 | 35 |
| | 50 | 50 | 50 | 50 | 50 | 50 | 50 | 50 | 50 | 50 | 50 | 50 | 50 | 50 | 50 | 50 |
| b | 1E-5 | 3E-5 | 5E-5 | 1E-4 | 1E-3 | 0.01 | 0.1 | 1.0 | 3.0 | 5.0 | 10 | 15 | 20 | 25 | 30 | 35 |
| | 100 | 100 | 100 | 100 | 100 | 100 | 100 | 100 | 100 | 100 | 100 | 100 | 100 | 100 | 100 | 100 |
| c | 1E-5 | 3E-5 | 5E-5 | 1E-4 | 1E-3 | 0.01 | 0.1 | 1.0 | 3.0 | 5.0 | 10 | 15 | 20 | 25 | 30 | 35 |
| | 500 | 500 | 500 | 500 | 500 | 500 | 500 | 500 | 500 | 500 | 500 | 500 | 500 | 500 | 500 | 500 |
| d | 1E-5 | 3E-5 | 5E-5 | 1E-4 | 1E-3 | 0.01 | 0.1 | 1.0 | 3.0 | 5.0 | 10 | 15 | 20 | 25 | 30 | 36 |
| | 1000 | 1000 | 1000 | 1000 | 1000 | 1000 | 1000 | 1000 | 1000 | 1000 | 1000 | 1000 | 1000 | 1000 | 1000 | 1000 |
| e | 1E-5 | 3E-5 | 5E-5 | 1E-4 | 1E-3 | 0.01 | 0.1 | 1.0 | 3.0 | 5.0 | 10 | 15 | 20 | 25 | 30 | 35 |
| | 5000 | 5000 | 5000 | 5000 | 5000 | 5000 | 5000 | 5000 | 5000 | 5000 | 5000 | 5000 | 5000 | 5000 | 5000 | 5000 |
| f | 1E-5 | 3E-5 | 5E-5 | 1E-4 | 1E-3 | 0.01 | 0.1 | 1.0 | 3.0 | 5.0 | 10 | 15 | 20 | 25 | 30 | 35 |
| | 1E4 | 1E4 | 1E4 | 1E4 | 1E4 | 1E4 | 1E4 | 1E4 | 1E4 | 1E4 | 1E4 | 1E4 | 1E4 | 1E4 | 1E4 | 1E4 |
| g | 1E-5 | 3E-5 | 5E-5 | 1E-4 | 1E-3 | 0.01 | 0.1 | 1.0 | 3.0 | 5.0 | 10 | 15 | 20 | 25 | 30 | 35 |
| | 2E4 | 2E4 | 2E4 | 2E4 | 2E4 | 2E4 | 2E4 | 2E4 | 2E4 | 2E4 | 2E4 | 2E4 | 2E4 | 2E4 | 2E4 | 2E4 |

note:
the upper and lower values of each box show the following values:
upper value: halogen content (atomic %) in the layer interface neighborhood region → (○E − 5 = ○ × $10^{-5}$ atomic %)
lower value: the region containing halogen atoms in an increased amount of the layer interface (Å) → (○E4 = ○ × 10Å)

TABLE 15

| | B1 | B2 | B3 | B4 | B5 | B6 | B7 | B8 | B9 | B10 | B11 | B12 | B13 | B14 | B15 | B16 |
|---|---|---|---|---|---|---|---|---|---|---|---|---|---|---|---|---|
| a | x | x | Δ | Δ | Δ | Δ | Δ | Δ | Δ | Δ | Δ | Δ | Δ | Δ | Δ | x |
| b | x | Δ | ○ | ○ | ○ | ○ | ○ | ○ | ○ | ○ | ○ | ○ | ○ | ○ | ○ | Δ |
| c | x | Δ | ○ | ○ | ○ | ○ | ○ | ○ | ○ | ○ | ○ | ○ | ○ | ○ | ○ | Δ |
| d | x | Δ | ○ | ○ | ○ | ○ | ○ | ○ | ○ | ○ | ○ | ○ | ○ | ○ | ○ | Δ |
| e | x | Δ | ○ | ○ | ○ | ○ | ○ | ○ | ○ | ○ | ○ | ○ | ○ | ○ | ○ | Δ |
| f | x | Δ | ○ | ○ | ○ | ○ | ○ | ○ | ○ | ○ | ○ | ○ | ○ | ○ | ○ | Δ |
| g | x | Δ | Δ | Δ | Δ | Δ | Δ | Δ | Δ | Δ | Δ | Δ | Δ | Δ | Δ | x |

TABLE 16

| film-forming conditions | layer constitution: photo-conductive layer | layer interface neighborhood region 1 | layer interface neighborhood region 2 | urface layer |
|---|---|---|---|---|
| flow rate of raw material gas | | | | |
| $SiH_4$ | 200 sccm | 200 sccm | 100 sccm | 100 sccm |
| $CH_4$ | 0 sccm | 0 sccm | 450 sccm | 450 sccm |
| He | 2000 sccm | 2000 sccm | 200 sccm | 200 sccm |
| $SiF_4$ | 0 sccm | 0~400 sccm | 0~400 sccm | 10 sccm |
| $B_2H_6$ | 0.5 ppm | 0.5 ppm | 0 ppm | 0 ppm |
| $H_2$ | 0 sccm | 0 sccm | 100 sccm | 100 sccm |
| inner pressure | 12 mTorr | 12~18 mTorr | 12~18 mTorr | 12 mTorr |
| microwave power applied | 650 W | 650 W | 630 W | 630 W |
| bias voltage applied | 90 V | 30~120 V | 30~120 V | 90 V |
| layer thickness | 25 μm | 0.005~2.0 μm*1<br>0.005~0.8 μm*2 | | 0.5 μm |

*1halogen rich region
*2hydrogen rich region

TABLE 17

| film-forming conditions | layer constitution: charge transportation layer | layer interface neighborhood region 1 | layer interface neighborhood region 2 | charge generation layer |
|---|---|---|---|---|
| flow rate of raw material gas | | | | |
| $SiH_4$ | 200 sccm | 200 sccm | 200 sccm | 200 sccm |
| $CH_4$ | 30 sccm | 30 sccm | 0 sccm | 0 sccm |
| He | 2500 sccm | 2500 sccm | 2000 sccm | 2000 sccm |
| $SiF_4$ | 0 sccm | 0~400 sccm | 0~400 sccm | 0 sccm |
| $B_2H_6$ | 1.0 ppm | 1.0 ppm | 0.5 ppm | 0.5 ppm |
| $H_2$ | 150 sccm | 150 sccm | 0 sccm | 0 sccm |
| inner pressure | 15 mTorr | 15~18 mTorr | 12~18 mTorr | 12 mTorr |
| microwave power applied | 620 W | 620 W | 650 W | 650 W |
| bias voltage applied | 70 V | 30~120 V | 30~120 V | 90 V |
| layer thickness | 20 μm | 0.005~2.0 μm*1<br>0.005~0.8 μm*2 | | 25 μm |

*1halogen rich region
*2hydrogen rich region

TABLE 18

| film-forming conditions | layer constitution: charge injection inhibition layer | photo-conductive layer |
|---|---|---|
| flow rate of raw material gas | | |
| $SiH_4$ | 200 sccm | 200 sccm |
| $CH_4$ | 50 sccm | 0 sccm |
| He | 300 sccm | 2000 sccm |
| $SiF_4$ | 0 sccm | 0 sccm |
| $B_2H_6$ | 1000 ppm | 0.5 ppm |
| $H_2$ | 10 sccm | 0 sccm |
| inner pressure | 12 mTorr | 12 mTorr |

TABLE 18-continued

| film-forming conditions | layer constitution: charge injection inhibition layer | photo-conductive layer |
|---|---|---|
| microwave power applied | 600 W | 650 W |
| bias voltage applied | 100 V | 90 V |
| layer thickness | 3 μm | 25 μm |

TABLE 19

| | Example 24 | | Example 25 | | Example 26 | | Example 27 | | Example 28 | |
|---|---|---|---|---|---|---|---|---|---|---|
| | A | B | A | B | A | B | A | B | A | B |
| charge retentivity | ◎ | ○ | ◎ | ◎ | ◎ | ◎ | ◎ | ◎ | ◎ | ◎ |
| photo-sensitivity | ◎ | ○ | ◎ | ◎ | ◎ | ◎ | ◎ | ◎ | ◎ | ◎ |
| residual potential | ◎ | ◎ | ◎ | ◎ | ◎ | ◎ | ◎ | ◎ | ◎ | ◎ |
| halftone reproduction | ◎ | ◎ | ◎ | ◎ | ◎ | ◎ | ◎ | ◎ | ◎ | ◎ |

| | Comparative Example 9 | | Comparative Example 10 | | Comparative Example 11 | | Comparative Example 12 | | Comparative Example 13 | |
|---|---|---|---|---|---|---|---|---|---|---|
| | A | B | A | B | A | B | A | B | A | B |
| charge retentivity | ○ | x | ○ | x | ◎ | Δ | ◎ | ○ | ◎ | ○ |
| photo-sensitivity | Δ | x | ○ | x | ○ | x | ◎ | Δ | ◎ | Δ |
| residual potential | Δ | x | ◎ | Δ | ◎ | ○ | ◎ | ○ | ○ | Δ |
| halftone reproduction | ○ | Δ | ◎ | Δ | ◎ | Δ | ○ | x | ◎ | ○ |

note)
A: ordinary image-forming process speed
B: image-forming process speed as much as 1.2 times higher than the process speed A

TABLE 20

| film-forming conditions | layer constitution: conductive layer | layer constitution: photo-surface layer |
|---|---|---|
| flow rate of raw material gas | | |
| $SiH_4$ | 200 sccm | 200 sccm |
| $CH_4$ | 0 sccm | 450 sccm |
| He | 2000 sccm | 200 sccm |
| $SiF_4$ | 0 sccm | 10 sccm |
| $B_2H_6$ | 0.5 ppm | 0 ppm |
| $H_2$ | 0 sccm | 100 sccm |
| inner pressure | 12 mTorr | 12 mTorr |
| microwave power applied | 650 W | 630 W |
| bias voltage applied | 90 V | 90 V |
| layer thickness | 25 μm | 0.5 μm |

TABLE 21

| film-forming conditions | layer constitution: charge injection inhibition layer | layer constitution: photo-conductive layer | layer constitution: surface layer |
|---|---|---|---|
| flow rate of raw material gas | | | |
| $SiH_4$ | 200 sccm | 200 sccm | 100 sccm |
| $CH_4$ | 50 sccm | 0 sccm | 450 sccm |
| He | 300 sccm | 2000 sccm | 200 sccm |
| $SiF_4$ | 0 sccm | 0 sccm | 10 sccm |
| $B_2H_6$ | 1000 ppm | 0.5 ppm | 0 ppm |
| $H_2$ | 10 sccm | 0 sccm | 100 sccm |
| inner pressure | 12 mTorr | 12 mTorr | 12 mTorr |
| microwave power applied | 600 W | 650 W | 630 W |

TABLE 21-continued

| film-forming conditions | layer constitution: charge injection inhibition layer | layer constitution: photo-conductive layer | layer constitution: surface layer |
|---|---|---|---|
| bias voltage applied | 100 V | 90 V | 90 V |
| layer thickness | 3 μm | 25 μm | 0.5 μm |

TABLE 22

| film-forming conditions | layer constitution: IR absorption layer | charge injection inhibition layer | photo-conductive layer | surface layer |
|---|---|---|---|---|
| flow rate of raw material gas | | | | |
| $SiH_4$ | 300 sccm | 200 sccm | 200 sccm | 100 sccm |
| $CH_4$ | 0 sccm | 50 sccm | 0 sccm | 450 sccm |
| He | 0 sccm | 300 sccm | 2000 sccm | 200 sccm |
| $SiF_4$ | 0 sccm | 0 sccm | 0 sccm | 10 sccm |
| $B_2H_6$ | 2800 ppm | 1000 ppm | 0.5 ppm | 0 ppm |
| $H_2$ | 0 sccm | 10 sccm | 0 sccm | 100 sccm |
| $GeH_4$ | 120 sccm | 0 sccm | 0 sccm | 0 sccm |
| inner pressure | 15 mTorr | 12 mTorr | 12 mTorr | 12 mTorr |
| microwave power applied | 660 W | 600 W | 650 W | 630 W |
| bias voltage applied | 100 V | 100 V | 90 V | 90 V |
| layer thickness | 0.5 μm | 3 μm | 25 μm | 0.5 μm |

TABLE 23

| film-forming conditions | layer constitution: charge injection inhibition layer | charge transportation layer | charge generation layer | surface layer |
|---|---|---|---|---|
| flow rate of raw material gas | | | | |
| $SiH_4$ | 200 sccm | 200 sccm | 200 sccm | 100 sccm |
| $CH_4$ | 50 sccm | 30 sccm | 0 sccm | 450 sccm |
| He | 300 sccm | 2500 sccm | 2000 sccm | 200 sccm |
| $SiF_4$ | 0 sccm | 0 sccm | 0 sccm | 10 sccm |
| $B_2H_6$ | 1000 ppm | 1.0 ppm | 0.5 ppm | 0 ppm |
| $H_2$ | 10 sccm | 150 sccm | 0 sccm | 100 sccm |
| inner pressure | 12 mTorr | 15 mTorr | 12 mTorr | 12 mTorr |
| microwave power applied | 600 W | 620 W | 650 W | 630 W |
| bias voltage applied | 100 V | 70 V | 90 V | 90 V |
| layer thickness | 3 μm | 20 μm | 25 μm | 0.5 μm |

TABLE 24

| film-forming conditions | layer constitution: charge injection inhibition layer | layer interface neighborhood region 1 | layer interface neighborhood region 2 | photo-conductive layer |
|---|---|---|---|---|
| flow rate of raw material gas | | | | |
| $SiH_4$ | 230 sccm | 230 sccm | 230 sccm | 230 sccm |
| $CH_4$ | 50 sccm | 50 sccm | 0 sccm | 0 sccm |
| He | 300 sccm | 300 sccm | 2000 sccm | 2000 sccm |
| $SiF_4$ | 0 sccm | 0~400 sccm | 0~400 sccm | 0 sccm |
| $H_2$ | 0 sccm | 0~1 slm | 0~1 slm | 0 sccm |
| $B_2H_6$ | 1000 ppm | 1000 ppm | 0.5 ppm | 0.5 ppm |
| inner pressure | 12 mTorr | 12~18 mTorr | 12~18 mTorr | 12 mTorr |
| microwave power | 600 W | 600~650 W | 600~650 W | 650 W |
| bias voltage | 100 V | 30~120 V | 30~120 V | 90 V |
| layer thickness | 3 μm | 0.005~2.0 μm*1<br>0.005~0.8 μm*2 | | 25 μm |

*1: halogen rich region
*2: hydrogen rich region

TABLE 25

| *halogen content % | the ratio of hydrogen content of the layer interface neighborhood region vs that of the corresponding bulk layer region | | | | | | | | | | | | |
|---|---|---|---|---|---|---|---|---|---|---|---|---|---|
| | 1.0 | 1.1 | 1.2 | 1.3 | 1.4 | 1.5 | 1.6 | 1.7 | 1.8 | 1.9 | 2.0 | 2.1 | 2.2 |
| 1E-5 | Δ | Δ | Δ | Δ | Δ | Δ | Δ | Δ | Δ | Δ | Δ | Δ | X |
| 3E-5 | Δ | Δ | Δ | Δ | Δ | Δ | Δ | Δ | Δ | Δ | Δ | Δ | Δ |
| 5E-5 | Δ | ○ | ○ | ○ | ○ | ○ | ○ | ○ | ○ | ○ | ○ | Δ | Δ |
| 1E-4 | Δ | ○ | ◎ | ◎ | ◎ | ◎ | ◎ | ◎ | ◎ | ○ | ○ | Δ | Δ |
| 1E-3 | Δ | ○ | ◎ | ◎ | ◎ | ◎ | ◎ | ◎ | ◎ | ○ | ○ | Δ | Δ |
| 0.01 | Δ | ○ | ◎ | ◎ | ◎ | ◎ | ◎ | ◎ | ◎ | ○ | ○ | Δ | Δ |
| 0.1 | Δ | ○ | ◎ | ◎ | ◎ | ◎ | ◎ | ◎ | ◎ | ○ | ○ | Δ | Δ |
| 1.0 | Δ | ○ | ◎ | ◎ | ◎ | ◎ | ◎ | ◎ | ◎ | ○ | ○ | Δ | Δ |
| 3.0 | Δ | ○ | ◎ | ◎ | ◎ | ◎ | ◎ | ◎ | ◎ | ○ | ○ | Δ | Δ |
| 5.0 | Δ | ○ | ◎ | ◎ | ◎ | ◎ | ◎ | ◎ | ◎ | ○ | ○ | Δ | Δ |
| 10 | Δ | ○ | ◎ | ◎ | ◎ | ◎ | ◎ | ◎ | ◎ | ○ | ○ | Δ | Δ |
| 15 | Δ | ○ | ◎ | ◎ | ◎ | ◎ | ◎ | ◎ | ◎ | ○ | ○ | Δ | Δ |
| 20 | Δ | ○ | ◎ | ◎ | ◎ | ◎ | ◎ | ◎ | ◎ | ○ | ○ | Δ | Δ |
| 25 | Δ | ○ | ○ | ○ | ○ | ○ | ○ | ○ | ○ | ○ | ○ | Δ | X |
| 30 | Δ | ○ | ○ | ○ | ○ | ○ | ○ | ○ | ○ | ○ | ○ | Δ | X |
| 35 | Δ | Δ | Δ | Δ | Δ | Δ | Δ | Δ | Δ | Δ | Δ | Δ | X |

note)
*: halogen content (%) in the layer interface neighborhood region → (○E-5 = ○ × $10^{-5}$%)

TABLE 26

| the region containing halogen atoms in an increased amount (Å) | the region containing hydrogen atoms in an increased amount (Å) | | | | | | |
|---|---|---|---|---|---|---|---|
| | 50 | 100 | 500 | 1000 | 3000 | 5000 | 8000 |
| 50 | Δ | Δ | Δ | Δ | Δ | Δ | Δ |
| 100 | Δ | ○ | ○ | ○ | ○ | ○ | Δ |
| 500 | Δ | ○ | ◎ | ◎ | ◎ | ○ | Δ |
| 1000 | Δ | ○ | ◎ | ◎ | ◎ | ○ | Δ |
| 3000 | Δ | ○ | ◎ | ◎ | ◎ | ○ | Δ |
| 5000 | Δ | ○ | ◎ | ◎ | ◎ | ○ | Δ |
| 8000 | Δ | ○ | ○ | ○ | ○ | ○ | Δ |
| 1E4 | Δ | ○ | ○ | ○ | ○ | ○ | Δ |
| 2E4 | Δ | Δ | Δ | Δ | Δ | Δ | X |

note:
the region containing halogen atoms in an increased amount of the layer interface neighborhood region: (○E4 = ○ × $10^4$ Å)

TABLE 27

| film-forming conditions | layer constitution | | | | |
|---|---|---|---|---|---|
| | charge injection inhibition layer | photo-conductive layer | layer interface neighborhood region 1 | layer interface neighborhood region 2 | surface layer |
| flow rate of raw material gas | | | | | |
| $SiH_4$ | 230 sccm | 230 sccm | 230 sccm | 100 sccm | 100 sccm |
| $CH_4$ | 50 sccm | 0 sccm | 0 sccm | 450 sccm | 450 sccm |
| He | 300 sccm | 2000 sccm | 2000 sccm | 200 sccm | 200 sccm |
| $SiF_4$ | 0 sccm | 0 sccm | 0~400 sccm | 0~400 sccm | 0 sccm |
| $H_2$ | 0 sccm | 0 sccm | 0~1 slm | 0~1 slm | 0 sccm |
| $B_2H_6$ | 1000 ppm | 0.5 ppm | 0.5 ppm | 0 ppm | 0 ppm |
| inner pressure | 12 mTorr | 12 mTorr | 12~18 mTorr | 12~18 mTorr | 12 mTorr |
| microwave power applied | 600 W | 650 W | 630~650 W | 630~650 W | 630 W |
| bias voltage applied | 100 V | 90 V | 30~120 V | 30~120 V | 90 V |
| layer thickness | 3 μm | 25 μm | 0.005~2.0 μm*1<br>0.005~0.8 μm*2 | | 0.5 μm |

*1: halogen rich region
*2: hydrogen rich region

TABLE 28

| film-forming conditions | layer constitution | | | | |
|---|---|---|---|---|---|
| | charge injection inhibition layer | charge transportation layer | layer interface neighborhood region 1 | layer interface neighborhood region 2 | charge generation layer |
| flow rate of raw material gas | | | | | |
| $SiH_4$ | 230 sccm | 230 sccm | 230 sccm | 230 sccm | 230 sccm |
| $CH_4$ | 50 sccm | 30 sccm | 30 sccm | 0 sccm | 0 sccm |
| He | 300 sccm | 2500 sccm | 2500 sccm | 2000 sccm | 2000 sccm |
| $SiF_4$ | 0 sccm | 0 sccm | 0~400 sccm | 0~400 sccm | 0 sccm |

TABLE 28-continued

| film-forming conditions | layer constitution: charge injection inhibition layer | charge transportation layer | layer interface neighborhood region 1 | layer interface neighborhood region 2 | charge generation layer |
|---|---|---|---|---|---|
| $H_2$ | 0 sccm | 0 sccm | 0~1 slm | 0~1 slm | 0 sccm |
| $B_2H_6$ | 1000 ppm | 1.0 ppm | 1.0 ppm | 0.5 ppm | 0.5 ppm |
| inner pressure | 12 mTorr | 15 mTorr | 15~18 mTorr | 12~18 mTorr | 12 mTorr |
| microwave power applied | 600 W | 620 W | 620~650 W | 620~650 W | 650 W |
| bias voltage applied | 100 V | 70 V | 30~120 V | 30~120 V | 90 V |
| layer thickness | 3 μm | 20 μm | 0.005~2.0 μm*1<br>0.005~0.8 μm*2 | | 25 μm |

*1: halogen rich region
*2: hydrogen rich region

TABLE 29

| film-forming conditions | layer constitution: charge injection inhibition layer | photo-conductive layer |
|---|---|---|
| flow rate of raw material gas | | |
| $SiH_4$ | 230 sccm | 230 sccm |
| $CH_4$ | 50 sccm | 0 sccm |
| He | 300 sccm | 2000 sccm |
| $SiF_4$ | 0 sccm | 0 sccm |
| $B_2H_6$ | 1000 ppm | 0.5 ppm |
| $H_2$ | 0 sccm | 0 sccm |

TABLE 29-continued

| film-forming conditions | layer constitution: charge injection inhibition layer | photo-conductive layer |
|---|---|---|
| inner pressure | 12 mTorr | 12 mTorr |
| microwave power applied | 600 W | 630 W |
| bias voltage applied | 100 V | 90 V |
| layer thickness | 3 μm | 25 μm |

TABLE 30

| | Example 39 | | Example 40 | | Example 41 | | Example 42 | | Example 43 | | Example 44 | |
|---|---|---|---|---|---|---|---|---|---|---|---|---|
| | A | B | A | B | A | B | A | B | A | B | A | B |
| charge retentivity | ◎ | ○ | ◎ | ◎ | ◎ | ◎ | ◎ | ◎ | ◎ | ◎ | ◎ | ◎ |
| photo-sensitivity | ◎ | ○ | ◎ | ◎ | ◎ | ◎ | ◎ | ◎ | ◎ | ◎ | ◎ | ◎ |
| appearance of faint image | ◎ | ◎ | ◎ | ◎ | ◎ | ◎ | ◎ | ◎ | ◎ | ◎ | ◎ | ◎ |
| residual potential | ◎ | ◎ | ◎ | ◎ | ◎ | ◎ | ◎ | ◎ | ◎ | ◎ | ◎ | ◎ |
| appearance of white spots | ◎ | ◎ | ◎ | ◎ | ◎ | ◎ | ◎ | ◎ | ◎ | ◎ | ◎ | ◎ |
| appearance of smeared image | ◎ | ◎ | ◎ | ◎ | ◎ | ◎ | ◎ | ◎ | ◎ | ◎ | ◎ | ◎ |
| appearance of ghost | ◎ | ◎ | ◎ | ◎ | ◎ | ◎ | ◎ | ◎ | ◎ | ◎ | ◎ | ◎ |
| halftone reproduction | ◎ | ◎ | ◎ | ◎ | ◎ | ◎ | ◎ | ◎ | ◎ | ◎ | ◎ | ◎ |

| | Comparative Example 14 | | Comparative Example 15 | | Comparative Example 16 | | Comparative Example 17 | | Comparative Example 18 | | Comparative Example 19 | |
|---|---|---|---|---|---|---|---|---|---|---|---|---|
| | A | B | A | B | A | B | A | B | A | B | A | B |
| charge retentivity | ○ | X | ○ | X | ◎ | Δ | ◎ | ○ | ◎ | ○ | ◎ | ○ |
| photo-sensitivity | Δ | X | ○ | X | ○ | X | ◎ | Δ | ◎ | Δ | ◎ | Δ |
| appearance of faint image | Δ | X | ○ | X | ○ | X | ○ | X | ○ | Δ | ○ | Δ |
| residual potential | Δ | X | ◎ | Δ | ◎ | ○ | ◎ | ○ | ○ | Δ | ◎ | ○ |
| appearance of | ○ | Δ | ◎ | ○ | ◎ | ○ | ◎ | ○ | ◎ | ○ | ◎ | ○ |

TABLE 30-continued

| | | | | | | | | | | | | |
|---|---|---|---|---|---|---|---|---|---|---|---|---|
| white spots | | | | | | | | | | | | |
| appearance of smeared image | Δ | X | ○ | Δ | ○ | Δ | ○ | Δ | ⊙ | ○ | ⊙ | ○ |
| appearance of ghost | Δ | X | ○ | X | ○ | X | ⊙ | ○ | ⊙ | ○ | ⊙ | ○ |
| halftone reproduction | ○ | Δ | ⊙ | Δ | ⊙ | Δ | ○ | X | ⊙ | ○ | ⊙ | ○ |

note)
A: ordinary image-forming process speed
B: image-forming process speed as much as 1.2 times higher than the process speed A

TABLE 31

| layer constitution film-forming conditions | photo-conductive layer | surface layer |
|---|---|---|
| flow rate of raw material gas | | |
| $SiH_4$ | 230 sccm | 100 sccm |
| $CH_4$ | 0 sccm | 450 sccm |
| He | 2000 sccm | 200 sccm |
| $SiF_4$ | 0 sccm | 0 sccm |
| $B_2H_6$ | 0.5 ppm | 0 ppm |
| $H_2$ | 0 sccm | 100 sccm |
| inner pressure | 12 mTorr | 12 mTorr |
| microwave power applied | 650 W | 630 W |
| bias voltage applied | 90 V | 90 V |
| layer thickness | 25 μm | 0.5 μm |

TABLE 32

| layer constitution film-forming conditions | charge injection inhibition layer | photo-conductive layer | surface layer |
|---|---|---|---|
| flow rate of raw material gas | | | |
| $SiH_4$ | 230 sccm | 230 sccm | 100 sccm |
| $CH_4$ | 50 sccm | 0 sccm | 450 sccm |
| He | 300 sccm | 2000 sccm | 200 sccm |
| $SiF_4$ | 0 sccm | 0 sccm | 0 sccm |
| $B_2H_6$ | 1000 ppm | 0.5 ppm | 0 ppm |
| $H_2$ | 10 sccm | 0 sccm | 100 sccm |
| inner pressure | 12 mTorr | 12 mTorr | 12 mTorr |
| microwave power applied | 600 W | 650 W | 630 W |
| bias voltage applied | 100 V | 90 V | 90 V |
| layer thickness | 3 μm | 25 μm | 0.5 μm |

TABLE 33

| layer constitution film-forming conditions | IR-absorp-tion layer | charge injection inhibition layer | photo-conductive layer | surface layer |
|---|---|---|---|---|
| flow rate of raw material gas | | | | |
| $SiH_4$ | 300 sccm | 230 sccm | 230 sccm | 100 sccm |
| $CH_4$ | 0 sccm | 50 sccm | 0 sccm | 450 sccm |
| He | 0 sccm | 300 sccm | 2000 sccm | 200 sccm |
| $SiF_4$ | 0 sccm | 0 sccm | 0 sccm | 0 sccm |
| $B_2H_6$ | 2800 ppm | 1000 ppm | 0.5 ppm | 0 ppm |
| $H_2$ | 0 sccm | 10 sccm | 0 sccm | 100 sccm |
| $GeH_4$ | 120 sccm | 0 sccm | 0 sccm | 0 sccm |
| inner | 15 mTorr | 12 mTorr | 12 mTorr | 12 mTorr |

TABLE 33-continued

| layer constitution film-forming conditions | IR-absorp-tion layer | charge injection inhibition layer | photo-conductive layer | surface layer |
|---|---|---|---|---|
| pressure | | | | |
| microwave power applied | 650 W | 600 W | 650 W | 630 W |
| bias voltage applied | 100 V | 100 V | 90 V | 90 V |
| layer thickness | 0.5 μm | 3 μm | 25 μm | 0.5 μm |

TABLE 34

| layer constitution film-forming conditions | charge injection inhibition layer | charge transpor-tation layer | charge genera-tion layer | surface layer |
|---|---|---|---|---|
| flow rate of raw material gas | | | | |
| $SiH_4$ | 230 sccm | 230 sccm | 230 sccm | 100 sccm |
| $CH_4$ | 50 sccm | 30 sccm | 0 sccm | 450 sccm |
| He | 300 sccm | 2500 sccm | 2000 sccm | 200 sccm |
| $SiF_4$ | 0 sccm | 0 sccm | 0 sccm | 0 sccm |
| $B_2H_6$ | 1000 ppm | 1.0 ppm | 0.5 ppm | 0 ppm |
| $H_2$ | 10 sccm | 150 sccm | 0 sccm | 100 sccm |
| inner pressure | 12 Ttorr | 15 mTorr | 12 mTorr | 12 mTorr |
| microwave power applied | 600 W | 620 W | 650 W | 630 W |
| bias voltage applied | 100 V | 70 V | 90 V | 90 V |
| layer thickness | 3 μm | 20 μm | 25 μm | 0.5 μm |

TABLE 35

| layer constitution film-forming conditions | photo-conductive layer | surface layer |
|---|---|---|
| flow rate of raw material gas | | |
| $SiH_4$ | 300→200 sccm | 100 sccm |
| $CH_4$ | 100→0 sccm | 450 sccm |
| He | 1000 sccm | 200 sccm |
| $SiF_4$ | 0 sccm | 20 sccm |
| $B_2H_6$ | 300→0.3 ppm | 0 ppm |
| $H_2$ | 400→0 sccm | 100 sccm |
| inner pressure | 11 mTorr | 12 mTorr |
| microwave power applied | 670 W | 630 W |

TABLE 35-continued

| layer constitution film-forming conditions | photo-conductive layer | surface layer |
|---|---|---|
| bias voltage applied | 80 V | 90 V |
| layer thickness | 27 μm | 0.5 μM |

What is claimed is:

1. A light receiving member comprising a substrate and a light receiving layer disposed on said substrate, said light receiving layer having a stacked structure comprising a plurality of constituent layers being stacked on said substrate, each of said plurality of constituent layers being composed of a non-single crystal material containing silicon atoms as a matrix and at least one kind of atom selected from the group consisting of hydrogen atoms and halogen atoms, characterized in that at least one layer of adjacent layers of said plurality of constituent layers has a 100 to 10,000Å thick interface neighborhood region in the vicinity of the interface between said adjacent layers, said interface neighborhood region containing said at least one kind of atom selected from hydrogen atoms and halogen atoms at a concentration which is greater than the concentration of said at least one kind of atom selected from hydrogen atoms and halogen atoms contained in said one layer excluding said interface neighborhood region.

2. A light receiving member according to claim 1, wherein the content of said at least one kind of atom selected from the hydrogen and halogen atoms contained in the interface neighborhood region is greater than a content of hydrogen and/or halogen atoms contained in the other layer of the adjacent layers.

3. A light receiving member according to claim 2, wherein the content of said at least one kind of atom selected from the hydrogen and halogen atoms contained in the interface neighborhood region is 1.1 to 2.0 times a content of hydrogen and/or halogen atoms contained in one of the adjacent layers excluding the interface neighborhood region and which is the greatest in terms of the content of said hydrogen and/or halogen atoms among the adjacent layers.

4. A light receiving member according to claim 1, wherein the interface neighborhood region is of a thickness corresponding 30% or less of the thickness of one of the adjacent layers excluding an interface neighborhood region and which is the thinnest among the adjacent layers.

5. A light receiving member according to claim 1, wherein the content of said at least one kind of atom selected from the hydrogen and halogen atoms contained in the interface neighborhood region is 1.1 to 2.0 times a content of hydrogen and/or halogen atoms contained in one of the adjacent layers excluding an interface neighborhood region and which is the greatest in terms of the content of said hydrogen and/or halogen atoms among the adjacent layers.

6. A light receiving member according to claim 1, wherein the interface neighborhood region is shared by the other layer of the adjacent layers.

7. A light receiving member according to claim 1, wherein one of the plurality of constituent layers has a free surface, said constituent layer having said free surface having a 100 to 10,000Å thick region in the vicinity of said free surface, said region containing at least one kind of atom selected from hydrogen and halogen atoms at a concentration which is greater than a content of the hydrogen and/or halogen atoms contained in said constituent layer excluding said region.

8. A light receiving member according to claim 7, wherein the 100 to 10,000Å thick region possessed by the constituent layer having a free surface contains the at least one kind of hydrogen and halogen atoms in a state that the atoms are unevenly distributed in the thickness direction.

9. A light receiving member according to claim 1, wherein one of the plurality of constituent layers contacts the surface of the substrate, said constituent layer having a 100 to 10,000Å thick region which contacts the surface of the substrate and wherein said 100 to 10,000Å thick region contains at least one kind of atom selected from hydrogen and halogen atoms at a concentration which is greater than a content of at least one hydrogen and halogen atoms contained in said constituent layer excluding said 100 to 10,000Å thick region.

10. A light receiving member according to claim 9, wherein the region in contact with the surface of the substrate contains at least one kind of atom selected from the group consisting of hydrogen atoms and halogen atoms wherein the atoms are unevenly distributed in the thickness direction.

11. A light receiving member according to claim 1, wherein the at least one kind of atom selected from the group consisting of hydrogen and halogen atoms are contained in the interface neighborhood region such that the at least one kind of atom are unevenly distributed in the thickness direction.

12. A light receiving member according to claim 1 wherein the 100 to 10,000Å thick interface neighborhood region possessed by the constituent layer contains said at least one kind of hydrogen atoms and halogen atoms in a state that the atoms are unevenly distributed in the thickness direction.

13. A light receiving member according to claim 1, wherein the plurality of constituent layers comprise a charge injection inhibition layer and a photoconductive layer.

14. A light receiving member according to claim 13 which further comprises a surface layer.

15. A light receiving member according to claim 14, wherein the surface layer contains at least one kind of atoms selected from the group consisting of carbon atoms, nitrogen atoms and oxygen atoms.

16. A light receiving member according to claim 13, wherein the charge injection inhibition layer contains atoms of an element belonging to group III or V of the periodic table.

17. A light receiving member according to claim 1, wherein the plurality of constituent layers comprise a charge transportation layer and a charge generation layer.

18. A light receiving member according to claim 17 which further comprises a surface layer.

19. A light receiving member according to claim 18, wherein the surface layer contains at least one kind of atoms selected from the group consisting of carbon atoms, nitrogen atoms and oxygen atoms.

20. A light receiving member according to claim 1, wherein the plurality of constituent layers comprise a photoconductive layer and a surface layer.

21. A light receiving member according to claim 20 which further comprises a charge injection inhibition layer.

22. A light receiving member according to claim 21, wherein the charge injection inhibition layer contains atoms of an element belonging to group III or V of the periodic table.

23. A light receiving member according to claim 20, wherein the surface layer contains at least one kind of atoms selected from the group consisting of carbon atoms, nitrogen atoms and oxygen atoms.

24. A light receiving member according to claim 1, wherein the interface neighborhood region contains the hydrogen atoms in an amount of 0.1 to 45 atomic %.

25. A light receiving member according to claim 1, wherein the interface neighborhood region contains the halogen atoms in an amount of 0.5 atomic ppm to 30 atomic %.

26. A light receiving member according to claim 1, wherein the one layer excluding the interface neighborhood region contains the hydrogen atoms in an amount of 0.05 to 40 atomic %.

27. A light receiving member according to claim 1, wherein the one layer excluding the interface neighborhood region contains the halogen atoms in an amount of 0.05 atomic ppm to 20 atomic %.

28. A light receiving member according to claim 1, wherein the one layer excluding the interface neighborhood region contains the hydrogen atoms and the halogen atoms in a total amount of 0.3 to 50 atomic %.

29. A light receiving member according to claim 1, wherein at least one of the plurality of constituent layers further contains atoms of an element belonging to group III or V of the periodic table.

30. A light receiving member according to claim 1, wherein at least one of the plurality of constituent layers further contains at least one kind of atoms selected from the group consisting of carbon atoms, nitrogen atoms and oxygen atoms.

31. A light receiving member according to claim 1, wherein one of the adjacent constituent layers contains atoms of a given element which are not contained in the other constituent layer.

32. A light receiving member according to claim 1, wherein one of the adjacent constituent layers has a chemical composition which is different from that of the other adjacent constituent layer.

33. A light receiving member according to claim 1, wherein the interface neighborhood region contains the at least one kind of hydrogen atoms and halogen atoms such that their concentration is maximized at the interface.

34. A light receiving member according to claim 1, wherein the interface neighborhood region contains both the hydrogen and halogen atoms, and the one layer excluding the interface neighborhood region substantially contains the hydrogen atoms only.

* * * * *